US009186883B2

(12) United States Patent
Ono et al.

(10) Patent No.: US 9,186,883 B2
(45) Date of Patent: Nov. 17, 2015

(54) LIQUID CONTAINER

(71) Applicant: Seiko Epson Corporation, Tokyo (JP)

(72) Inventors: Atsushi Ono, Matsumoto (JP); Ryoichi Tanaka, Shiojiri (JP); Toshinobu Yamazaki, Matsumoto (JP); Shigenori Nakagawa, Tatsuno-machi (JP); Takeshi Iwamuro, Matsumoto (JP); Naoki Naito, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/472,669

(22) Filed: Aug. 29, 2014

(65) Prior Publication Data

US 2015/0062266 A1 Mar. 5, 2015

(30) Foreign Application Priority Data

Sep. 4, 2013 (JP) ..... 2013-182846

(51) Int. Cl.

| | |
|---|---|
| ***B41J 2/175*** | (2006.01) |
| ***B41J 2/19*** | (2006.01) |
| ***B41J 2/00*** | (2006.01) |

(52) U.S. Cl.

CPC .. *B41J 2/00* (2013.01); *B41J 2/175* (2013.01); *B41J 2/1752* (2013.01); *B41J 2/1753* (2013.01); *B41J 2/17513* (2013.01); *B41J 2/17523* (2013.01); *B41J 2/17553* (2013.01); *B41J 2/17563* (2013.01)

(58) Field of Classification Search

USPC ..... 347/86, 87, 92, 93

See application file for complete search history.

(56) References Cited

U.S. PATENT DOCUMENTS

| | | | | |
|---|---|---|---|---|
| 5,828,395 | A * | 10/1998 | Takata | 347/86 |
| 6,120,140 | A * | 9/2000 | Hirosawa et al. | 347/93 |
| 6,158,855 | A * | 12/2000 | Saikawa | 347/93 |
| 6,270,211 | B1 * | 8/2001 | Long et al. | 347/92 |
| 6,296,352 | B1 * | 10/2001 | Hollands et al. | 347/86 |
| 6,540,343 | B1 * | 4/2003 | Umeyama et al. | 347/93 |
| 6,626,528 | B2 * | 9/2003 | Tsukuda | 347/93 |
| 7,063,414 | B2 * | 6/2006 | Harakawa | 347/93 |
| 7,690,777 | B2 * | 4/2010 | Wada | 347/93 |
| 7,931,361 | B2 * | 4/2011 | Nishizaki | 347/94 |
| 8,480,214 | B2 * | 7/2013 | Tsubaki | 347/85 |
| 2003/0227525 | A1 | 12/2003 | Kim et al. | |

FOREIGN PATENT DOCUMENTS

| | | |
|---|---|---|
| JP | 2004-009730 | 1/2004 |
| JP | 2012-152985 | 8/2012 |

* cited by examiner

*Primary Examiner* — Anh T. N. Vo

(57) ABSTRACT

A liquid container capable of containing a liquid has a flow passage that is formed in the liquid container and through which the liquid flows, and a filter 166 provided in the middle of the flow passage. The filter 166 inclines in a direction with respect to the horizontal direction.

9 Claims, 31 Drawing Sheets

LIQUID CONTAINER

BACKGROUND

1. Technical Field

The present invention relates to a liquid container for containing a liquid to be supplied to a liquid consuming apparatus.

2. Related Art

Heretofore, an inkjet printer, which performs printing (recording) by ejecting ink (liquid) onto a target such as a paper from a liquid ejection head, is known as a kind of liquid consuming apparatus. In this kind of printer, for example, there are cases where an air bubble mixing with the ink when the ink is injected into a liquid container blocks an ink flow passage or obstructs a flow of the ink. Moreover, if the air bubble mixing with the ink is supplied to the head, there is a possibility that a discharge failure such as dot omission is caused by this air bubble.

To solve this problem, for example, a liquid container described in JP-A-2004-9730 includes a filter having a protruding shape. Not only is ink filtered using this filter, but also is an air bubble that has flowed into the ink moved to an edge portion of the filter due to the filter having a protruding shape, thereby achieving smooth supply of the ink to a head.

However, in the case of moving the air bubble to the edge portion of the filter as in JP-A-2004-9730, air bubbles are accumulated at the filter with a lapse of time since the air bubbles remain at the filter, which is considered to adversely affect ink supply through the filter.

SUMMARY

The invention can be realized in the following modes or application examples.

Application example 1: A liquid container capable of containing a liquid includes: a flow passage that is formed in the liquid container and through which the liquid flows; and a filter provided in the middle of the flow passage. The filter inclines in a direction with respect to a horizontal direction.

In this liquid container, the filter provided in the flow passage in the liquid container inclines in a direction with respect to the horizontal direction. As a result of the filter inclining in a direction with respect to the horizontal direction, an air bubble that has flowed into the ink moves in the inclining direction, without remaining at the filter. With this configuration, adverse influence of air bubbles being accumulated at the filter can be suppressed.

Application example 2: In the above-described liquid container, the filter inclines such that an end portion of the filter that is located on an upstream side of the liquid passing through the filter is located vertically above an end portion of the filter that is located on a downstream side of the liquid.

In this liquid container, the filter inclines such that the end portion thereof which is located on the upstream side is located vertically above the end portion thereof which is located on the downstream side. Accordingly, an air bubble that has flowed into the ink moves toward the upstream side of the filter, without remaining at the filter. With this configuration, it is possible to suppress the air bubble being included in the ink supplied to a head due to the air bubble moving toward the downstream side.

Application example 3: The above-described liquid container further includes a plurality of liquid containing chambers each containing a liquid. The filter is provided in a filter chamber, and the filter chamber is in communication with a liquid containing chamber located at the highest position in a vertical direction, among the plurality of liquid containing chambers.

In this liquid container, the filter chamber is in communication with the liquid containing chamber located at the highest position. With this configuration, an air bubble that has moved from the filter chamber to the liquid containing chamber can be prevented from further moving into another liquid containing chamber.

Application example 4: In the above-described liquid container, the liquid containing chamber that is in communication with the filter chamber is provided with a rib that inclines with respect to the horizontal direction.

With this liquid container, an air bubble that has guided out from the filter chamber to the liquid containing chamber can be moved by the rib inclining with respect to the horizontal direction, toward the upper liquid surface without causing the air bubble to remain at the rib.

Application example 5: In the above-described liquid container, a vertically upper face of the liquid containing chamber that is in communication with the filter chamber is provided with an air intake that is capable of taking, into the liquid containing chamber, the air coming from the outside of the liquid container.

In this liquid container, the air intake capable of taking in the air coming from the outside is provided in the vertically upper face of the liquid containing chamber. With this configuration, when many air bubbles that have guided out from the filter chamber to the liquid containing chamber remain in the liquid containing chamber, it is possible to suppress deformation or the like of the liquid container caused by the pressure of the remaining air bubbles.

Application example 6: In the above-described liquid container, the liquid containing chamber that is in communication with the filter chamber is provided with a guiding port that guides out, to the liquid containing chamber, an air bubble coming from the filter chamber, and the guiding port and the air intake are arranged at positions that overlap each other as seen in a plan view from the vertical direction.

In this liquid container, the guiding port that guides out an air bubble coming from the filter chamber and the air intake are arranged at the positions that overlap each other as seen in a plan view from the vertical direction. With this configuration, air bubbles that have guided out from the guiding port gather on the lower face of the air intake, and the air bubbles can be efficiently discharged to the outside.

Application example 7: In the above-described liquid container, the flow passage inclines so as to be located vertically above further on a downstream side of the filter chamber.

With this liquid container, when an air bubble is generated downstream of the filter chamber, the air bubble can be moved further downstream, without being retained in the flow passage.

Application example 8: The above-described liquid container further includes a float portion that floats with a change of a remaining amount of the liquid contained in the liquid container. The filter inclines such that an end portion of the filter that is located on the side of the float portion is located vertically below an end portion of the filter that is located on a side opposite to the float portion.

In this liquid container, the filter inclines such that the end portion thereof which is located on the side of the float portion is located vertically below the end portion thereof which is located on the opposite side. Accordingly, the air bubble moves toward the side opposite to the float portion, without remaining at the filter. With this configuration, it is possible to avoid occurrence of a problem in the float portion due to the air bubble moving toward the float portion.

Application example 9: In the above-described liquid container, the filter is arranged such that the liquid passes therethrough from below to above in the vertical direction.

In this liquid container, the liquid passes through the filter from below to above in the vertical direction. With this configuration, a foreign object that has not passed through the filter does not remain at the filter but subsides, and the filter being blocked by the foreign object can be reduced.

BRIEF DESCRIPTION OF THE DRAWINGS

The invention will be described with reference to the accompanying drawings, wherein like numbers reference like elements.

FIG. 9A is a perspective view showing a state where an injection port is covered with a covering body, and FIG. 9B is a perspective view showing a state where the covering body is removed from the injection port.

FIG. 12A is a cross-sectional view as seen along arrows B-B in FIG. 10, and FIG. 12B is a cross-sectional view as seen along arrows C-C in FIG. 10.

DESCRIPTION OF EXEMPLARY EMBODIMENTS

The following describes an embodiment of a liquid container and an inkjet printer (hereinafter referred to also as a "printer"), which is an example of a liquid consuming apparatus that consumes a liquid supplied from the liquid container, with reference to the drawings.

Figure 1:
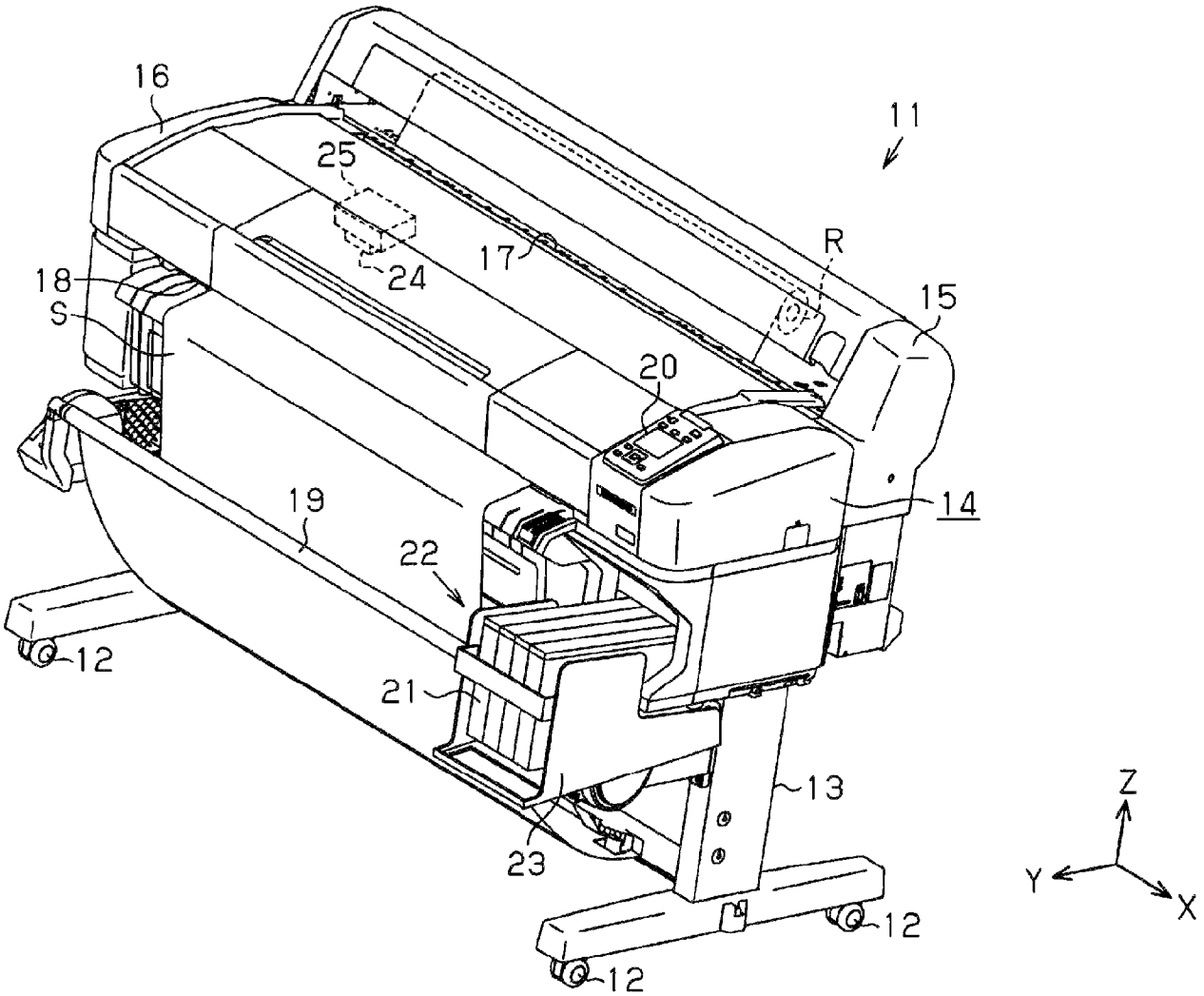
FIG. 1 is a perspective view of a printer to which liquid containers are fixed.

As shown in FIG. 1, a printer 11 in the present embodiment includes a leg portion 13 with wheels 12 attached to the lower end thereof, and a substantially rectangular parallelepiped apparatus body 14 installed on the leg portion 13. Note that, in the present embodiment, a direction aligned with the gravity direction is an up-down direction Z, and the long direction of the apparatus body 14 that intersects (in the present embodiment, that is perpendicular to) the up-down direction Z is a left-right direction X. A direction intersecting (in the present embodiment, a direction perpendicular to) both the up-down direction Z and the left-right direction X is a front-rear direction Y.

As shown in FIG. 1, a feeding portion 15 that protrudes upward is provided at the rear part of the apparatus body 14. Roll paper R formed by rolling up paper S, which serves as an elongated medium, into a cylindrical shape is loaded in the feeding portion 15. In a casing portion 16 constituting the exterior of the apparatus body 14, an insertion slot 17 for guiding, into the casing portion 16, the paper S sent out from the feeding portion 15 is formed at a position on the front side of the feeding portion 15.

Meanwhile, a discharge slot 18 for discharging the paper S out of the casing portion 16 is formed on the side of the front face of the apparatus body 14. Note that the casing portion 16 houses a medium conveyance mechanism (not shown) that conveys the paper S that is fed from the feeding portion 15, from the side of the insertion slot 17 toward the discharge slot 18. A medium receiving unit 19 that receives the paper S discharged from the discharge slot 18 is provided on the side of the front face of the apparatus body 14 at a position below the discharge slot 18.

An operation panel 20 for performing a setting operation and an input operation is provided in the upper part of the apparatus body 14 on one end side (in FIG. 1, right end side) that is the outside, in the left-right direction X, of a path for conveying the paper S. Furthermore, liquid containers 21 each capable of containing ink, which is an example of liquid, are fixed in the lower part of the apparatus body 14 on one end side (in FIG. 1, right end side) that is the outside, in the left-right direction X, of the path for conveying the paper S.

A plurality of (in the present embodiment, four) liquid containers 21 are provided so as to correspond to respective ink types or colors. The liquid containers 21 are arranged so as to be aligned with the left-right direction X, thereby constituting a liquid containing unit 22. Note that, in a state where the liquid containers 21 are fixed to the apparatus body 14, the liquid containing unit 22 has an exposed portion on the front side (outer side) of the apparatus body 14. The liquid containing unit 22 is covered with a frame member 23 that has a substantially U-shaped cross section and is fixed to the apparatus body 14, on both sides of the exposed portion in the left-right direction X and the lower side thereof in the up-down direction Z.

The casing portion 16 houses a carriage 25 on which a liquid ejection head 24 is placed, in a state where the carriage 25 can move back and forth in the left-right direction X, which serves as a main scanning direction. Note that the casing portion 16 houses a liquid supply mechanism (not shown) for supplying the inks contained in the liquid containers 21 toward the liquid ejection head 24. Recording (printing) is performed by ejecting ink droplets from the liquid ejection head 24 toward the paper S conveyed by the medium conveyance mechanism, and the inks in the liquid containers 21 are consumed through the ejection of ink droplets.

Figure 2:
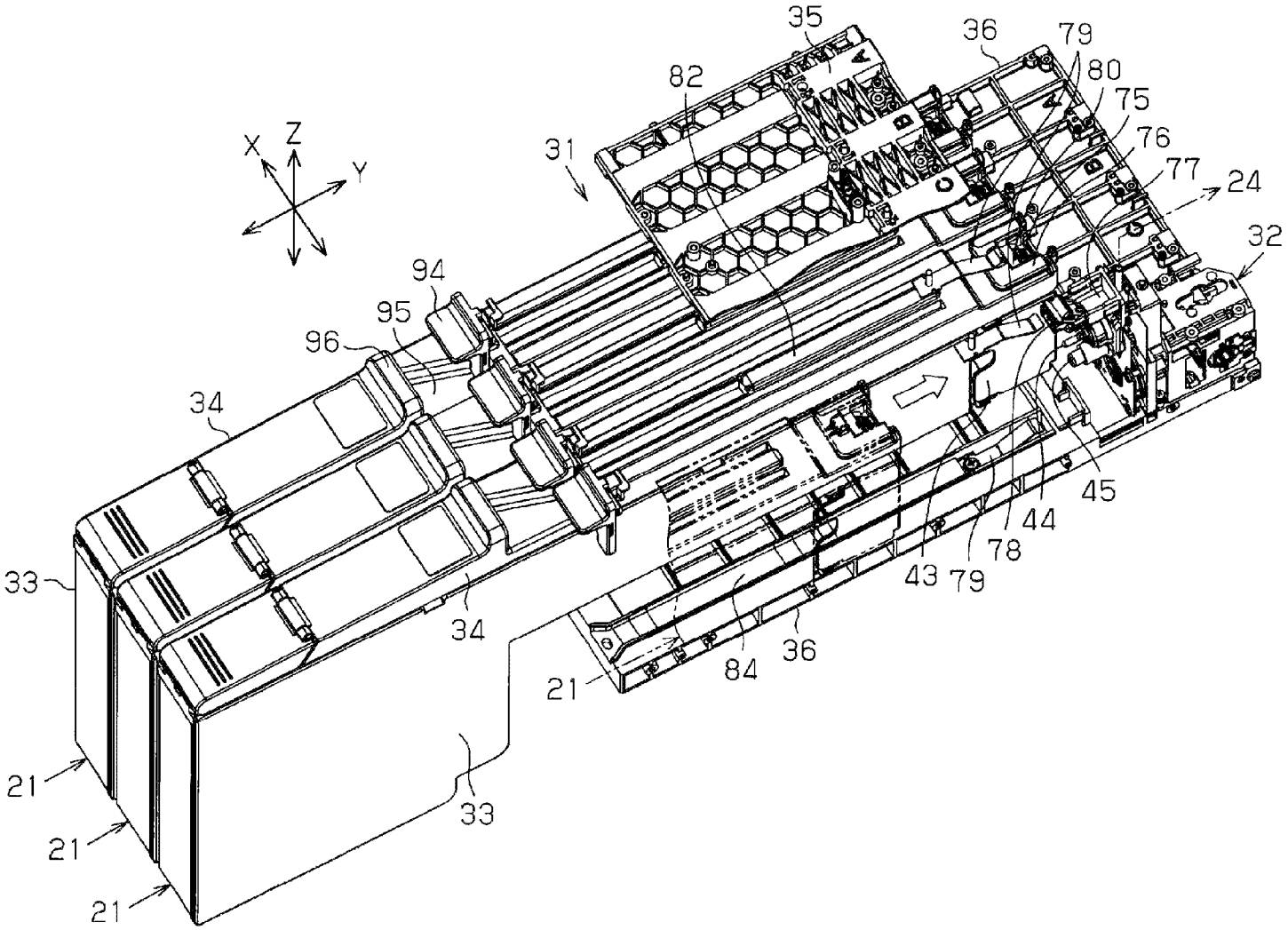
FIG. 2 is a perspective view showing a state where the liquid containers are installed in an installation portion.
Figure 3:
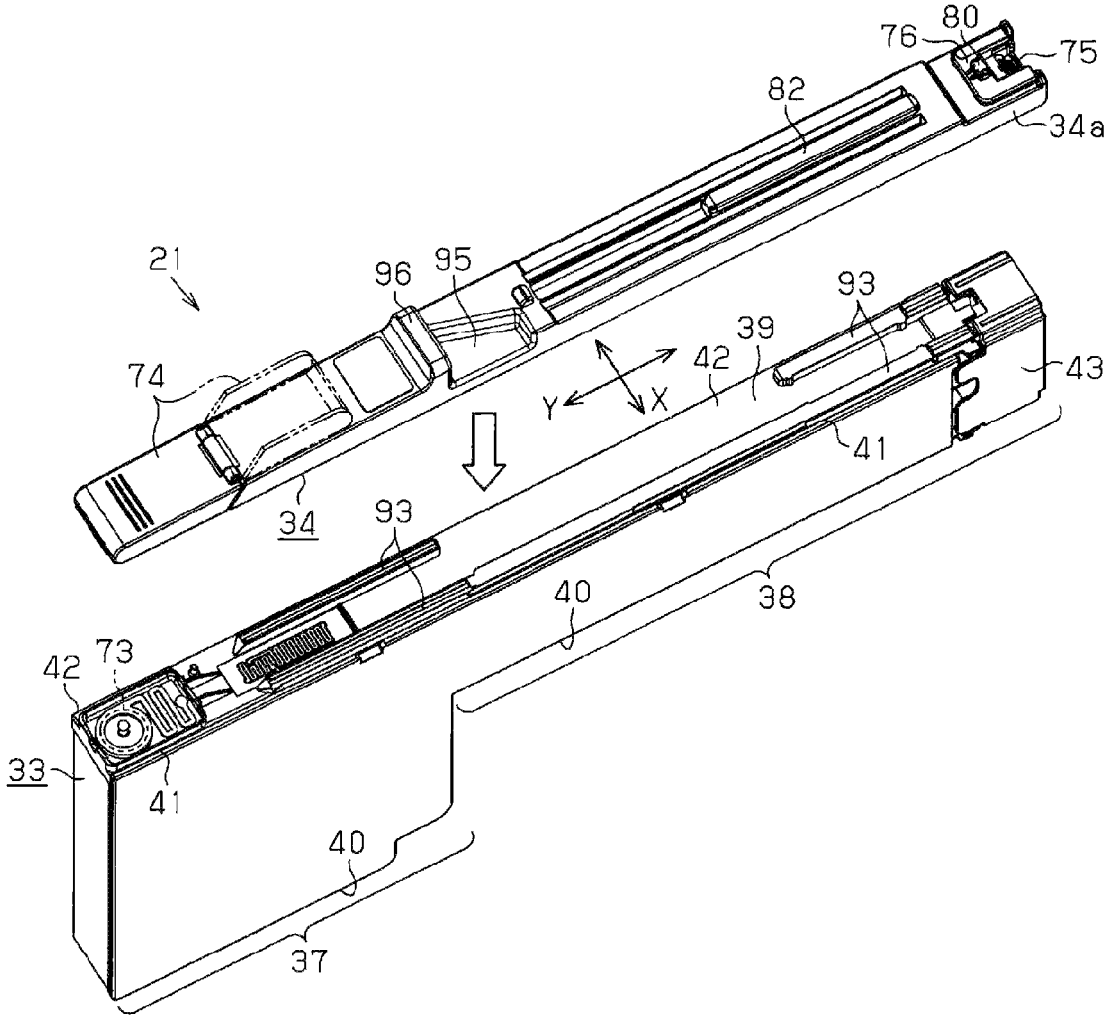
FIG. 3 is a perspective view showing a liquid container in a state where a slider is separated therefrom.

Next, a description will be given of an installation portion 31 with which the liquid containers 21 are installed onto the apparatus body 14 in a fixed state, and the liquid containers 21 fixed to the apparatus body 14 via the installation portion 31, with reference to FIGS. 2 and 3. Note that, in order to avoid complication of the drawing, FIG. 2 shows only one of supply portions 32, which are a part of the liquid supply mechanism for supplying the inks from the liquid containers 21 toward the liquid ejection head 24, and the liquid container 21 corresponding to the single supply portion 32 shown in FIG. 2 is shown in a state before being installed onto the installation portion 31, as indicated by chain double-dashed lines and an outlined arrow. FIG. 3 shows a state where the liquid containing body 33 and a slider 34 serving as an example of a sub-holding member, which constitute each liquid container 21, are separate from each other.

As shown in FIG. 2, the printer 11 is provided with the installation portion 31 having an upper frame 35 and a lower frame 36 that are arranged so as to be spaced apart with a predetermined interval in the vertical direction (the up-down direction Z). The supply portions 32, which are a part of the liquid supply mechanism, are attached to the installation portion 31 so as to correspond to the respective liquid containers 21. Note that FIG. 2 shows a state where a part of the upper frame 35 is fractured in the left-right direction X and removed.

The liquid containers 21 are fixed to the printer 11 so as to be unable to move, with one end side (in FIG. 2, right end side) of the liquid containers 21 in the long direction located within the installation portion 31. In a state where the liquid containers 21 are fixed to the printer 11, the inks contained in the liquid containers 21 are supplied toward the liquid ejection head 24 by the supply portions 32 attached to one end side of the liquid containers 21 so as to correspond to the respective liquid containers 21 in the installation portion 31. Accordingly, in the present embodiment, the posture of the liquid containers 21 when in use is in a state where the liquid containers 21 are installed onto the installation portion 31 of the printer 11 and are fixed to the printer 11 so as to be unable to move.

As shown in FIGS. 2 and 3, the liquid containers 21 in the present embodiment each include a liquid containing body 33 that contains ink, and the slider 34 arranged so as to be laid over the upper side of the liquid containing body 33 that is the side in the direction opposite to the gravity direction in the vertical direction.

Assuming that the direction perpendicular to the long direction of the apparatus body 14 in the substantially horizontal direction is the long direction (the front-rear direction Y) of the liquid containing body 33, the shape of the liquid containing body 33 is a substantially L-shaped rectangular parallelepiped, as seen in a side view, having a fixed width in the short direction (the left-right direction X) perpendicular to the long direction of the liquid containing body 33 in the substantially horizontal direction. That is to say, the liquid containing body 33 has a first containing body portion 37 with side faces having a substantially square shape as seen in the short direction of the liquid containing body 33 (the left-right direction X), and a second containing body portion 38 that is provided rearward of the first containing body portion 37 and has a substantially rectangular shape elongated in the front-rear direction Y. Flat face portions 41 and 42 extending continuously in the long direction (the front-rear direction Y) without a step are formed at both end portions of an upper face 39 of the liquid containing body 33 in the short direction, and the slider 34 can slide along these flat face portions 41 and 42. Meanwhile, a lower face 40 of the liquid containing body 33 has a shape with a stepped face, that is, the lower face of the first containing body portion 37 is lower than the lower face of the second containing body portion 38 in the long direction of the liquid containing body 33 (the front-rear direction Y).

In the present embodiment, a fixed portion 37*a* (see FIGS. 13, 14, and 20) provided on the lower face of the first containing body portion 37 is screwed with a fixation portion (not shown) provided in the apparatus body 14, using a screw 37*b* (see FIG. 20), and the liquid container 21 is thereby fixed to the printer 11 so as to be unable to move. Of the liquid containing body 33 fixed by screwing, almost all of the second containing body portion 38 serves as a second area located within the apparatus body 14 of the printer 11, and meanwhile, the first containing body portion 37 serves as a first area exposed frontward of the apparatus body 14 as a result of being located outside the apparatus body 14 of the printer 11.

Furthermore, the second containing body portion 38 includes a connecting portion 43 that is attached so as to be able to relatively move with respect to the second containing body portion 38 and is formed by a member separate from a casing member (a containing body case 130 shown in FIG. 13) constituting the liquid containing body 33, on the rear end side of the second containing body portion 38 that is opposite to the side of the first containing body portion 37 in the long direction of the second containing body portion 38. In the connecting portion 43, an ink flow passage for guiding the ink contained in the liquid containing body 33 to an ink supply needle 44 included in the supply portion 32 attached to the installation portion 31, and a transmission mechanism that transmits the status of the remaining ink in the liquid containing body 33 to an ink remaining amount detection bar 45 that is also included in the supply portion 32 are formed.

A configuration of the connecting portion 43 in which the ink flow passage and the transmission mechanism are formed will now be described with reference to FIGS. 4 and 5. Note that FIGS. 4 and 5 show constituent members of the supply needle 44 and the remaining amount detection bar 45 among constituent members of the supply portion 32, and omit other members as appropriate.

Figure 4:
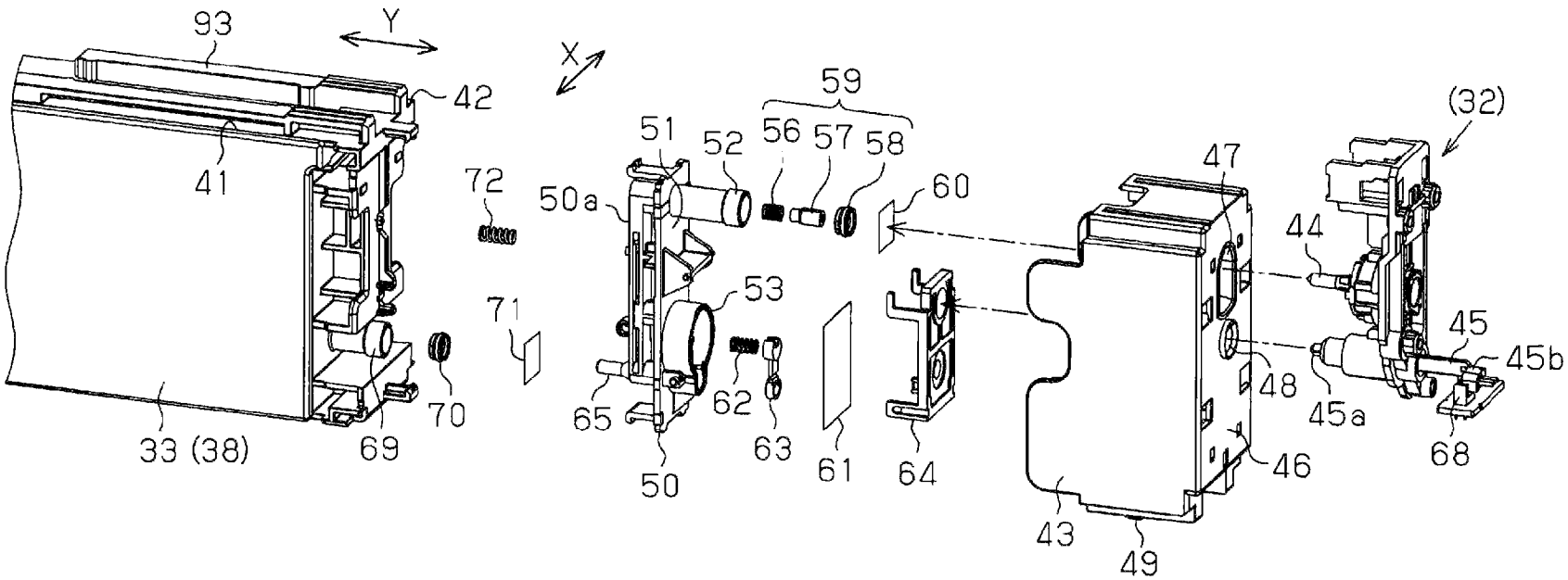
FIG. 4 is an exploded perspective view showing a configuration of a connecting portion provided in the liquid container.
Figure 5:
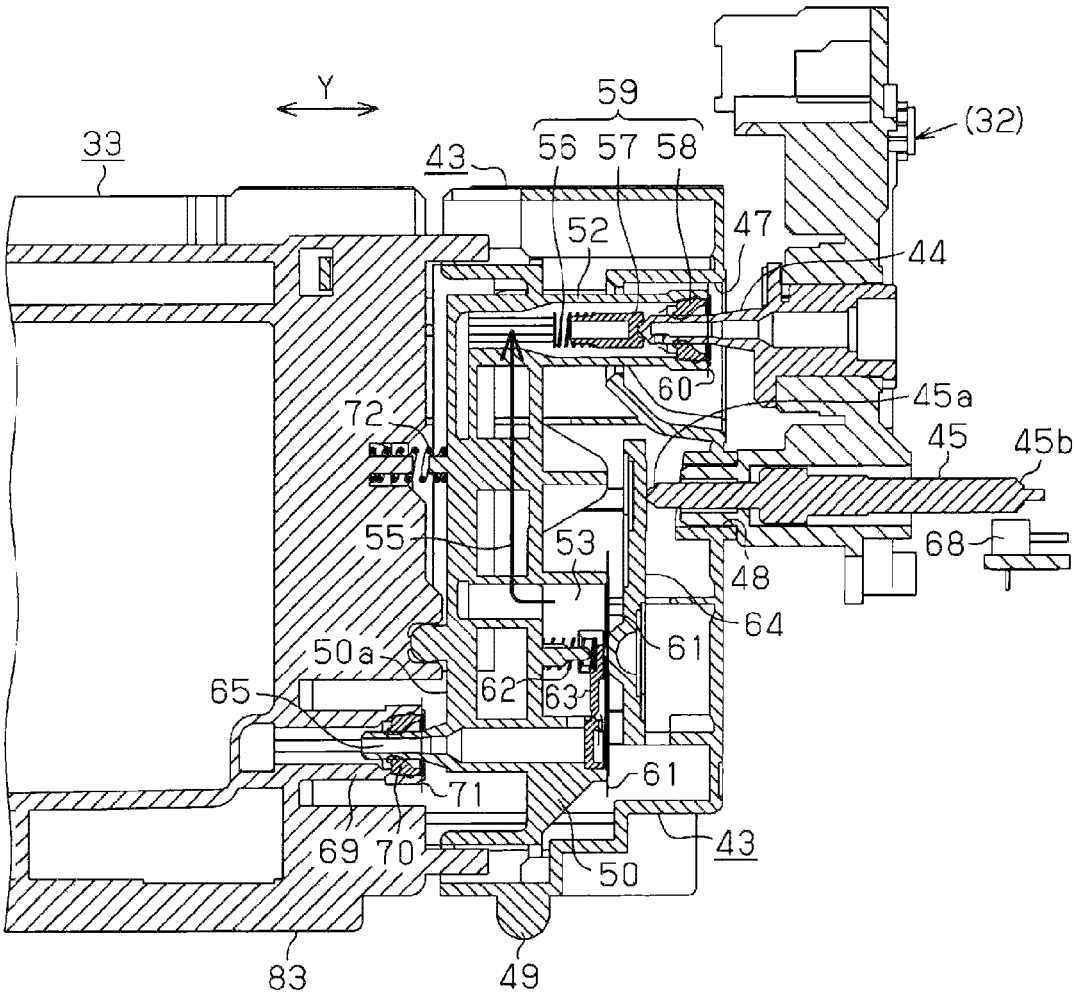
FIG. 5 is a cross-sectional view showing a configuration of the connecting portion provided in the liquid container.

As shown in FIGS. 4 and 5, the connecting portion 43 provided in the second containing body portion 38 has a casing having a substantially box-like shape with a bottom that is open on one side, and a bottom wall portion thereof constitutes an end face 46 of the second containing body portion 38 of the liquid containing body 33 on the side of the supply portion 32. A needle insertion hole 47 into which the supply needle 44 of the supply portion 32 is inserted is formed in the end face 46 of the connecting portion 43, and a bar insertion hole 48 into which the remaining amount detection bar 45 is inserted is formed at a position adjacent to the needle insertion hole 47. The connecting portion 43 also has, on its lower end side, a protruding area 49 whose surface has a substantially circular column shape.

The casing of the connecting portion 43 includes an attached member 50 that forms a substantially flat-plate shape and has a predetermined thickness in the direction in which the supply needle 44 is inserted into the needle insertion hole 47. The attached member 50 has, in its end face 51 on one side that is the side of the supply portion 32 in its thickness direction, a substantially cylindrical outlet port 52 into which the supply needle 44 is inserted via the needle insertion hole 47, and a liquid chamber 53 that is also substantially cylindrical. In the attached member 50, an outflow passage 55 that brings the liquid chamber 53 and the outlet port 52 into communication with each other is formed in a penetrating manner, as indicated by a thick solid arrow in FIG. 5.

Since the supply needle 44 is inserted into the outlet port 52 via the needle insertion hole 47, an openable/closable valve 59 that is constituted by a spring 56, a valve member 57, and a packing 58 and suppresses an outflow of the ink supplied from the liquid containing body 33 is installed within the outlet port 52. A seal 60 that covers the opening of the outlet port 52 is provided by means of adhesion such that the ink does not flow out before the supply needle 44 is inserted into the outlet port 52.

A flexible thin film 61 is welded onto the liquid chamber 53 so as to cover the opening of the liquid chamber 53. For this reason, the thin film 61 undergoes deformation with a change of the internal pressure of the liquid chamber 53, and the volume of the liquid chamber 53 changes. A spring 62 that biases the thin film 61 toward the outside of the liquid chamber 53 is also provided in the liquid chamber 53. Note that a pressure receiving plate 63 that transmits the biasing force of the spring 62 to the thin film 61 is inserted between the spring 62 and the thin film 61.

A movable member 64 is attached to the outer surface of the liquid chamber 53 in the attached member 50. The movable member 64 is configured so as to be able to pivot around a predetermined pivot fulcrum extending in the horizontal direction (the left-right direction X) perpendicular to the long direction of the liquid containing body 33 (the front-rear direction Y), and is in contact, from the outside of the liquid chamber 53, with the thin film 61 constituting a part of the inner face of the liquid chamber 53.

Meanwhile, a substantially cylindrical inlet port 65 is formed in an end face 50*a* on the other side of the attached member 50 in the thickness direction thereof, so as to protrude in the thickness direction of the attached member 50. A substantially cylindrical guiding port (guiding port portion) 69 into which the inlet port 65 is inserted is provided so as to correspond to the inlet port 65, on the side of the liquid containing body 33 (the second containing body portion 38). A configuration is employed in which the inside of the liquid containing body 33 (the second containing body portion 38) is brought into communication with the liquid chamber 53 as a result of insertion of the inlet port 65 into the guiding port 69. Note that a packing 70 that suppresses leakage and an outflow of the ink contained in the liquid containing body 33 is installed within the guiding port 69, and a seal 71 that covers the opening of the guiding port 69 is welded therewith such that the ink does not flow out from the liquid containing body 33 before the inlet port 65 is inserted into the liquid containing body 33 (the second containing body portion 38).

The attached member 50 is biased toward the installation portion 31 within the connecting portion 43 by a compression spring 72 inserted between the attached member 50 and the liquid containing body 33 (the second containing body portion 38), such that, for example, the insertion of the supply needle 44 into the outlet port 52 and the contact of the remaining amount detection bar 45 with the movable member 64 are stable.

The transmission mechanism will now be described with reference to FIG. 5.

As shown in FIG. 5, in the connecting portion 43, the thin film 61 of the liquid chamber 53 is configured to be pressed out by the spring 62 via the pressure receiving plate 63 so as to increase the volume of the liquid chamber 53. For this reason, with an increase in the volume of the liquid chamber 53, the ink in the liquid containing body 33 flows into the liquid chamber 53 through the inlet port 65. On the other hand, as a result of the ink being absorbed from the outlet port 52 toward the supply needle 44 by the supply portion 32, the ink in the liquid chamber 53 flows out from the liquid chamber 53 through the outflow passage 55. At this time, since the inner diameter of the outflow passage 55 is set to be larger than the inner diameter of the inlet port 65 in the present embodiment, the amount of the ink flowing out from the liquid chamber 53 does not keep up with the amount of the ink flowing into the liquid chamber 53, and accordingly the pressure in the liquid chamber 53 becomes negative. For this reason, the thin film 61 undergoes deformation so as to be withdrawn into the liquid chamber 53 against the biasing force of the spring 62. Note that FIG. 5 shows a state where the thin film 61 is withdrawn into the liquid chamber 53.

The negative pressure generated in the liquid chamber 53 is gradually resolved as a result of the ink in the liquid containing body 33 flowing into the liquid chamber 53 through the inlet port 65. Then, the thin film 61 is again pressed toward the outside of the liquid chamber 53 by the force of the spring 62, and the volume of the liquid chamber 53 is restored. For this reason, the supply portion 32 is restored to its original state before the start of ink supply to the liquid ejection head 24, after a lapse of a predetermined time since the ink supply to the liquid ejection head 24 has been stopped. Upon the ink being again supplied from the supply portion 32 to the liquid ejection head 24, the pressure in the liquid chamber 53 becomes negative, and the thin film 61 is brought into a state of being withdrawn into the liquid chamber 53. On the other hand, if the ink in the liquid containing body 33 is consumed and runs out, the ink does not flow into the liquid chamber 53 even if the pressure in the liquid chamber 53 is negative. That is to say, even after a lapse of the predetermined time from the stop of the ink supply by the supply portion 32, the negative pressure in the liquid chamber 53 is not resolved, and the state where the thin film 61 is withdrawn into the liquid chamber 53 is maintained.

A spring (not shown), which biases the remaining amount detection bar 45 so as to press the remaining amount detection bar 45 against the movable member 64, is attached to the remaining amount detection bar 45. A second end portion 45*b* of the remaining amount detection bar 45 on the side opposite to a first end portion 45*a* thereof that comes into contact with the movable member 64 is an area that is subjected to detection of a recess-shaped sensor 68. The sensor 68 is a transmission type photosensor, in which a light-receiving portion and a light-emitting portion (not shown) are provided so as to face each other. It is detected whether or not the ink remains in the liquid containing body 33, based on a detection signal that is output from the sensor 68.

That is to say, if the ink in the liquid containing body 33 runs out, the ink does not flow into the liquid chamber 53 from the liquid containing body 33, and accordingly the thin film 61 is maintained in a state of undergoing deformation in the direction of reducing the volume of the liquid chamber 53. Accordingly, as a result of the movable member 64 being pressed by the first end portion 45*a* of the remaining amount detection bar 45 biased by the spring (not shown), the movable member 64 pivots around the pivot fulcrum, the remaining amount detection bar 45 moves toward the liquid containing body 33, and consequently, the second end portion 45*b* of the remaining amount detection bar 45 is inserted between the light-emitting portion and the light-receiving portion of the sensor 68. For this reason, the sensor 68 detects that the ink in the liquid containing body 33 has run out, based on the light maintained in a blocked state.

Next, returning to FIGS. 2 and 3, the slider 34 will be described.

As shown in FIG. 3, an injection port (injection port portion) 73 for injecting the ink into the liquid containing body 33 is provided in the upper face 39 of the liquid containing body 33 in the first area of the liquid containing body 33 that is located outside the printer 11. In the present embodiment, the first containing body portion 37 corresponds to the first area, and the injection port 73 is provided in this first containing body portion 37. The injection port 73 located outside the printer 11 is configured to be able to be covered with the slider 34 such that the injection port 73 is not exposed when the ink is not injected.

That is to say, the slider 34 has a substantially rectangular shape having a long direction, and is formed with an outer shape that substantially overlaps the upper face 39 of the liquid containing body 33. The slider 34 is configured to cover the upper part of the ink injection port 73 provided in the liquid containing body 33 with an openable/closable cover 74 when the slider 34 is arranged in a state of substantially overlapping the upper face 39 of the liquid containing body 33 as a result of one end side of the slider 34 being inserted into the installation portion 31. Specifically, the slider 34 has, at its end portion in the long direction, the openable/closable cover 74 that is displaced between a position of covering the injection port 73 and a position of opening the injection port 73. Note that an "insertion direction" mentioned in the following description indicates a "direction of insertion" of the slider 34 into the installation portion 31, unless otherwise stated.

In the present embodiment, the openable/closable cover 74 is pivotably supported by the slider 34 such that an axis extending in the short direction of the liquid containing body 33 serves as the center of rotation, at a position that is more on the side of the second containing body portion 38 (the second area) than the injection port 73 when the openable/closable cover 74 is in a state of covering the injection port 73. Accordingly, when opening the injection port 73, a user can lift the near side of the openable/closable cover 74 that is the front end side of the slider 34 in the long direction, and pivot the openable/closable cover 74 by approximately 180 degrees toward the printer 11 on the side of the second containing body portion 38, as indicated by chain double-dashed lines in FIG. 3.

Consequently, the openable/closable cover 74 can be displaced so as to be located on the rear side with respect to the injection port 73 by achieving an opened state of the injection port 73 as indicated by the chain double-dashed lines in FIG. 3 from a covered state thereof indicated by solid lines in FIG. 3. Note that, in the present embodiment, the injection port 73 is provided near the front end portion of the first containing body portion 37 of the liquid containing body 33, such that the length of the openable/closable cover 74 in the front-rear direction Y necessary for covering the injection port 73 is not long.

The slider 34 includes a chip holder 76, which serves as an example of a storage portion holding member on which a recording chip 75 can be placed, the recording chip 75 serving as an example of a storage portion for recording related information that is related to the ink injected into the liquid containing body 33 from the injection port 73. The chip holder 76 is attached to an end portion 34*a* located on the far side in the direction in which the slider 34 is inserted into the installation portion 31. When the slider 34 is inserted into the installation portion 31 in a state where the slider 34 overlaps the upper face 39 of the liquid containing body 33, the recording chip 75 attached to the chip holder 76 can engage with a communication portion 77 provided on the side of the installation portion 31 of the printer 11. As a result of engaging with the communication portion 77, the recording chip 75 placed on the chip holder 76 comes into contact with and is electrically connected to electric terminals 78 included in the communication portion 77. Consequently, the related information recorded in the recording chip 75 is transmitted to the printer 11.

Note that, in the printer 11 in the present embodiment, the slider 34 is positioned together with the connecting portion 43, within the printer 11 by a pair of flat springs 79 attached to the installation portion 31, when the slider 34 is inserted into the installation portion 31 of the printer 11 in the state where the slider 34 overlaps the upper face 39 of the liquid containing body 33.

That is to say, as shown in FIG. 2, the flat springs 79, which have an oblique shape and an interval therebetween narrowing toward the insertion direction, are fixed by screws in the vertical direction respectively to the upper frame 35 and the lower frame 36. The flat spring 79 of the upper frame 35 abuts, in a biasing state, against a protruding area 80 provided in the chip holder 76 included in the slider 34, and the flat spring 79 of the lower frame 36 abuts, in a biasing state, against the protruding area 49 (see FIG. 5) provided in the connecting portion 43. Consequently, the slider 34 (the chip holder 76) and the connecting portion 43 are positioned by the pair of flat springs 79 in the up-down direction Z.

The slider 34 inserted in a state of overlapping the liquid containing body 33 and the second containing body portion 38 of the liquid containing body 33 are brought into a state of being positioned in the installation portion 31. That is to say, as shown in FIG. 2, the lower face of the upper frame 35 of the installation portion 31 is provided with a guide groove (not shown) into which a projecting portion 82 is inserted while coming into sliding contact with the guide groove. The projecting portion 82 is provided so as to extend in the long direction on the side of the upper face of the slider 34. The upper face of the lower frame 36 of the installation portion 31 is provided with a guide groove 84 with which a projecting portion 83 (see FIGS. 5 and 23) engages. The projecting portion 83 is provided so as to extend in the long direction on the side of the lower face of the liquid containing body 33. Accordingly, the short direction of the slider 34 and the second containing body portion 38 is positioned by the engagement between the respective projecting portions with the guide grooves. Consequently, the slider 34 (and the chip holder 76 attached to the slider 34) and the connecting portion 43 provided in the second containing body portion 38 are positioned in their short direction.

In the liquid container 21 in the present embodiment, the chip holder 76 and the openable/closable cover 74 included in the slider 34 are detachably attached to the slider 34. The slider 34 is configured to be able to slide with respect to the upper face 39 of the liquid containing body 33, in a state where the chip holder 76 and the openable/closable cover 74 are attached to the slider 34. In other words, the slider 34 is configured to be able to be inserted into and pulled out of the installation portion 31, in a state where the liquid containing body 33 is fixed to the printer 11.

The configuration of the slider 34 will be described in more detail with reference to FIGS. 6A and 6B.

Figure 6A:
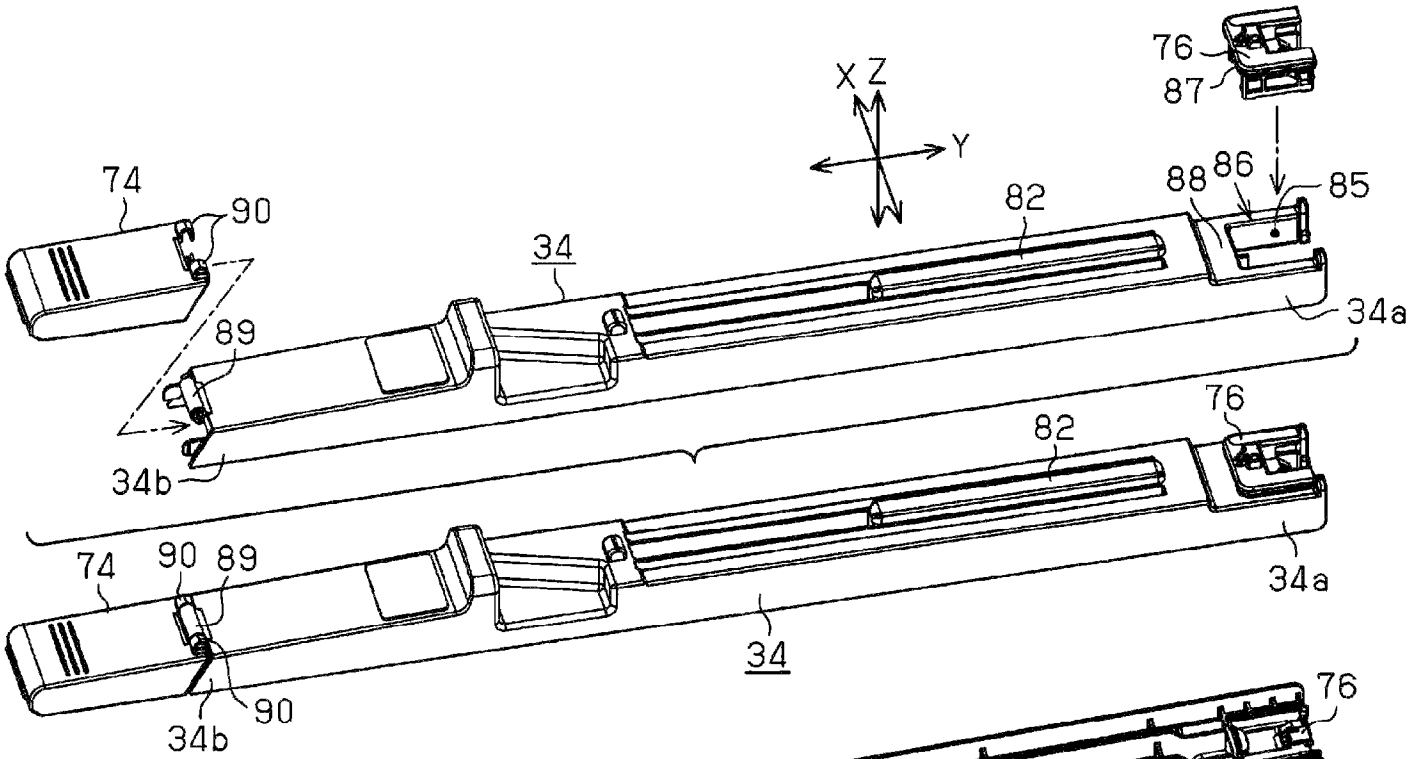
FIG. 6A is an exploded perspective view showing a configuration of the slider.

As shown in FIG. 6A, at the end portion 34*a* of the slider 34 on the far side in the direction of insertion of the slider 34 into the installation portion 31, a holder attaching portion 86 is formed that is cut out on its far side in the insertion direction and has a substantially U-shaped opening 85. The chip holder 76 can be inserted into and pulled out of the opening 85 in a direction intersecting the insertion direction, that is, in a direction intersecting the sliding direction of the slider 34. In the present embodiment, a hook-shaped portion 87 provided on the upper side of the chip holder 76 is inserted into and attached to the opening 85 of the holder attaching portion 86 from above, that is, from the side opposite to the liquid containing body 33 with respect to the slider 34, so as to abut against a substantially C-shaped upper surface 88 forming the opening 85. The chip holder 76 is pulled upward out of the holder attaching portion 86 and is thus removed from the slider 34.

Meanwhile, a rotation shaft 89 is formed at an end portion 34*b* of the slider 34 on the near side in the direction of insertion of the slider 34 into the installation portion 31, and the openable/closable cover 74 is pivotably attached to the slider 34 by bearing portions 90 formed in the openable/closable cover 74 being fitted to the rotation shaft 89.

The slider 34 to which the chip holder 76 and the openable/closable cover 74 are thus attached in the present embodiment, can slide in the long direction of the liquid containing body 33 (the front-rear direction Y) while abutting against both end portions of the liquid containing body 33 in the width direction, which is the short direction thereof (the left-right direction X), on the upper face 39 of the liquid containing body 33, in a state where the slider 34 overlaps the liquid containing body 33.

Figure 6B:
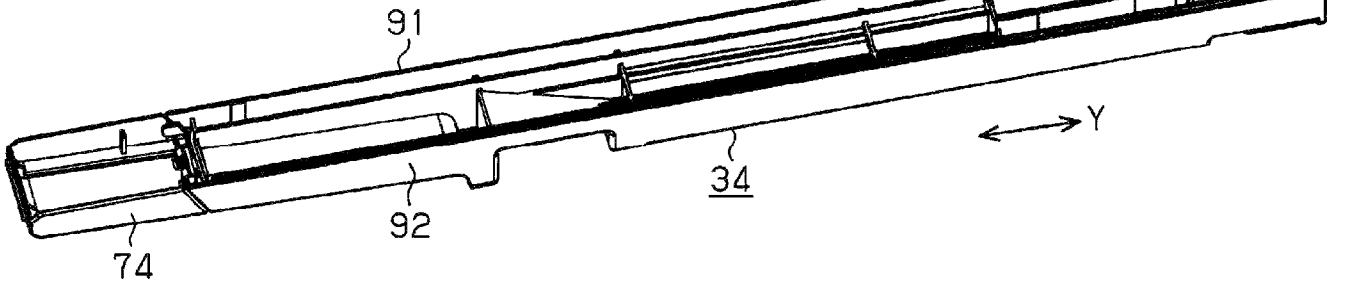
FIG. 6B is a perspective view showing the side of a back face of the slider.

Specifically, as shown in FIG. 6B, side wall portions 91 and 92, which have a linear rib shape and extend in the long direction at ends on both sides in the width direction intersecting the long direction, are formed in the lower face of the slider 34 that overlaps the upper face 39 of the liquid containing body 33. Meanwhile, the linear flat face portions 41 and 42 extending in the long direction are formed at ends on both sides of the upper face 39 of the liquid containing body 33 in the width direction intersecting the long direction. The flat face portions 41 and 42 serve as contact faces against which the side wall portions 91 and 92 respectively abut. Accordingly, the side wall portions 91 and 92 formed in the slider 34 can move (slide) in the long direction while abutting respectively against the flat face portions 41 and 42 formed on the upper face 39 of the liquid containing body 33.

That is to say, as shown in FIGS. 2 and 3, a plurality of protruding portions 93 that are adjacent to the inside of the flat face portions 41 and 42 are formed on the upper face 39 of the liquid containing body 33 so as to be aligned with the long direction. Accordingly, the slider 34 stably moves (slides) in the long direction (the front-rear direction Y) with respect to the liquid containing body 33, as a result of its movement in the width direction (the left-right direction X) being restricted by the protruding portions 93.

Note that, in the printer 11 in the present embodiment, a slidable tab 94 capable of sliding in the up-down direction is provided on the upper side of the liquid container 21 fixed to the printer 11 in a state where the second containing body portion 38 is located within the installation portion 31. The slidable tab 94 provided in the printer 11 engages with a recess portion 95 provided on the upper face of the slider 34 as a result of being displaced downward from above, and the movement (sliding) of the slider 34 in the direction of being pulled out of the installation portion 31 along the long direction is restricted. Accordingly, the slidable tab 94 and the recess portion 95 are disengaged by the user moving the slidable tab 94 from below to above, and then the slider 34 enters a state of being able to be pulled out of the installation portion 31. As a result of the user sliding the slider 34 with respect to the liquid containing body 33 in this state, the slider 34 can be inserted into and pulled out of the installation portion 31. Furthermore, in the present embodiment, a finger hooking portion 96 protruding in the short direction is formed on the side of the upper face of the slider 34, and this finger hooking portion 96 enables the slider 34 to be easily inserted and pulled out by the user.

Furthermore, in the present embodiment, the recording chip 75 placed on the chip holder 76 is placed in a replaceable manner. This configuration will be described with reference to FIGS. 7A and 7B. Note that FIGS. 7A and 7B show a state where the chip holder 76 has been removed from the slider 34.

Figure 7B:
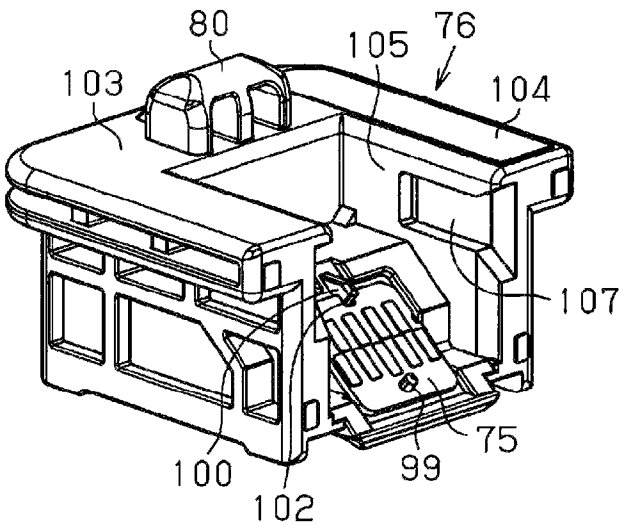
FIG. 7B is a perspective view of the chip holder on which a recording chip is placed.
Figure 7A:
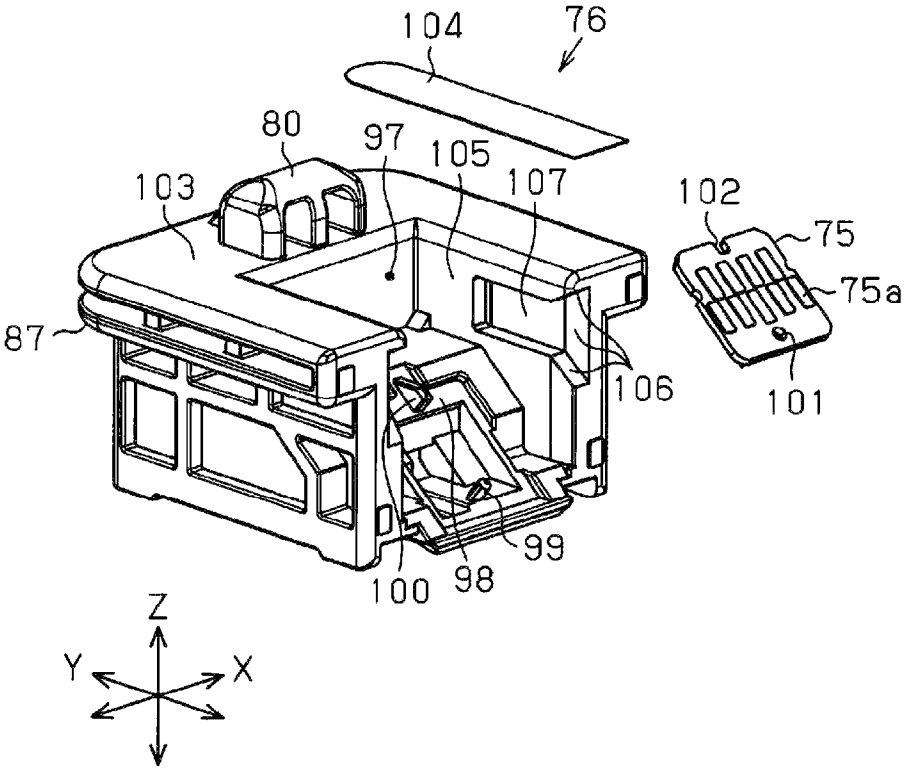
FIG. 7A is an exploded perspective view showing a configuration of a chip holder.

As shown in FIG. 7A, the chip holder 76 is constituted by a plurality of walls. The chip holder 76 is provided with a recess portion 97 that is open on both the upper side and the far side in the direction of insertion of the slider 34 into the installation portion 31 in a state where the chip holder 76 is installed into the slider 34, and this recess portion 97 has an inclined face 98 that inclines downward toward the insertion direction. A boss 99 having a circular column shape is formed on the lower end side of the inclined face 98, and a plate-shaped rib 100, whose long direction is the direction of insertion of the slider 34 into the installation portion 31, is formed on the upper end side of the inclined face 98. Some or all of the inclined face 98, the boss 99 having a circular column shape, and the rib 100 are referred to as a support portion.

Meanwhile, in the present embodiment, the recording chip 75 to be placed on the chip holder 76 has a substantially rectangular shape. A plurality of (here, nine) electrodes 75*a*, whose long direction is the insertion direction, are provided on the surface of the recording chip 75. A round hole 101 is formed at one end portion of the recording chip 75 in the front or rear of the electrodes 75*a* in the insertion direction, and a slit 102 is formed at the other end portion thereof. The boss 99 provided in the chip holder 76 is inserted into the round hole 101 formed in the recording chip 75, and with this insertion, the rib 100 provided in the chip holder 76 is inserted into the slit 102 provided in the recording chip 75. Thus, the recording chip 75 is placed in a state of inclining with respect to the horizontal direction, on the inclined face 98 of the chip holder 76. Even if the chip holder 76 is placed on a plane in any posture (arbitrary posture), the recording chip 75 is supported by the chip holder 76 such that the walls protrude in the gravity direction further than the recording chip 75. An identification seal 104 (identification label) for identifying the placed recording chip 75 is attached to at least a part of an upper surface 103 of the chip holder 76 in the present embodiment. This identification seal 104 has the same color as the liquid contained in the liquid container 21 corresponding to the chip holder 76, or the liquid contained in a later-described liquid injection source 126.

As shown in FIG. 7B, in a state where the recording chip 75 is placed on the chip holder 76, the recording chip 75 is in a state where its rotation around the boss 99 within the inclined face 98 is restricted by the rib 100. A small gap is provided between the round hole 101 and the boss 99 and between the slit 102 and the rib 100, such that the placed recording chip 75 can be removed from the chip holder 76.

Note that, in the chip holder 76, groove-shaped portions 107, which extend in the insertion direction and each have chamfered portions 106 at their side end in the insertion direction, are provided in side wall portions 105 formed on both sides of the recess portion 97 in the left-right direction X that intersects the insertion direction relative to the installation portion 31. FIGS. 7A and 7B shows only one of the groove-shaped portions 107. The protruding area 80 that abuts against the flat spring 79 provided on the upper frame 35 is formed on the upper surface 103 of the chip holder 76.

Next, a configuration of the openable/closable cover 74 will be described with reference to FIGS. 8A, 8B, and 8C. In the present embodiment, the openable/closable cover 74 is detachably attached to the slider 34, and the rotation of the openable/closable cover 74 around the rotation shaft 89 is suppressed as a result of a load being applied to the rotation at a covering position at which the openable/closable cover 74 covers the injection port 73.

Figure 8A:
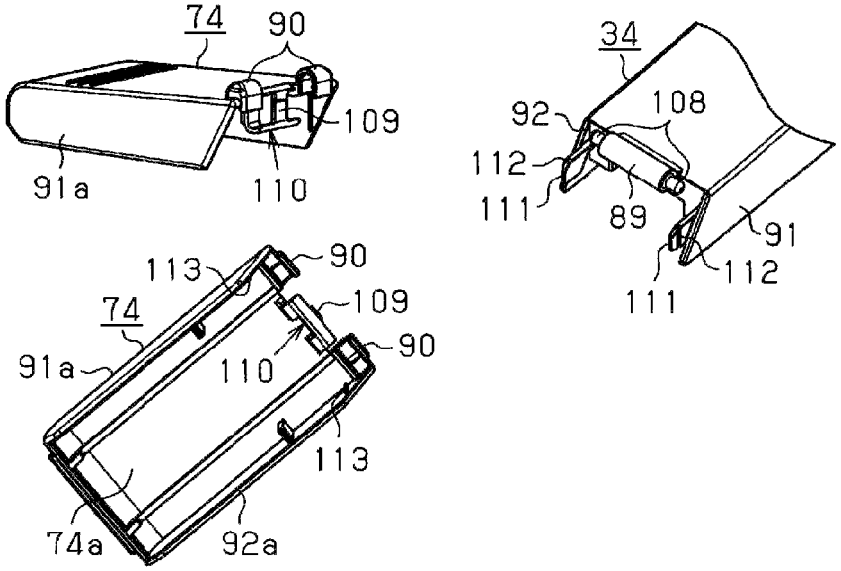
FIG. 8A is a perspective view showing a configuration of an openable/closable cover.

As shown in FIG. 8A, the openable/closable cover 74 has two bearing portions 90 that have a substantially semi-cylindrical shape and engage with shaft end portions 108 on both sides of the rotation shaft 89 provided in the slider 34, and an abutting portion 109 that abuts against a substantial center portion of the rotation shaft 89 in the axial direction thereof from the direction opposite to the abutting direction of the bearing portions 90. The abutting portion 109 is provided at the tip of the hook shape of a hook area 110 that has a substantially J-shape as seen in the short direction and is provided with two flexible plate-shaped areas formed so as to protrude from the side of the inner face (back face 74*a*) of the openable/closable cover 74 that faces the injection port 73. When the two bearing portions 90 are engaged with the shaft end portions 108 of the rotation shaft 89, the abutting portion 109 is temporarily displaced by the rotation shaft 89 with bending displacement of the hook area 110, the bending displacement is thereafter cancelled in a state where the bearing portions 90 engage with the shaft end portions 108 of the rotation shaft 89, and the abutting portion 109 thereby engages with the rotation shaft 89 in a substantially abutting state. Thus, the openable/closable cover 74 is configured to be pivotably supported with respect to the rotation shaft 89.

The side wall portions 91 and 92 of the slider 34 on both sides in the short direction thereof are each provided with an extending area 111 that extends in the long direction. A groove portion 112 is formed in the up-down direction in each extending area 111. Meanwhile, cover side wall portions 91*a* and 92*a* of the openable/closable cover 74 that respectively constitute a part of the side wall portions 91 and 92 of the slider 34 each have a projecting portion 113 capable of interlocking with the corresponding groove portion 112, at a position corresponding to the groove portion 112 in a state where the openable/closable cover 74 attached to the liquid containing body 33 covers the injection port 73.

Figure 8B:
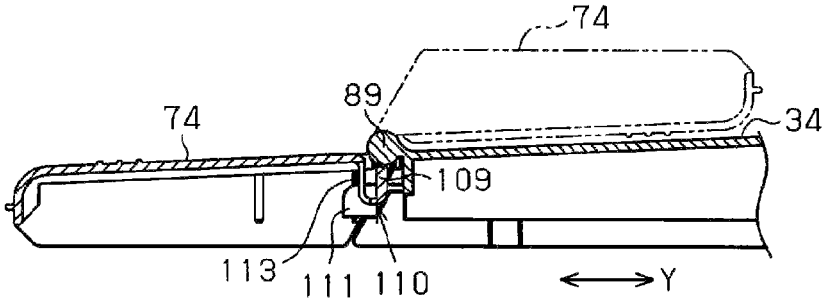
FIG. 8B is a cross-sectional view showing the openable/closable cover in a state of being attached to the slider.
Figure 8C:
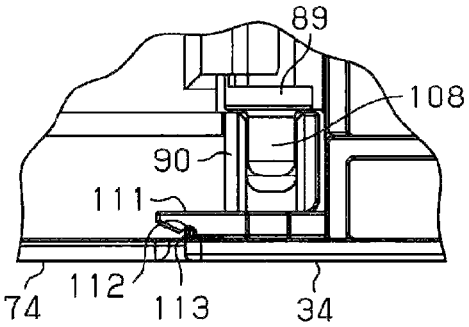
FIG. 8C is a partial enlarged view showing a configuration of an engaging portion.

That is to say, as shown in FIGS. 8B and 8C, the openable/closable cover 74 is incorporated into the slider 34 as a result of the bearing portions 90 and the abutting portion 109 being brought into a state of engaging with the rotation shaft 89 of the slider 34. When the incorporated openable/closable cover 74 is located at the covering position at which the openable/closable cover 74 covers the injection port 73, the projecting portions 113 formed in the cover side wall portions 91*a* and 92*a* overlap the groove portions 112 as seen in the short direction, and are brought into an engaging state where the projecting portions 113 have entered the groove portions 112. Accordingly, when the openable/closable cover 74 rotates around the rotation shaft 89 and is displaced to an uncovering position at which the openable/closable cover 74 uncovers the injection port 73, as indicated by chain double-dashed lines in FIG. 8B, a load is generated on the rotation of the openable/closable cover 74. In this regard, the groove portions 112 of the slider 34 function as an example of an engaging portion that engages with the openable/closable cover 74 and suppresses displacement thereof from the covering position to the uncovering position.

Next, a configuration of the liquid container 21 at the periphery of the injection port 73 will be described.

Figure 9A:
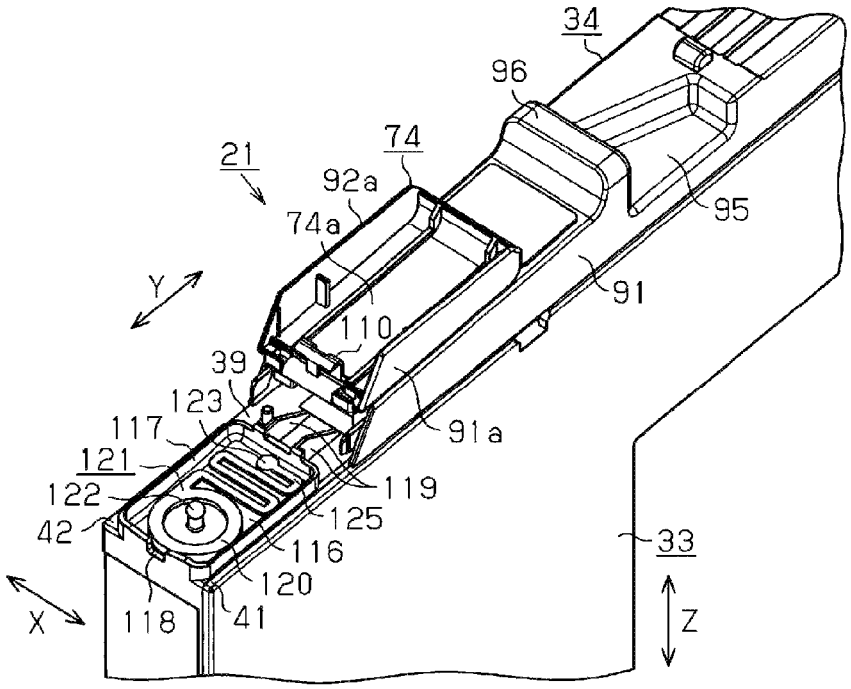
FIGS. 9A and 9B each show the liquid container with the openable/closable cover in a state of being located at an uncovering position.

As shown in FIG. 9A, a liquid receiving face 116, which serves as an example of a liquid receiving portion that extends in a direction intersecting the up-down direction Z, is formed in a front portion of the upper face 39 of the liquid containing body 33. The liquid receiving face 116 has a substantially rectangular shape as seen in a plan view, and its width dimension in the left-right direction X is slightly smaller than the width direction of the liquid containing body 33 in the left-right direction X.

A peripheral wall portion 117 is provided in the upper face 39 of the liquid containing body 33 so as to protrude in the upward direction (the direction opposite to the gravity direction) intersecting the liquid receiving face 116, so as to surround the periphery of the liquid receiving face 116. At the substantial center of a front wall portion of the peripheral wall portion 117 in the left-right direction X, a cutoff groove 118 is formed that is recessed downward of the rest of the peripheral wall portion 117. That is to say, in the present embodiment, the cutoff groove 118, which serves as an example of a recess portion, is formed in the peripheral wall portion 117, which serves as an example of a peripheral position of the injection port 73. Meanwhile, in a rear wall portion of the peripheral wall portion 117, a pair of reinforcement ribs 119 are formed that extend rearward while intersecting the rear wall portion.

A covering member 121 including a covering body 120 is placed on the liquid receiving face 116. The covering body 120 has a substantially cylindrical shape and can cover and open the injection port 73 (see FIG. 9B). The covering body 120 has a tab portion 122 having a substantially circular column shape that protrudes in the upward direction from the upper face of the covering body 120. The tab portion 122 is an area to be held by the user when removing the covering body 120 from the injection port 73 and, conversely, covering the injection port 73 with the covering body 120.

The covering member 121 also includes a fixation portion 123 for fixing the covering member 121 to the liquid receiving face 116, on the rear side that is opposite to the front side where the covering body 120 is provided, in the state shown in FIG. 9A. The fixation portion 123 is fixed to a fixation hole 124 (see FIG. 10) formed as an opening in the liquid receiving face 116, so as to be able to rotate around the center of rotation that is the axis of the fixation hole 124, and so as to be unable to be detached from the liquid receiving face 116. Accordingly, the covering member 121 can rotate with respect to the liquid receiving face 116 around the fixation portion 123 serving as the center of rotation, and does not easily withdraw from the liquid receiving face 116. However, the covering member 121 including the fixation portion 123 can be replaced with a new covering member 121.

The covering member 121 also includes a connecting portion 125 that connects the covering body 120 to the fixation portion 123 while being bent several times in a direction intersecting the up-down direction Z (in the preset embodiment, three times in the left-right direction X), in a state where the covering member 121 is placed on the liquid receiving face 116. The connecting portion 125 has a rectangular cross-sectional shape in its extending direction, and the length of the rectangular cross-sectional shape in a direction aligned with the liquid receiving face 116 is longer than the length thereof in a direction (the up-down direction Z) intersecting the liquid receiving face 116. For this reason, when the connecting portion 125 is placed on the liquid receiving face 116, the contacting area between the connecting portion 125 and the liquid receiving face 116 is large, and the connecting portion 125 can be stably placed on the liquid receiving face 116.

The covering body 120, the connecting portion 125, and the fixation portion 123 that constitute the covering member 121 are made of elastomer such as rubber or resin, or the like, and are capable of undergoing elastic deformation. Accordingly, in the state shown in FIG. 9A, the covering body 120 covers the injection port 73 so as not to form a gap between the covering body 120 and the injection port 73, by being fitted into the injection port 73 in a state where the covering body 120 has undergone elastic deformation.

Figure 9B:
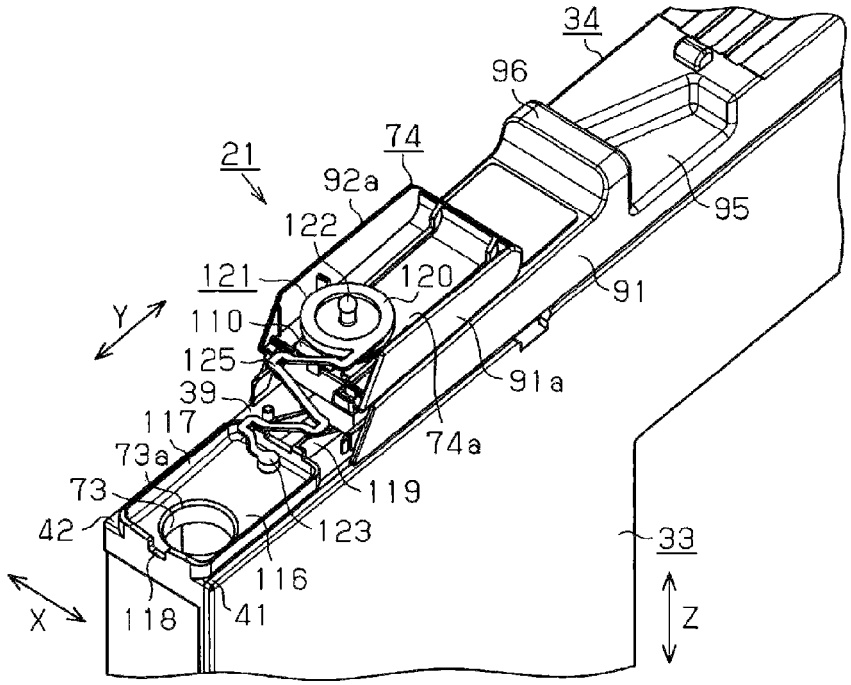

As shown in FIG. 9B, the covering body 120 removed from the injection port 73 can be placed on the back face 74*a* (an example of a bottom face) of the openable/closable cover 74 located at the uncovering position. Since the area of the back face 74*a* of the openable/closable cover 74 is larger than the area of projection in a case where the covering body 120 is projected in a direction aligned with the up-down direction Z, the covering body 120 can be placed more stably on the back face 74*a*.

Furthermore, the back face 74*a* of the openable/closable cover 74 is a face that inclines downward toward the front of the injection port 73, in a state (the state shown in FIG. 9A) where the openable/closable cover 74 is located at the uncovering position. The cover side wall portions 91*a* and 92*a* are in a state of facing in the upward direction at ends on both sides of the back face 74*a* of the openable/closable cover 74 located at the uncovering position. Accordingly, when the covering body 120 to which the ink is attached is placed on the back face 74*a* of the openable/closable cover 74 located at the uncovering position, the cover side wall portions 91*a* and 92*a* also function as an example of an insulating portion that suppresses leakage of the ink to the outside from the openable/closable cover 74.

FIG. 9B shows the liquid container 21 in a state where the covering body 120 has been removed from the injection port 73 and is placed on the back face 74*a* of the openable/closable cover 74. As shown in FIG. 9B, as a result of exposure of the injection port 73 formed as an opening in a part of the liquid receiving face 116, the user can inject the ink to the inside (a first ink chamber 151 (see FIG. 14)) of the liquid containing body 33 via the injection port 73. An opening edge 73*a* at the upper end edge of the injection port 73 is chamfered and is thereby formed obliquely, such that the ink can easily flow into the injection port 73 when being injected.

As shown in FIG. 9B, the length of the connecting portion 125 of the covering member 121 is a length that is sufficient for enabling the covering body 120 to be placed on the back face 74*a* of the openable/closable cover 74 in a state of being located at the uncovering position. Note that, in the state shown in FIG. 9B, the connecting portion 125 is in a state of being slightly stretched, while the covering body 120 is in a state of being placed on the back face 74*a* of the openable/closable cover 74 and abutting against the hook area 110 of the openable/closable cover 74.

Figure 10:
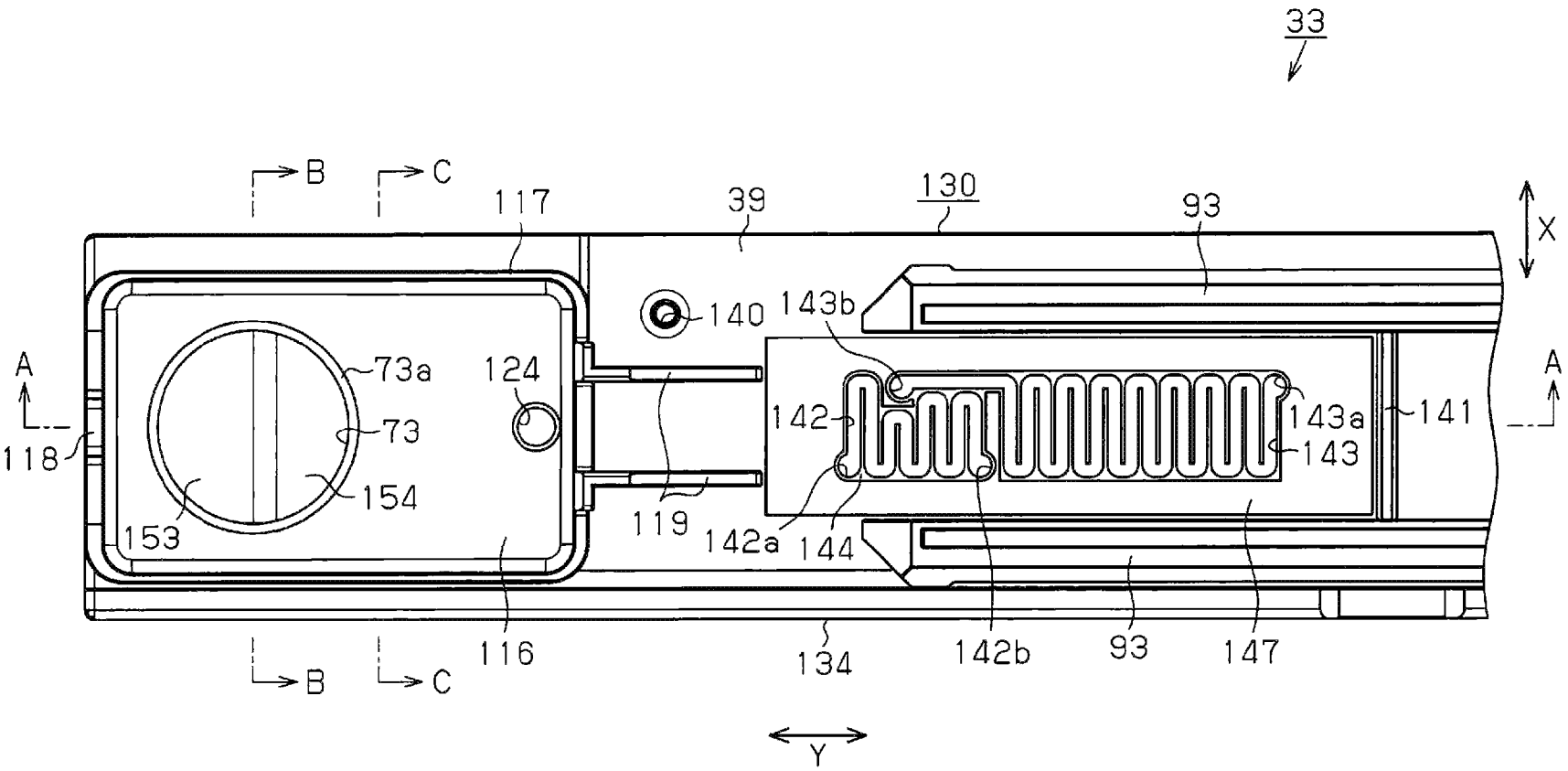
FIG. 10 is a plan view of a liquid containing body.

As shown in FIG. 10, the fixation hole 124 into which the fixation portion 123 of the covering member 121 is inserted and fixed is formed as an opening in a direction intersecting the liquid receiving face 116, near the wall portion on the rear side (in FIG. 10, the right side) of the peripheral wall portion 117 of the liquid receiving face 116. The fixation hole 124 is provided such that the center position of the fixation hole 124 in the left-right direction X substantially coincides with the center position of the injection port 73 in the left-right direction X. Note that, although the fixation hole 124 is formed as an opening in the liquid receiving face 116 similarly to the injection port 73, the fixation hole 124 is not in communication with the first ink chamber 151.

Figure 11:
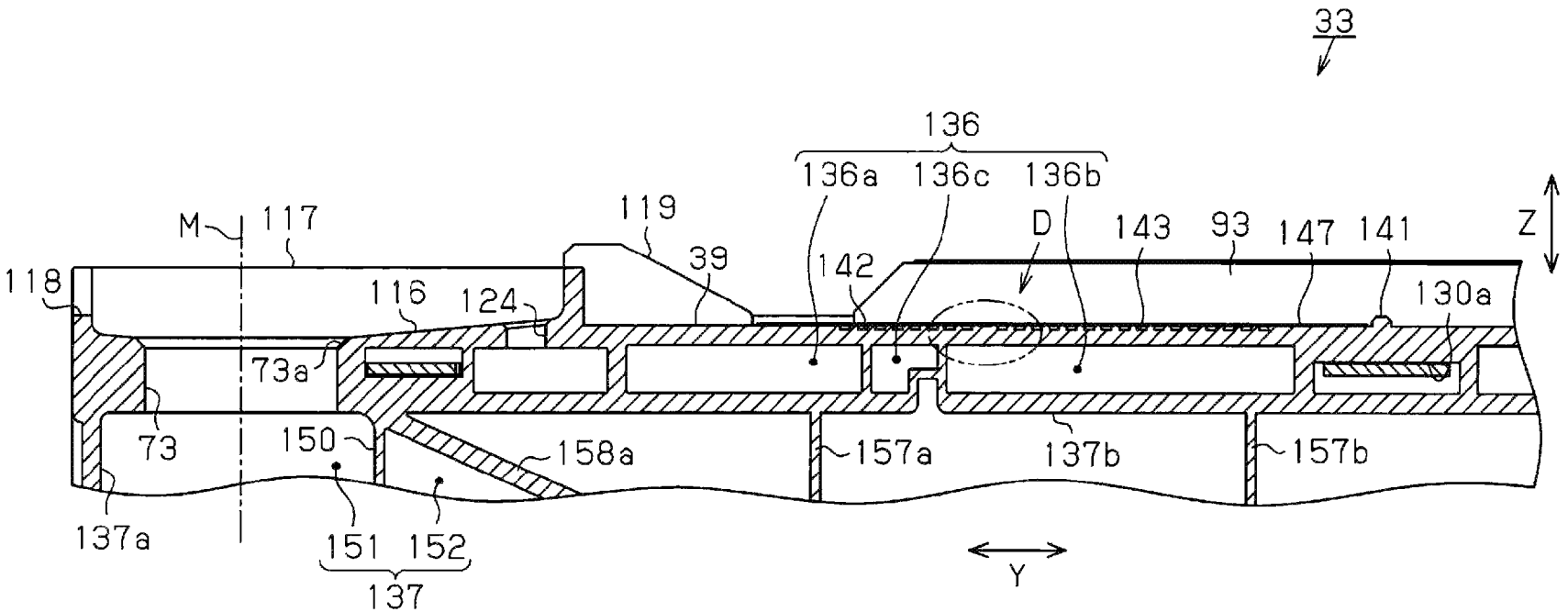
FIG. 11 is a cross-sectional view showing a cross-sectional structure of the liquid containing body, as seen along arrows A-A in FIG. 10.

As shown in FIG. 11, the liquid receiving face 116 is formed so as to incline downward (in the gravity direction) toward the injection port 73 in the front-rear direction Y. Accordingly, the vicinity of the fixation hole 124 located separately from the injection port 73 is at the highest position in the liquid receiving face 116. That is to say, since the fixation portion 123 of the covering member 121 fixed to the fixation hole 124 is located at a position higher than the periphery of the injection port 73 in the liquid receiving face 116, the ink is hardly attached to the fixation portion 123 even if the ink flows on the liquid receiving face 116 when the ink is injected into the injection port 73, or other occasion.

Figure 12A:
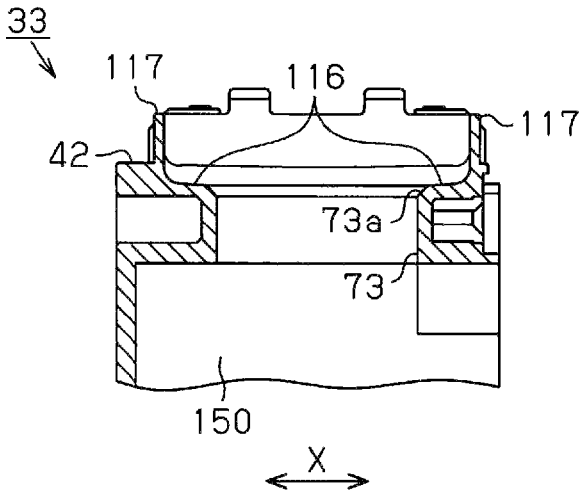
FIGS. 12A and 12B each show a cross-sectional structure of the liquid containing body.
Figure 12B:
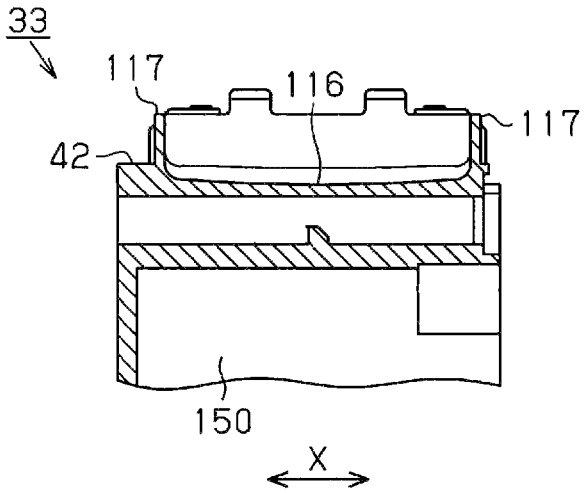

As shown in FIG. 12A, the liquid receiving face 116 is formed so as to incline downward toward the injection port 73, also in the left-right direction X. Furthermore, as shown in FIG. 12B, the liquid receiving face 116 is formed so as to incline downward toward the center in the left-right direction X, at a position close to the fixation hole 124 that is separate from the injection port 73.

Next, an internal configuration of the liquid containing body 33 will be described.

Figure 13:
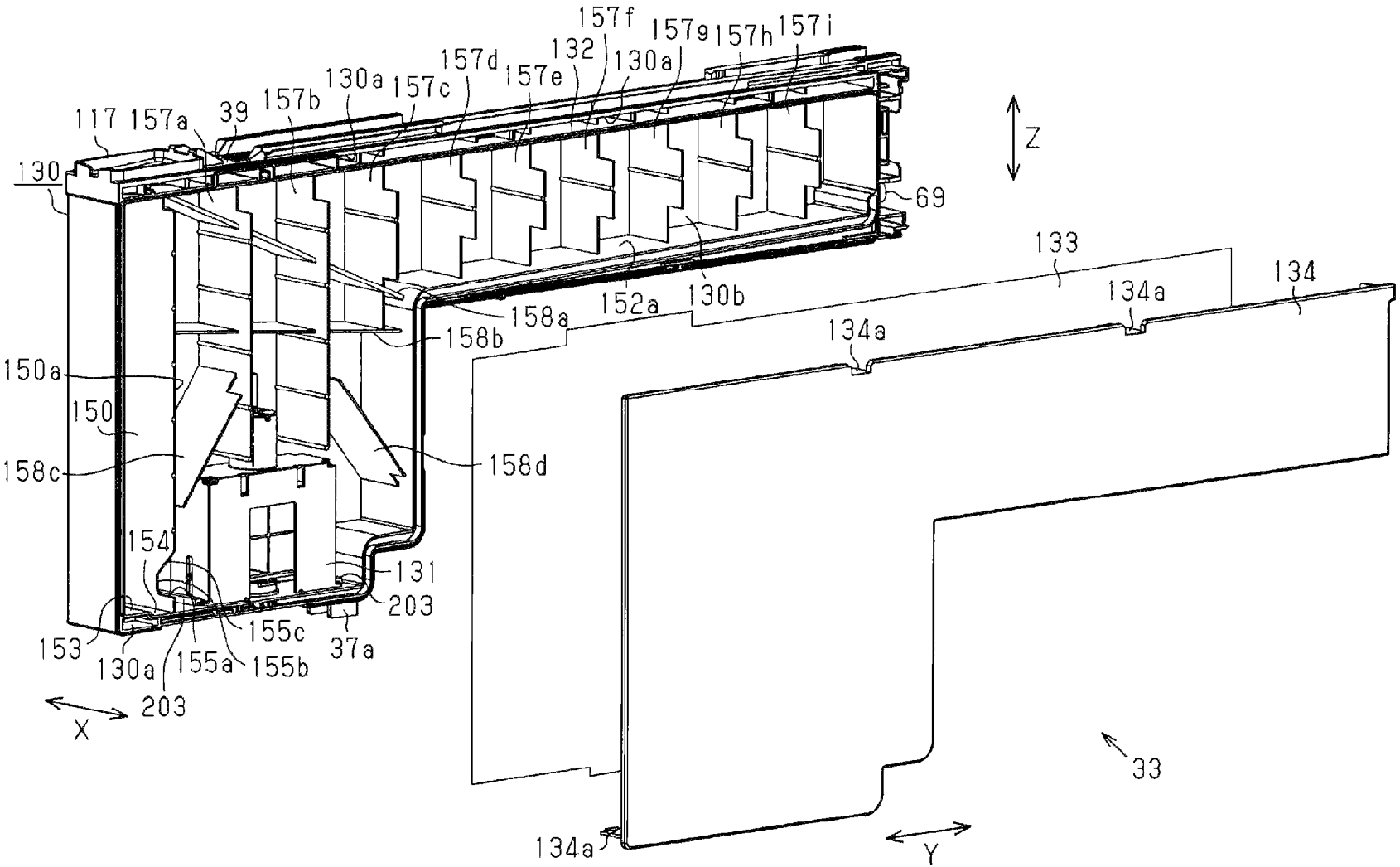
FIG. 13 is an exploded perspective view of the liquid containing body.

As shown in FIG. 13, the liquid containing body 33 includes the containing body case 130 having a substantially L-shape as seen in a side view from the left-right direction X, a float valve 131 that is a kind of valve mechanism housed in the containing body case 130, a film 133 that is adhered (e.g., heat sealing) to a case opening portion 132 of the containing body case 130, and a resin cover 134 that covers the case opening portion 132 through the film 133. Note that the containing body case 130 is integrally formed such that its right side face is open, and an interlocking portion 130*a* that interlocks a claw portion 134*a* formed on the cover 134 is formed outside the loop-shaped case opening portion 132.

Figure 14:
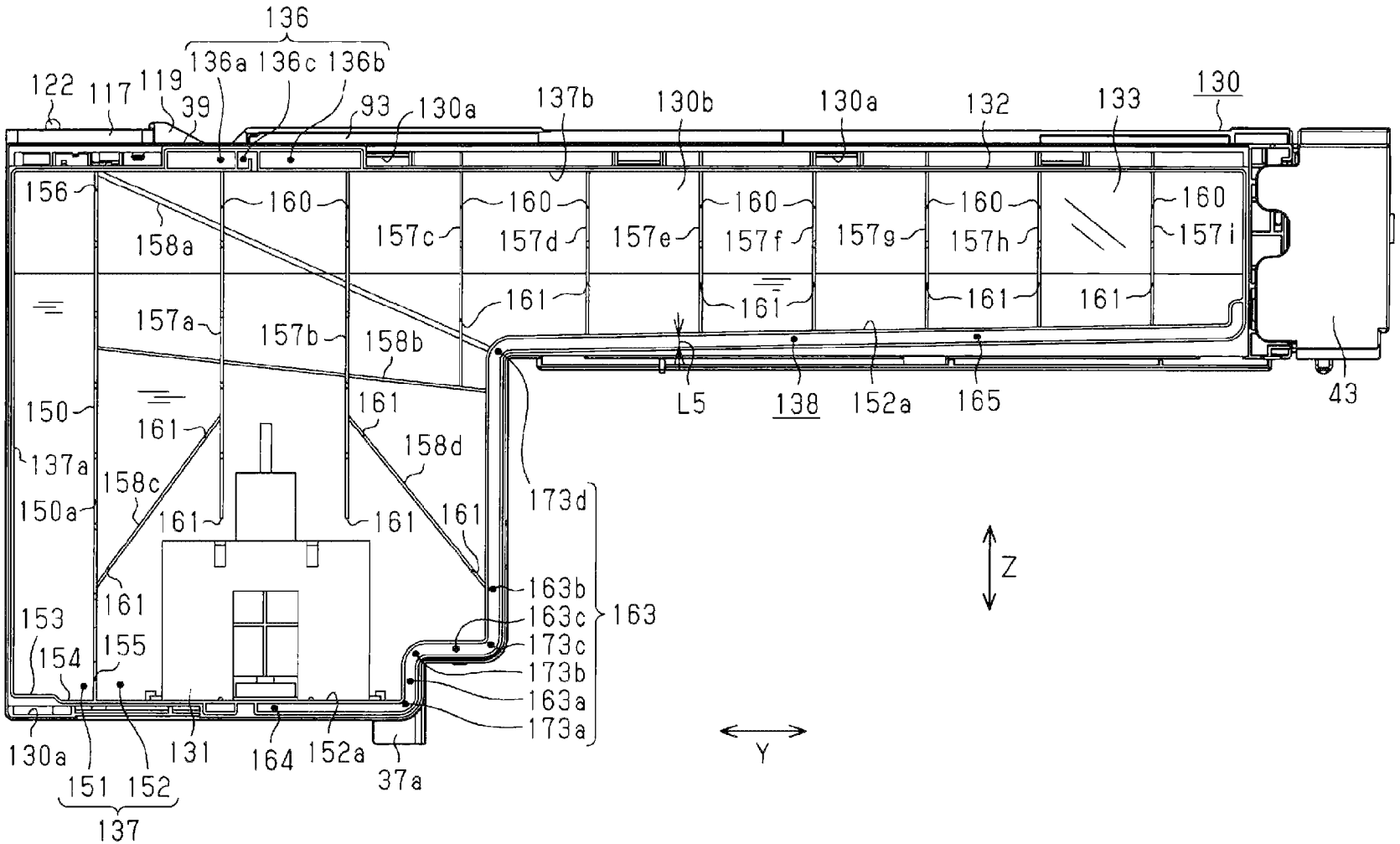
FIG. 14 is a side view of a containing body case to which a film is adhered.

As shown in FIG. 14, after the film 133 is adhered to the case opening portion 132 of the containing body case 130, a space area enclosed by the containing body case 130 and the film 133 functions as an air chamber 136 that is in communication with the atmosphere, an ink chamber 137 serving as an example of a liquid containing chamber that contains the ink, and a guiding flow passage 138 serving as an example of a liquid flow passage. Note that the guiding flow passage 138 is in communication, at its one end, with the ink chamber 137, and the guiding port 69 (see FIGS. 4 and 5) that guides the ink contained in the ink chamber 137 toward the liquid ejection head 24 (on the side of the printer 11) is formed on the other end side of the guiding flow passage 138.

Next, the air chamber 136 and a configuration in which the air is taken into the air chamber 136 will be described.

As shown in FIG. 10, an atmosphere communication hole 140 that is in communication with the atmosphere, and a positioning protrusion 141 extending in the left-right direction X are formed in the upper face 39 of the containing body case 130 in which the injection port 73 is formed. Furthermore, at least one snake groove is formed so as to meander between the aforementioned reinforcement ribs 119 and the positioning protrusion 141. In the present embodiment, two snake grooves 142 and 143 are formed, and a meandering projecting portion 144 that surrounds the periphery of the snake grooves 142 and 143 is also formed.

Figure 15:
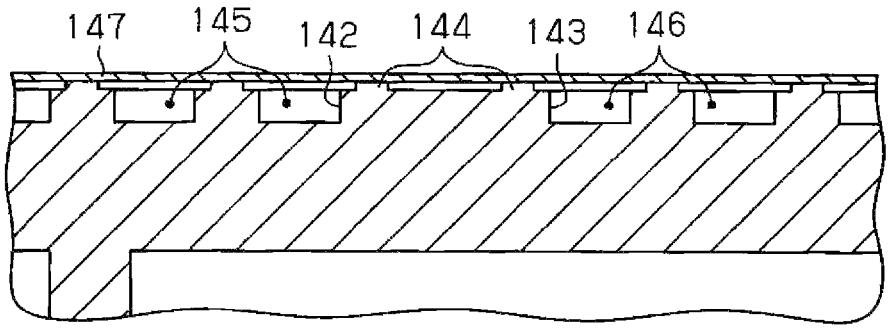
FIG. 15 is an enlarged view of portion D in FIG. 11.

As shown in FIGS. 10 and 15, an air passage forming film 147 that covers the snake grooves 142 and 143 and forms air passages 145 and 146 is adhered (e.g., heat sealing) to the upper face 39 of the containing body case 130. That is to say, after the air passage forming film 147 is adhered to the meandering projecting portion 144 in a state where the air passage forming film 147 is positioned with respect to the reinforcement ribs 119 and the positioning protrusion 141, a first air passage 145 is formed by the first snake groove 142 and the air passage forming film 147. Furthermore, a second air passage 146 is formed by the second snake groove 143 and the air passage forming film 147.

As shown in FIGS. 10 and 11, the atmosphere communication hole 140 is in communication with a first air chamber 136*a*. One end 142*a* of the first snake groove 142 is in communication with the first air chamber 136*a*, and the other end 142*b* thereof is in communication with a second air chamber 136*b*. Furthermore, one end 143*a* of the second snake groove 143 is in communication with the second air chamber 136*b*, and the other end 143*b* thereof is in communication with a third air chamber 136*c*.

Figure 16:
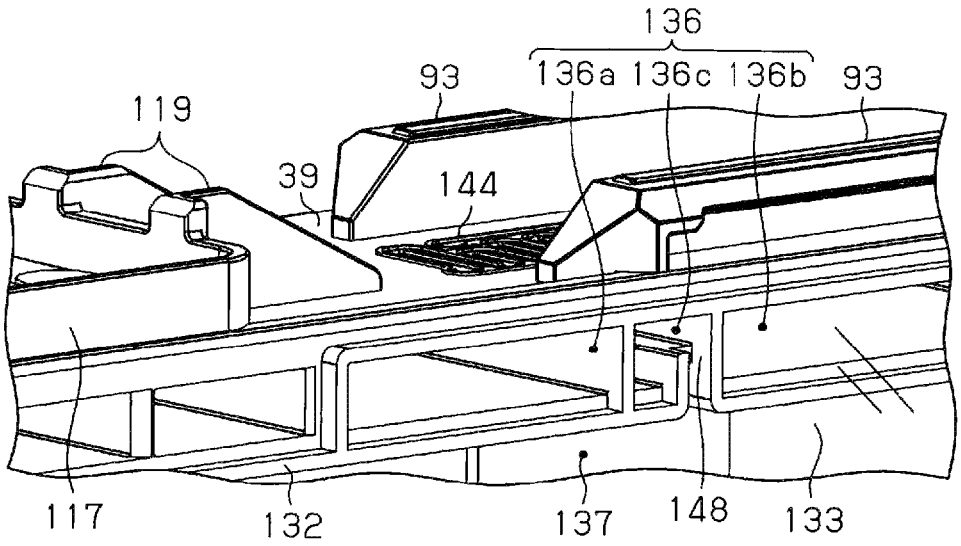
FIG. 16 is an enlarged view of the containing body case to which the film is adhered.

As shown in FIG. 16, an air intake 148 is formed in the third air chamber 136*c*, and the third air chamber 136*c* is in communication with the ink chamber 137 via the air intake 148. For this reason, for example, if the ink contained in the ink chamber 137 is guided out and the pressure in the ink chamber 137 decreases, the outside air taken in from the atmosphere communication hole 140 is taken into the ink chamber 137 via the first air chamber 136*a*, the first air passage 145, the second air chamber 136*b*, the second air passage 146, and the third air chamber 136*c*.

Next, the ink chamber 137 will be described.

As shown in FIG. 14, the ink chamber 137 is shaped such that the height dimension thereof in the up-down direction Z on the front side is larger than the height dimension thereof in the up-down direction Z on the rear side, similarly to the shape of the liquid containing body 33. Furthermore, the ink chamber 137 is partitioned into the first ink chamber 151 serving as an example of a first liquid containing chamber and a second ink chamber 152 serving as an example of a second liquid containing chamber, by a partition wall 150 that intersects a ceiling face 137*b* of the ink chamber 137. The ceiling face 137*b* serves as an example of an injection port forming face in which the injection port 73 is formed.

Note that the partition wall 150 is provided so as to extend in the up-down direction Z, and also intersects a bottom face 153 that faces the ceiling face 137*b*. The width of the partition wall 150 in the left-right direction X is substantially equal to the width from a left side wall 130*b* of the containing body case 130 to the case opening portion 132. The partition wall 150 is formed integrally with the containing body case 130 at a position close to the front side of the ink chamber 137 on which the height of the ink chamber 137 in the up-down direction Z is large, so as to be perpendicular to the side wall 130*b* of the containing body case 130 and to protrude toward the case opening portion 132 (in FIG. 14, toward the near side) from the side wall 130*b*. For this reason, the height of the second ink chamber 152 in the up-down direction Z on the side of the first ink chamber 151 is substantially equal to the height of the first ink chamber 151 in the up-down direction Z, and is larger than the height of the second ink chamber 152 in the up-down direction Z on the rear side separate from the first ink chamber 151. The volume of the first ink chamber 151 is smaller than the volume of the second ink chamber 152.

Specifically, as shown in FIG. 11, the partition wall 150 is formed such that the partition wall 150 and a front wall face 137*a* of the first ink chamber 151 are substantially axially symmetric with respect to a virtual injection line M extending in the up-down direction Z so as to pass through the center of the opening of the injection port 73. That is to say, the injection port 73 is formed in the ceiling face 137*b* of the first ink chamber 151 located frontward of the partition wall 150.

Figure 17:
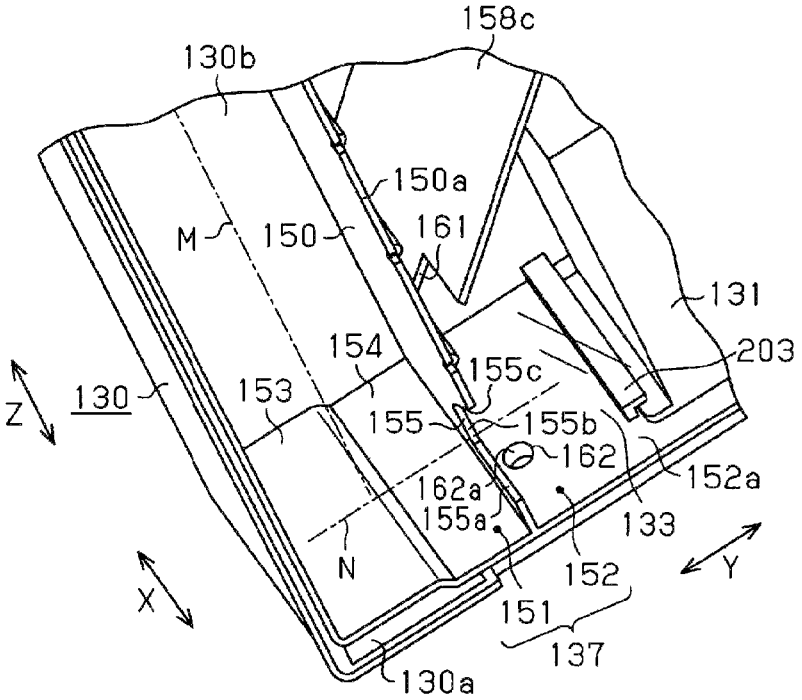
FIG. 17 is an enlarged view of the containing body case to which the film is adhered.

As shown in FIG. 17, a recess portion 154 that is recessed in the gravity direction so as to separate from the injection port 73 is provided at a position in the bottom face 153 of the first ink chamber 151 close to the partition wall 150, such that the position of the recess portion 154 is shifted from the injection port 73 in a direction intersecting the gravity direction. That is to say, the recess portion 154 is provided so as to be spanned in the left-right direction X, at a position shifted from the virtual injection line M in the front-rear direction Y.

As shown in FIGS. 14 and 17, after the film 133 is adhered to the partition wall 150, portions recessed from an adhesion face 150*a* toward the side wall 130*b* function respectively as a wall communication opening (wall communication opening portion) 155 serving as an example of a communication opening, and as a wall ventilation opening (wall ventilation opening portion) 156 serving as an example of a ventilation opening. That is to say, the first ink chamber 151 and the second ink chamber 152 are in communication with each other via the wall communication opening 155 and the wall ventilation opening 156. Note that the wall ventilation opening 156 is formed at the upper end of the partition wall 150 so as to adjoin the ceiling face 137*b*, and is located above the wall communication opening 155.

Meanwhile, the wall communication opening 155 is located below the wall ventilation opening 156 on the side of the bottom face 153, and is formed at a position separate upward from the recess portion 154. Furthermore, a lower face 155*a* of the wall communication opening 155 that is located on the lower side within the wall communication opening 155 is formed substantially horizontally so as to be substantially perpendicular to a far face 155*b* on the left side, and an upper face 155*c* of the wall communication opening 155 that is located on the upper side (the side in the direction opposite to the gravity direction) is not perpendicular to the far face 155*b*. That is to say, the upper face 155*c* inclines in a direction intersecting the horizontal direction. As the upper face 155*c* is more separate from the far face 155*b*, the upper face 155*c* is also more separate from the lower face 155*a*. Furthermore, the wall communication opening 155 is in a relationship in which a communication opening axis N that passes through the center of the opening of the wall communication opening 155 and is perpendicular to the cross-section of the opening (in the present embodiment, extends in the front-rear direction Y) is not parallel with and does not intersect the virtual injection line M. That is to say, the wall communication opening 155 is formed at a twisted position with respect to the injection port 73.

Furthermore, the area of the wall communication opening 155 corresponds to the area of the recessed portion in the partition wall 150, and is smaller than the area of the partition wall 150 and is also smaller than the area of the injection port 73. Furthermore, the area of the wall ventilation opening 156 is smaller than the area of the wall communication opening 155.

As shown in FIG. 14, the second ink chamber 152 has at least one intersecting rib portion that intersects the ceiling face 137*b* and extends in the up-down direction Z. In the present embodiment, nine intersecting rib portions 157*a* to 157*i* are formed at intervals in the front-rear direction Y. Furthermore, the second ink chamber 152 has at least one inclined rib portion serving as an example of a hood portion that intersects the up-down direction Z and the front-rear direction (horizontal direction) Y. In the present embodiment, four inclined rib portions 158*a* to 158*d* are formed. Note that these intersecting rib portions 157*a* to 157*i* and inclined rib portions 158*a* to 158*d* are perpendicular to the side wall 130*b* of the containing body case 130, and are formed integrally with the containing body case 130 so as to protrude from the side wall 130*b* toward the case opening portion 132 (in FIG. 14, toward the near side).

The width of the intersecting rib portions 157*a* to 157*i* in the left-right direction X is substantially equal to the width from the side wall 130*b* of the containing body case 130 to the case opening portion 132. Furthermore, a part of the upper end of each of the intersecting rib portions 157*a* to 157*i* that is in contact with the ceiling face 137*b* is recessed toward the side wall 130*b*. For this reason, after the film 133 is adhered to adhesion faces (right end faces) of the intersecting rib portions 157*a* to 157*i*, the recessed portions each function as a rib ventilation opening (rib ventilation opening portion) 160, which serves as an example of a ventilation opening. Note that the area of each rib ventilation opening 160 is larger than the area of the wall ventilation opening 156, and the size of each rib ventilation opening 160 in the up-down direction Z is larger than the size of the wall ventilation opening 156 in the up-down direction Z. That is to say, the lower opening end of the wall ventilation opening 156 is located at a position closer to the ceiling face 137*b* than the lower opening end of each rib ventilation opening 160. Accordingly, the wall ventilation opening 156 is formed so as to be closer to the ceiling face 137*b* than each rib ventilation opening 160.

A first intersecting rib portion 157*a*, which is closest to the partition wall 150, and a second intersecting rib portion 157*b*, which is second closest thereto, are formed so as to have a gap between a bottom face 152*a* and the first and second intersecting rib portions 157*a* and 175*b*, at a position close to the front at which the size of the second ink chamber 152 in the up-down direction Z is large. For this reason, after the film 133 is adhered to adhesion faces of the first intersecting rib portion 157*a* and the second intersecting rib portion 157*b*, the lower ends of the first intersecting rib portion 157*a* and the second intersecting rib portion 157*b* each function as a rib communication opening (rib communication opening portion) 161, which serves as an example of a communication opening through which the ink can pass. Note that the bottom face 152*a* of the second ink chamber 152 is a face located on the lower side in the up-down direction Z in the second ink chamber 152, and partially bends and inclines so as to conform to the shape of the second ink chamber 152. The float valve 131 is housed between the bottom face 152*a* and the first and second intersecting rib portions 157*a* and 157*b*.

The third intersecting rib portion 157*c* to the ninth intersecting rib portion 157*i* are formed at positions close to the rear of the second ink chamber 152. Furthermore, a part of the lower end of each of the third intersecting rib portion 157*c* to the ninth intersecting rib portion 157*i* is recessed toward the side wall 130*b*. For this reason, after the film 133 is adhered to adhesion faces (right end faces) of the third intersecting rib portion 157*c* to the ninth intersecting rib portion 157*i*, the portions recessed toward the side wall 130*b* at the lower ends of the third intersecting rib portion 157*c* to the ninth intersecting rib portion 157*i* each function as a rib communication opening 161, which serves as an example of a communication opening through which the ink can pass. That is to say, in the second ink chamber 152, spaces separated from each other by the intersecting rib portions 157*a* to 157*i* are in communication with one another via the rib communication openings 161 and the rib ventilation openings 160 that are formed further on the side of the ceiling face 137*b* than the rib communication openings 161.

As shown in FIGS. 13 and 14, a first inclined rib portion 158*a* located at the highest position is formed into a face inclining downward toward the rear from the intersection point between the partition wall 150 and the ceiling face 137*b*. Furthermore, a second inclined rib portion 158*b* at the second highest position is formed into a face inclining downward more gently than the first inclined rib portion 158*a*, toward the rear from a position in the partition wall 150 that is below the first inclined rib portion 158*a*. That is to say, the first inclined rib portion 158*a* and the second inclined rib portion 158*b* are formed so as to intersect the partition wall 150 and intersect the front-rear direction Y. Note that the width of the first inclined rib portion 158*a* and the second inclined rib portion 158*b* in the left-right direction X is smaller than the width of the partition wall 150 and the width of the intersecting rib portions 157*a* to 157*i*. For this reason, when the film 133 is adhered to the case opening portion 132, a gap is formed between the film 133 and the first and second inclined rib portions 158*a* and 158*b*. Accordingly, the spaces partitioned by the first inclined rib portion 158*a* and the second inclined rib portion 158*b* are in communication with each other via the gap.

Furthermore, a third inclined rib portion 158*c*, which serves as an example of a first hood portion, and a fourth inclined rib portion 158*d*, which serves as an example of a second hood portion, are formed at positions that are above the float valve 131 and are further on the side of the bottom face 152*a* than the second inclined rib portion 158*b*. The third inclined rib portion 158*c* is formed between the partition wall 150 and the first intersecting rib portion 157*a*, and the fourth inclined rib portion 158*d* is formed rearward of the second intersecting rib portion 157*b*. The third inclined rib portion 158*c* and the fourth inclined rib portion 158*d* are axially symmetric with respect to an axis (not shown) that passes through the center of the float valve 131 and is aligned with the gravity direction, and are each formed into a face inclining downward from the center of the float valve 131 toward end portions. That is to say, the distance between the upper end of the third inclined rib portion 158*c* and the upper end of the fourth inclined rib portion 158*d* is shorter than the distance between the lower end of the third inclined rib portion 158*c* and the lower end of the fourth inclined rib portion 158*d*.

Note that the width of the third inclined rib portion 158*c* and the fourth inclined rib portion 158*d* in the left-right direction X is substantially equal to the width of the partition wall 150. Furthermore, both ends of the third inclined rib portion 158*c* and the fourth inclined rib portion 158*d* are recessed toward the side wall 130*b*. For this reason, after the film 133 is adhered to adhesion faces (right end faces) of the third inclined rib portion 158*c* and the fourth inclined rib portion 158*d*, the portions recessed toward the side wall 130*b* each function as the rib communication opening 161 through which the ink can pass. Accordingly, the spaces partitioned by the third inclined rib portion 158*c* and the fourth inclined rib portion 158*d* are in communication with each other via the rib communication openings 161.

Figure 18:
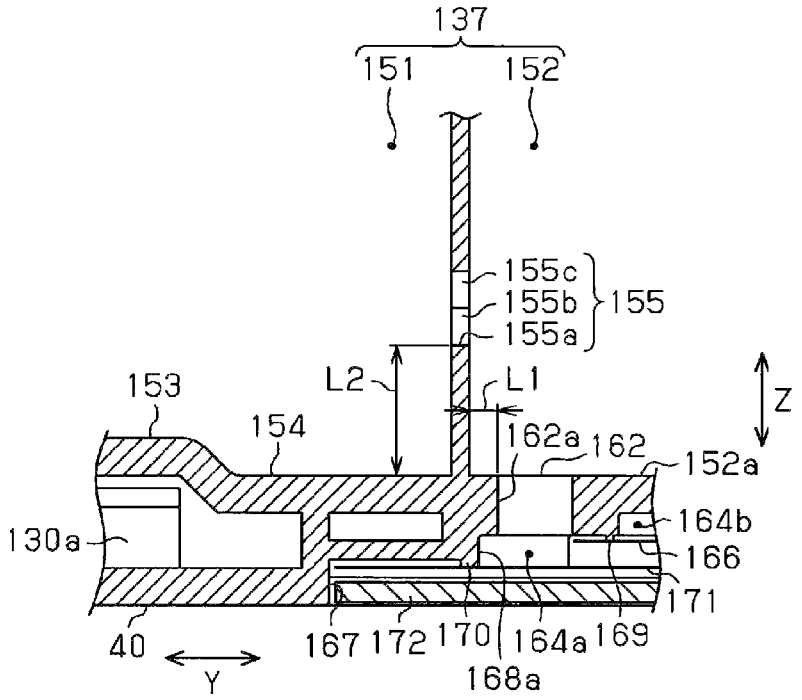
FIG. 18 is a partial cross-sectional view of the containing body case.

As shown in FIGS. 17 and 18, a flow passage opening (flow passage opening portion) 162 that is in communication with the guiding flow passage 138 is formed in the bottom face 152*a* of the second ink chamber 152. That is to say, the inclined rib portions 158*a* to 158*d* are provided so as to be located at positions above the flow passage opening 162 and the float valve 131 and to cover the flow passage opening 162 and the float valve 131 from above. Note that the distance L1 between the flow passage opening 162 and the partition wall 150 in the front-rear direction Y is shorter than the distance L2 between the bottom face 153 and the wall communication opening 155 in the up-down direction Z. Note that the distance L2 in the present embodiment corresponds to the distance between the upper end of the recess portion 154 formed in the bottom face 153 and the lower end of the wall communication opening 155. That is to say, the flow passage opening 162 is formed at a position close to the partition wall 150 in the bottom face 152*a* of the second ink chamber 152.

Next, the guiding flow passage 138 will be described.

As shown in FIG. 14, the guiding flow passage 138 is formed on the lower side of the second ink chamber 152 along the bottom face 152*a* of the second ink chamber 152. The guiding flow passage 138 has a bent flow passage portion 163 that is formed so as to bend in conformity to the shape of the liquid containing body 33, and that causes the ink to flow while changing the ink flowing direction (hereinafter referred to as a "flowing direction"). Furthermore, the guiding flow passage 138 has a connecting flow passage portion 164 that connects the flow passage opening 162 to the bent flow passage portion 163, and an inclined flow passage portion 165 that connects the bent flow passage portion 163 to the guiding port 69.

Figure 19:
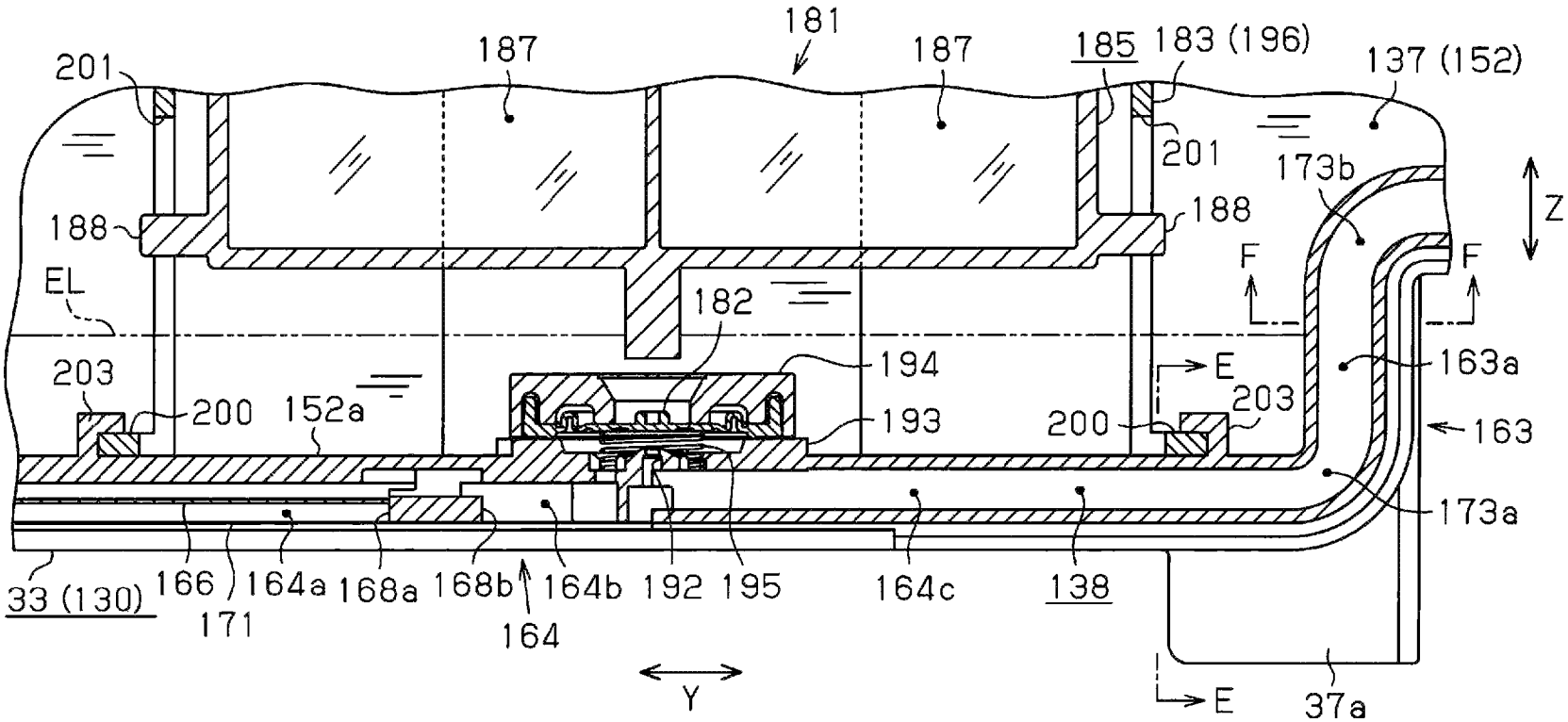
FIG. 19 is a partial cross-sectional view of the containing body case.

As shown in FIGS. 18 and 19, the connecting flow passage portion 164 includes a filter 166 that is substantially rectangular as seen in a bottom view from the lower side. That is to say, the connecting flow passage portion 164 is divided by the filter 166 into a first connecting flow passage portion 164*a* serving as a filter chamber on the side of the flow passage opening 162 and a second connecting flow passage portion 164*b* that is further on the side of the float valve 131 than the filter 166. Furthermore, the connecting flow passage portion 164 includes a third connecting flow passage portion 164*c* that is further on the side of the guiding port 69 than the float valve 131 and is in communication with the bent flow passage portion 163.

Figure 20A:
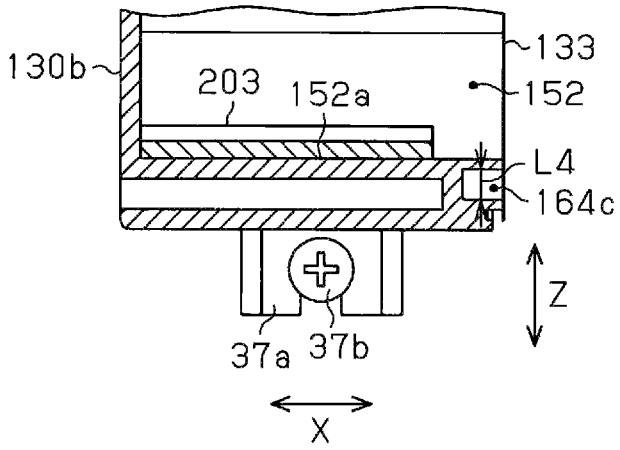
FIG. 20A is a cross-sectional view as seen along arrows E-E in FIG. 19.
Figure 20B:
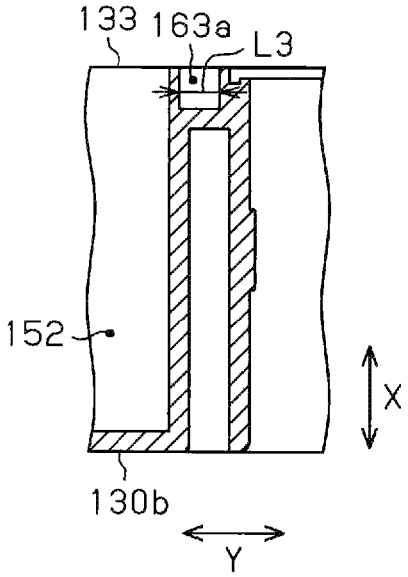
FIG. 20B is a cross-sectional view as seen along arrows F-F in FIG. 19.

As shown in FIGS. 20A and 20B, the cross-sectional area of the bent flow passage portion 163 is larger than the cross-sectional area of the third connecting flow passage portion 164*c*. Note that width of the guiding flow passage 138 in the left-right direction X is substantially constant in the flowing direction. For this reason, the width L3 of the bent flow passage portion 163 (in FIG. 20B, a first vertical flow passage portion 163*a*) in the direction (in the first vertical flow passage portion 163*a*, the front-rear direction Y) perpendicular to both the flowing direction and the left-right direction X is larger than the width L4 of the third connecting flow passage portion 164*c* in the direction (the up-down direction Z) perpendicular to both the flowing direction and the left-right direction X. Furthermore, the cross-sectional area of the inclined flow passage portion 165 is substantially equal to the cross-sectional area of the bent flow passage portion 163. Accordingly, the width L5 (see FIG. 14) of the inclined flow passage portion 165 in the direction perpendicular to both the flowing direction and the left-right direction X is larger than the width L4 of the third connecting flow passage portion 164*c*.

Figure 21:
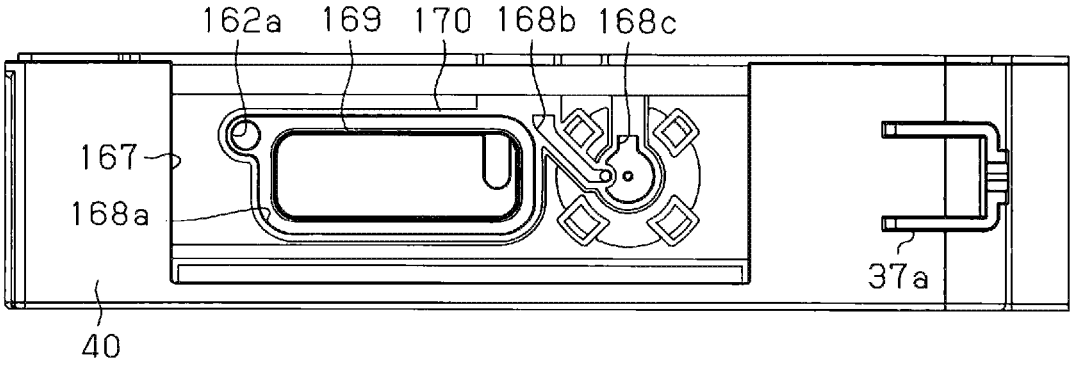
FIG. 21 is a bottom view of the containing body case.

As shown in FIGS. 18 and 21, a substantially rectangular step portion 167 that is recessed toward the upper side, which is the side of the ink chamber 137, is formed in a lower face 40 located close to the front side on which the height of the containing body case 130 in the up-down direction Z is large. The step portion 167 has first to third flow passage forming recess portions 168*a* to 168*c* that are recessed toward the ink chamber 137. A through hole 162*a*, which is formed to penetrate the bottom face 152*a* of the second ink chamber 152 and whose one end serves as the flow passage opening 162, is open toward the first flow passage forming recess portion 168*a* on the other end side. Furthermore, the first flow passage forming recess portion 168*a* is formed so as to have a step such that the inside of a loop projecting portion 169, which is substantially rectangular as seen in a bottom view and to which the filter 166 is adhered, is deeper than the outside thereof. Furthermore, a flow passage projecting portion 170 is formed at the periphery of the first to third flow passage forming recess portions 168*a* to 168*c*. That is to say, the through hole 162*a* and the loop projecting portion 169 are surrounded by the flow passage projecting portion 170.

Accordingly, the connecting flow passage portion 164 is formed by the filter 166 being adhered to the loop projecting portion 169 and a flow passage forming film 171 being adhered (e.g., heat sealing) to the flow passage projecting portion 170. That is to say, after the flow passage forming film 171 is adhered to the flow passage projecting portion 170, the first flow passage forming recess portion 168*a* functions as the first connecting flow passage portion 164*a* and the second connecting flow passage portion 164*b*. The second flow passage forming recess portion 168*b* functions as the second connecting flow passage portion 164*b*. Furthermore, the third flow passage forming recess portion 168*c* functions as the third connecting flow passage portion 164*c*. A protection member 172 that has a substantially rectangular plate shape and protects the flow passage forming film 171 is attached to the step portion 167.

As shown in FIG. 14, the bent flow passage portion 163 includes at least one vertical flow passage portion extending in the up-down direction Z, a plurality of bent portions, and a horizontal flow passage portion extending in the front-rear direction Y. In the present embodiment, the bent flow passage portion 163 includes two vertical flow passage portions 163*a* and 163*b*, four bent portions 173*a* to 173*d* formed on both sides of the vertical flow passage portions 163*a* and 163*b*, and a horizontal flow passage portion 163*c*.

That is to say, the first bent portion 173*a* is located at the lowermost side, and connects the rear end of the third connecting flow passage portion 164*c* to the lower end of the first vertical flow passage portion 163*a*. The second bent portion 173*b* is located above the first bent portion 173*a*, and connects the upper end of the first vertical flow passage portion 163*a* to the front end of the horizontal flow passage portion 163*c*. The third bent portion 173*c* connects the rear end of the horizontal flow passage portion 163*c* to the lower end of the second vertical flow passage portion 163*b*. The fourth bent portion 173*d* connects the upper end of the second vertical flow passage portion 163*b* to the front end of the inclined flow passage portion 165. Accordingly, the bent flow passage portion 163 is different from the inclined flow passage portion 165 in the flowing direction in which the ink is caused to flow, and bends with respect to the inclined flow passage portion 165.

The inclined flow passage portion 165 is formed so as to extend in a direction intersecting the front-rear direction (horizontal direction) Y such that an end portion thereof on the rear side, which is the side of the guiding port 69, is located above (in the direction opposite to the gravity direction with respect to) an end portion thereof on the front side, which is the side of the flow passage opening 162 continuous with the fourth bent portion 173*d*. That is to say, the inclined flow passage portion 165 forms an upward inclined face that is continuous from the side of the flow passage opening 162 toward the guiding port 69. The inclined flow passage portion 165 bends upward on its rear end side and is in communication with the guiding port 69.

Note that the guiding flow passage 138 is located on the side in the gravity direction in the second ink chamber 152, and is provided so as to extend along the bottom face 152*a*. For this reason, the portions of the bottom face 152*a* of the second ink chamber 152 corresponding to the connecting flow passage portion 164 and the horizontal flow passage portion 163*c* are substantially horizontal, while the portion of the bottom face 152*a* of the second ink chamber 152 corresponding to the inclined flow passage portion 165 is a face inclining downward toward the flow passage opening 162.

Next, the float valve 131 will be described.

Figure 22:
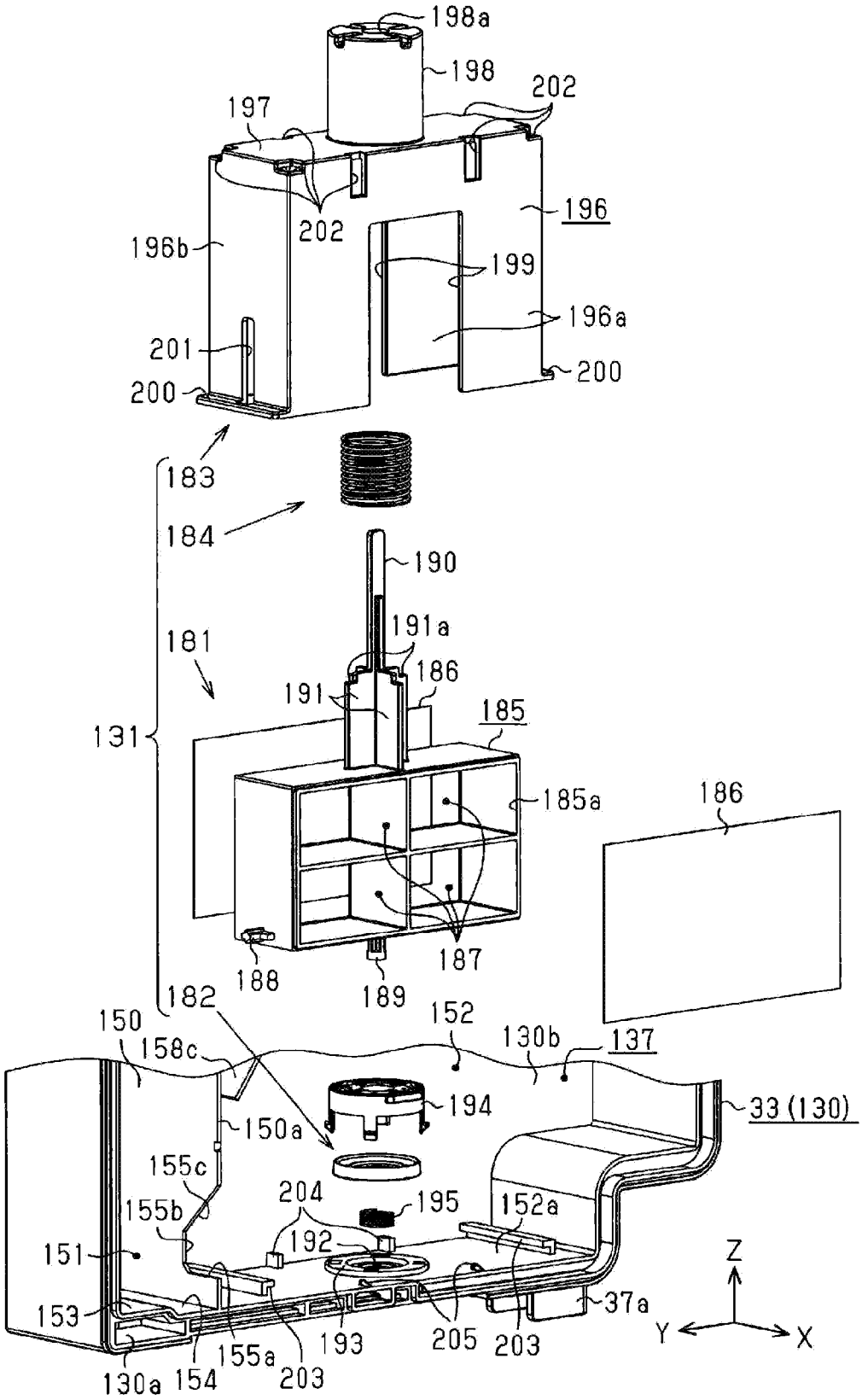
FIG. 22 is an exploded perspective view showing a part of the containing body case and each constituent member of a float valve.

As shown in FIG. 22, the float valve 131 has a float member 181 arranged within the ink chamber 137, a valve body 182 arranged below the float member 181, a restriction case 183 serving as an example of a restriction member arranged above the float member 181, and a coil spring 184 serving as an example of a biasing member arranged between the float member 181 and the restriction case 183. Note that FIG. 22 shows a part of the containing body case 130 in which the ink chamber 137 is formed, together with the aforementioned constituent members of the float valve 131, in order to simply show the configuration in which the float valve 131 is attached into the ink chamber 137.

Each constituent member of the float valve 131 will now be described.

First, the float member 181 has a rectangular frame body 185, the inside of which is divided into a plurality of (in the present embodiment, four) space areas. Thin film members 186, such as transparent films, are adhered to opening portions 185*a* aligned with the front-rear direction Y in left and right side faces of the frame body 185. For this reason, in the float member 181, a plurality of (in the present embodiment, four) sealed gas chambers 187 are formed inward of the thin film members 186 by the opening portions 185*a* of the frame body 185 being covered with the thin film members 186. Accordingly, the float member 181 can float in the up-down direction Z with a change of the ink remaining amount in the ink chamber 137, due to the buoyancy generated by these gas chambers 187.

Meanwhile, projecting portions 188 protruding in the front-rear direction Y are formed in the lower part of front and rear side faces of the frame body 185 that are aligned with the left-right direction X in which the opening portions 185*a* are not formed. A pressing portion 189 having a substantially circular column shape is provided so as to protrude vertically downward from the center position of the lower face of the frame body 185. A bar-shaped portion 190, which is arranged coaxially with the pressing portion 189 in the lower face, is provided so as to protrude and extend vertically upward in an elongated manner from the center position of the upper face of the frame body 185.

Furthermore, plate-shaped portions 191, which form a cross shape as seen in plan view from above around the bar-shaped portion 190, are formed at the periphery of the bar-shaped portion 190 in the upper face of the frame body 185, such that the protruding length of each plate-shaped portion 191 from the upper face of the frame body 185 is substantially half the protruding length of the bar-shaped portion 190. The size of the cross-sectional cross shape of the plate-shaped portions 191 is formed so as to be larger than the outer-diameter dimension of the coil spring 184. Spring seats 191*a* for supporting the coil spring 184 placed thereon are formed in a rectangular shape by cutting off tip edges, which extend radially from the bar-shaped portion 190, of the upper end portions of the plate-shaped portions 191 forming the cross-sectional cross shape.

Next, the valve body 182 is a diaphragm valve that is made of a flexible material such as elastomer and has a substantially circular plate shape. The valve body 182 is arranged at a position above a valve port 192 (see FIG. 19) that is formed as an opening in the bottom face 152*a* of the second ink chamber 152 so as to be located on the boundary between the second connecting flow passage portion 164*b* and the third connecting flow passage portion 164*c* in the guiding flow passage 138. That is to say, a configuration is employed in which a ring-shaped attachment seat 193 that surrounds the valve port 192 is formed in the bottom face 152*a* of the second ink chamber 152, and a similarly ring-shaped attachment tool 194 is interlocked with the attachment seat 193 from above. The valve body 182 is arranged at a position above the valve port 192, in a state where the valve body 182 is sandwiched between the attachment seat 193 and the attachment tool 194.

Assuming that the aforementioned coil spring 184 is a first biasing member having first biasing force, a coil spring 195, which functions as a second biasing member having second biasing force, is arranged within the attachment seat 193 so as to constantly abut against the valve body 182 from below. The valve body 182 is constantly biased by the coil spring 195 toward a valve opening position (the position shown in FIGS.

19 and 28) at which the valve body 182 is separate upward from the valve port 192 and opens the guiding flow passage 138.

Note that the force relationship between the first biasing force of the coil spring 184 and the second biasing force of the coil spring 195 is set to be the following force relationship, based on the presumption that the first biasing force of the coil spring 184 is larger than the second biasing force of the coil spring 195.

Figure 28:
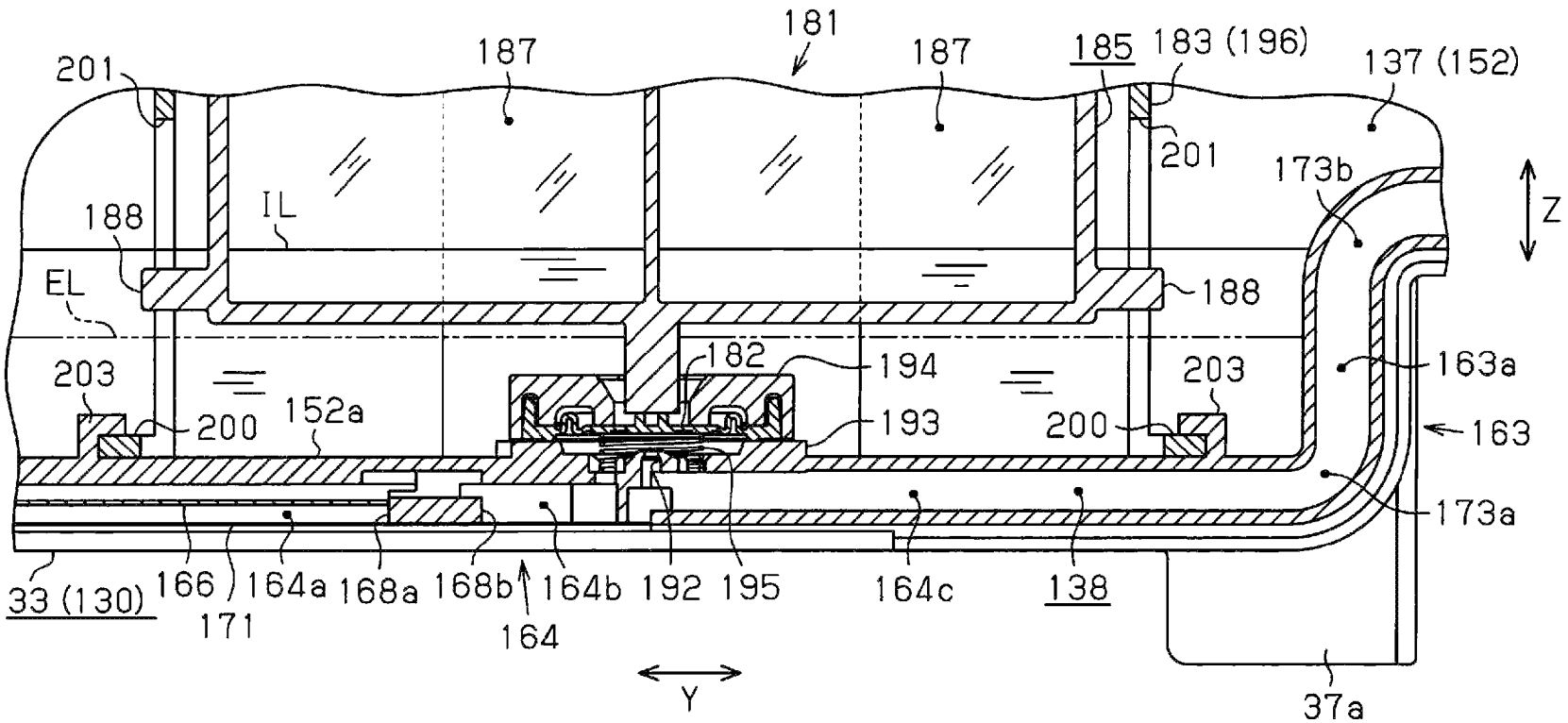
FIG. 28 is a partial cross-sectional view showing a state of the float valve when the ink remaining amount is close to a threshold remaining amount.
Figure 29:
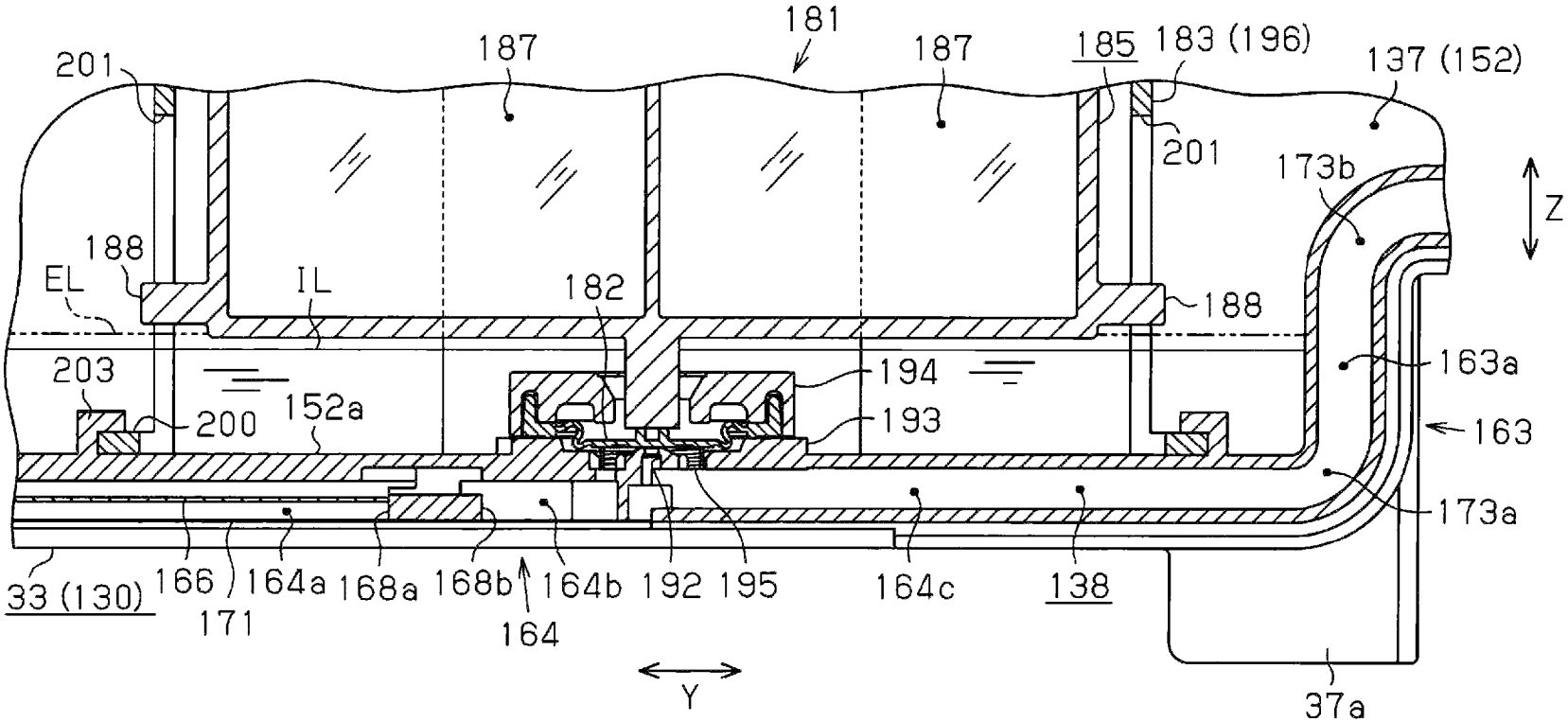
FIG. 29 is a partial cross-sectional view showing a state of the float valve when the ink remaining amount is smaller than the threshold remaining amount.

That is to say, for example, if the ink remaining amount in the ink chamber 137 is smaller than a threshold remaining amount, which is a preset small remaining amount, as shown in FIG. 29, the sum of the buoyancy of the float member 181 floating in the remaining ink at this moment and the second biasing force of the coil spring 195 is set to be smaller than the first biasing force of the coil spring 184. On the other hand, for example, if the ink remaining amount in the ink chamber 137 is larger than or equal to the threshold remaining amount, as shown in FIGS. 19 and 28, the sum of the buoyancy of the float member 181 floating in the remaining ink at this moment and the second biasing force of the coil spring 195 is set to be larger than or equal to the first biasing force of the coil spring 184.

Next, the restriction case 183 has a box shape that is open on the lower side. This box shape is formed so as to have a loop wall portion 196 having a squire loop shape such that the float member 181 can be inserted into and removed from the loop wall portion 196 in the up-down direction Z, and an upper wall portion 197 that closes the upper opening of the loop wall portion 196. That is to say, the loop wall portion 196 is formed in a loop shape capable of surrounding the periphery of a floating area of the float member 181 in the up-down direction Z, with a gap between the loop wall portion 196 and the side faces of the float member 181.

A cylindrical portion 198 whose upper opening is closed is formed at the center position of the upper wall portion 197, so as to be in communication with the inner space of the loop wall portion 196 via a lower opening of the cylindrical portion 198. An insertion hole 198*a* into which the bar-shaped portion 190 protruding upward from the upper face of the float member 181 can be inserted is formed in a penetrating manner in an upper wall portion of the cylindrical portion 198. Spring seats (not shown) are formed so as to bulge downward in an area of the upper wall portion of the cylindrical portion 198, this area having a cross shape as seen in a plan view from above around the insertion hole 198*a*. The spring seats of the cylindrical portion 198 faces, in the up-down direction Z, the spring seats 191*a* formed by cutting out the plate-shaped portions 191 in the float member 181.

Left and right side walls 196*a* of the loop wall portion 196 of the restriction case 183, the side walls 196*a* being aligned with the front-rear direction Y, are facing areas that face the thin film members 186 of the float member 181, in a state where the constituent members of the float valve 131 are put together. A rectangular cutout portions 199 extending in the up-down direction Z in which the float member 181 floats are formed at the substantial center of the left and right side walls 196*a* in the front-rear direction Y, by cutting out the side walls 196*a* from the lower end edges thereof in the upward direction. The cutout portions 199 are formed such that their width dimension in the front-rear direction Y is larger than the outer diameter dimension of the cylindrical portion 198 of the upper wall portion 197, and their height dimension in the up-down direction Z is larger than the height dimension of the frame body 185 of the float member 181 in the up-down direction Z.

Furthermore, band-shaped hook portions 200 having a predetermined width in the front-rear direction Y are formed so as to protrude horizontally toward the front and the rear from lower end portions of front and rear side walls 196*b* of the loop wall portion 196 of the restriction case 183. The side walls 196*b* are aligned with the left-right direction X. Elongated guide holes 201 into which the projecting portions 188 of the float member 181 can be inserted are formed so as to be aligned with the up-down direction Z and respectively extend from positions that are the substantial center of the hook portions 200 in the left-right direction X and also are the substantial center thereof in the front-rear direction Y, up to positions that are slightly below the substantial center of the side walls 196*b* in the up-down direction Z. In the restriction case 183, passing holes 202 are formed in areas spanned from two portions on each of the left and right long sides of the upper wall portion 197 up to upper end portions of the left and right side walls 196*a* of the loop wall portion 196, and in areas at four corners of the upper end portion of the loop wall portion 196. The passing holes 202 bring the inside and the outside of the restriction case 183 into communication with each other such that the ink can flow in and out.

Next, the coil spring 184 is arranged between the float member 181 and the restriction case 183 so as to be able to contract in the up-down direction Z. That is to say, the coil spring 184 is placed on the spring seats 191*a* formed at the upper ends of the plate-shaped portions 191 at the periphery of the bar-shaped portion 190, by inserting the bar-shaped portion 190 of the float member 181 into the coil spring 184 from below. In this state, the bar-shaped portion 190 of the float member 181 is inserted into the insertion hole 198*a* of the cylindrical portion 198 of the restriction case 183, while the frame body 185 of the float member 181 is inserted into the loop wall portion 196 from below. Then, the upper end of the coil spring 184 abuts against the spring seats (not shown) formed so as to bulge downward from the upper wall of the cylindrical portion 198 of the restriction case 183.

Then, a state is maintained where the float member 181 is pressed into the restriction case 183 such that the coil spring 184 further contracts from the above-described state, while the restriction case 183 into which the float member 181 is inserted is attached to the bottom face 152*a* of the second ink chamber 152 of the ink chamber 137. Thus, the float valve 131 is housed in the containing body case 130.

Next, a configuration in which the float valve 131 is attached into the containing body case 130 will be described.

As shown in FIG. 22, interlocking rail portions 203 that have an inverted L-shaped cross-section and into which the front and rear hook portions 200 of the restriction case 183 can be slidably inserted in the left-right direction X are formed in the bottom face 152*a* of the second ink chamber 152 in the containing body case 130. The interlocking rail portions 203 are formed at two positions, namely front and rear positions in the bottom face 152*a* that sandwich the attachment seat 193 of the valve body 182 at the distance corresponding to the dimension of the restriction case 183 in the front-rear direction Y. Positioning portions 204 are formed at two positions, namely front and rear positions that are on the far side of the containing body case 130 and are between the respective interlocking rail portions 203 and the attachment seat 193. The positioning portions 204 can abut against a side wall 196*a* on the far side in the left and right side walls 196*a*, which are aligned with the front-rear direction Y, of the restriction case 183 that has moved by sliding toward the far side of the containing body case 130 in a state where the hook portions 200 are inserted into the interlocking rail portions 203.

Furthermore, in the bottom face 152*a* of the second ink chamber 152, protruding portions 205 are formed at two positions on the near side that correspond, in the left-right direction X, to the positioning portions 204 on the far side. The protruding portions 205 can be interlocked with the lower end portion of a side wall 196*a* of the restriction case 183 on the near side, with the side wall 196*a* on the far side caused to abut against the positioning portions 204, from the near side, which is the opening side of the containing body case 130. These protruding portions 205 are structures that extend obliquely upward toward the far side of the containing body case 130 and are capable of undergoing elastic deformation. The protruding portions 205 are provided in an inclined posture such that, when the restriction case 183 moves by sliding toward the far side by inserting the hook portions 200 into the interlocking rail portions 203, the lower end edges of the side walls 196*a* can get over the protruding portions 205 while sliding from the near side toward the far side. After the side wall 196*a* on the near side gets over the protruding portions 205, the protruding portions 205 are elastically restored to their original inclined posture and are interlocked with the near-side face of this side wall 196*a*, and the restriction case 183 is thereby prevented from moving out from the far side of the containing body case 130 toward the near side thereof.

Figure 23:
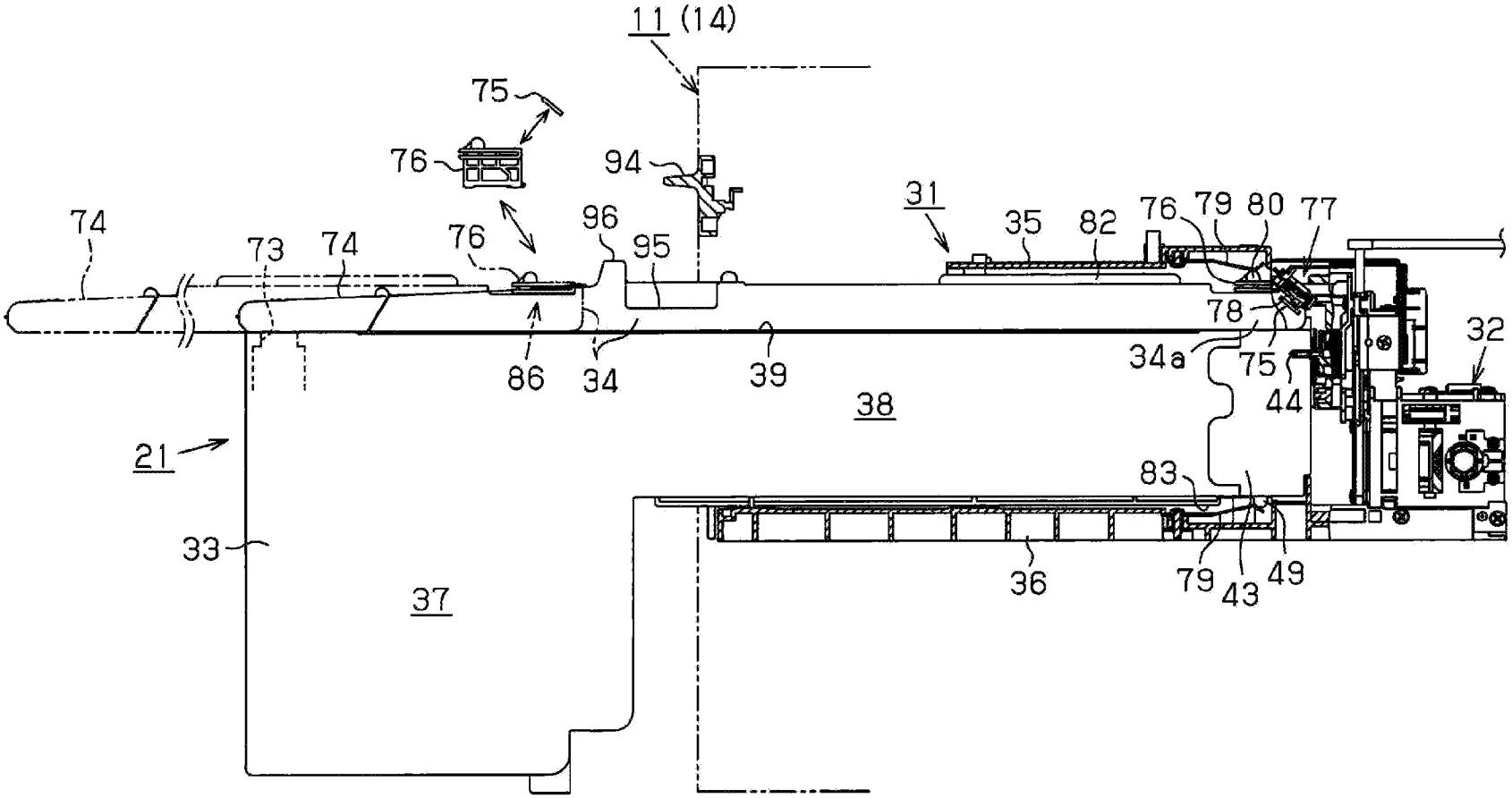
FIG. 23 is a diagram illustrating an operation of the slider in the liquid container installed in a holder.

Next, an operation of the liquid container 21 in the present embodiment will be described. Note that FIGS. 24A, 24B, and 24C omit the slider 34 and the liquid containing body 33. As shown in FIG. 23, in the liquid container 21 in which the portion of the second containing body portion 38 is located within the installation portion 31 and is fixed to the printer 11 so as to be unable to move, upon the slidable tab 94 being displaced upward, the slidable tab 94 is disengaged from the recess portion 95 of the slider 34. Then, the user can pull out the slider 34 from the printer 11 (the installation portion 31) by sliding the slider 34 along the long direction thereof toward the direction opposite to the insertion direction.

As a result of thus pulling out the slider 34, an area of the slider 34 that is located within the printer 11, that is, an area of the slider 34 that overlaps the area (the second area) located within the printer 11 in the second containing body portion 38 including the connecting portion 43 in the upper face 39 of the liquid containing body 33 moves out of the printer 11. In the present embodiment, as indicated by chain double-dashed lines in FIG. 23, the slider 34 moves up to a position at which the user can pull out, outside the printer 11, the chip holder 76 attached to the end portion 34*a* of the slider 34 on the far side in the insertion direction from the holder attaching portion 86 of the slider 34. Accordingly, the area of the slider 34 that overlaps the area (second area) located within the printer 11 in the second containing body portion 38 including the connecting portion 43 in the upper face 39 of the liquid containing body 33 functions as a moving area that moves between the inside and the outside of the printer 11.

Consequently, the user pulls out and removes the chip holder 76 that has moved out of the printer 11 from the slider 34 (the holder attaching portion 86). Then, for example, if there is a recording chip 75 that is already placed on the chip holder 76, this recording chip 75 is replaced with another recording chip 75 that has recorded the related information (e.g., color phase, saturation, brightness, viscosity, solute type of the ink, etc.) related to the ink injected into the liquid containing body 33 from the injection port 73. The user then inserts the chip holder 76 onto which the replacing recording chip 75 is placed again into the slider 34 (the holder attaching portion 86) and thus attaches the chip holder 76 to the slider 34, and thereafter inserts the slider 34 into the printer 11 (the installation portion 31) along the upper face 39 of the liquid containing body 33.

As a result of thus inserting the slider 34, the recording chip 75, which is placed on the chip holder 76 in an inclining manner with respect to the insertion direction, comes into contact with and is electrically connected to the electric terminals 78 of the communication portion 77 included in the supply portion 32, and the related information recorded in the recording chip 75 is transmitted to the printer 11. At the time of this connection, the recording chip 75 is positioned with respect to the electric terminals 78. In a state where the related information recorded in the recording chip 75 is transmitted to (read by) the printer 11, the chip holder 76 is located within the printer 11, and a part (the first area) of the slider 34 is located outside the printer 11. In other words, in a state where the related information recorded in the recording chip 75 is read by the printer 11, the recording chip 75 and the chip holder 76 are located at positions at which the user cannot touch by his/her hand.

Figure 24A:
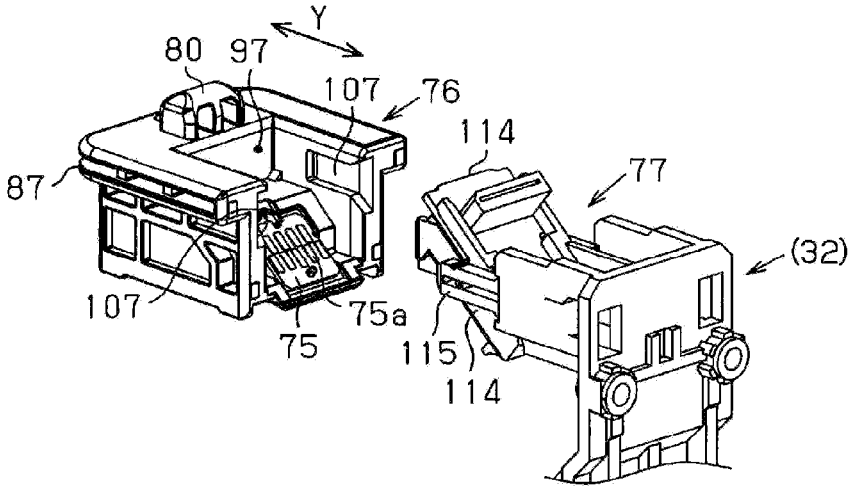
FIG. 24A is a perspective view of the chip holder and a communication portion before engaging with each other.

That is to say, as shown in FIG. 24A, the communication portion 77 included in the supply portion 32 is provided with a terminal portion 114 including the electric terminals 78 that come into contact with the plurality of electrodes 75*a* formed in the recording chip 75, and protrusion-shaped portions 115 that protrude in the short direction and extend in the insertion direction on both sides in the short direction. The terminal portion 114 engages with the recess portion (engaging portion) 97 of the chip holder 76, and the protrusion-shaped portions 115 engage with the groove-shaped portions 107 of the chip holder 76. This recess portion 97 is a face of a wall constituting the chip holder 76, and is formed in a face on the side of the recording chip 75.

Figure 24B:
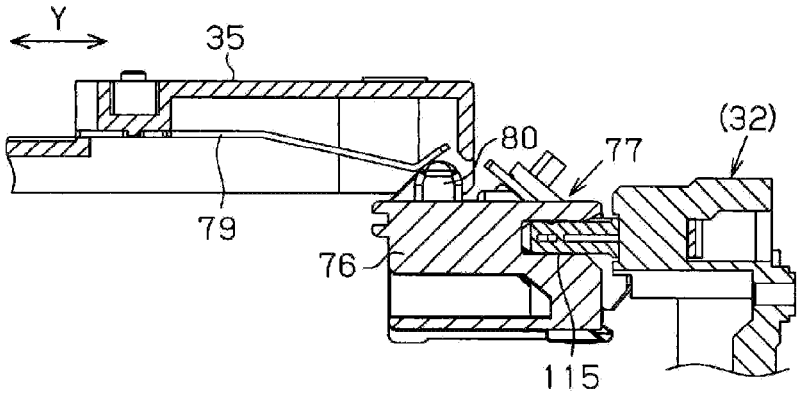
FIG. 24B is a side view with a partial cross-sectional view showing a state of engagement between the chip holder and the communication portion.

At this time, as shown in FIG. 24B, when the slider 34 is inserted into the installation portion 31, the chip holder 76 moves toward the communication portion 77 while the protruding area 80 of the chip holder 76 is pressed downward by the flat spring 79 fixed to the upper frame 35, so as not to separate from the slider 34. During this movement, the protrusion-shaped portions 115 of the communication portion 77 are guided by the chamfered portions 106 and are inserted into and engage with the groove-shaped portions 107 of the chip holder 76, and the chip holder 76 is positioned with respect to the communication portion 77. In this regard, the groove-shaped portions 107 of the chip holder 76 each function as an example of a positioned shape portion that is positioned in the printer 11.

Figure 24C:
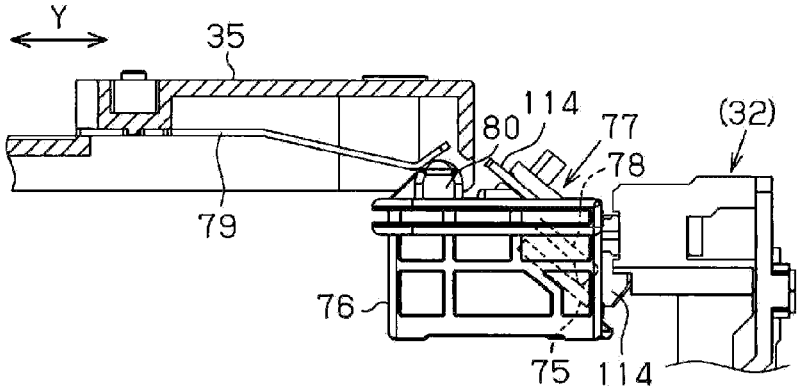
FIG. 24C is a side view of the chip holder and the communication portion after engaging with each other.

Consequently, as shown in FIGS. 24A and 24C, the recording chip 75 placed on the chip holder 76 is positioned with respect to the terminal portion 114 of the communication portion 77, and the plurality of electric terminals 78 included in the terminal portion 114 appropriately come into contact with the plurality of (here, nine) electrodes 75*a* of the recording chip 75. Note that at the time of this contact, since the electrodes 75*a* of the recording chip 75 is in a state of inclining downward in the insertion direction, the electric terminals 78 come into contact with the electrodes 75*a* while rubbing the surface thereof.

Next, an operation related to ink injection into the liquid container 21 will be described.

When the ink is injected into the liquid containing body 33, the openable/closable cover 74 is displaced to the uncovering position, as shown in FIG. 9A, and the covering body 120 is placed on the back face 74*a* of the openable/closable cover 74, thereby exposing the injection port 73, as shown in FIG. 9B.

At this time, after removing the covering body 120 from the injection port 73, the user rotates the fixation portion 123 of the covering member 121 around the center of rotation by an arbitrary angle (in the present embodiment, 180 degrees) with respect to the liquid receiving face 116, and places the covering body 120 on the back face 74*a* of the openable/closable cover 74. In the state shown in FIG. 9B, since the back face 74*a* of the openable/closable cover 74 is located at a position higher than the liquid receiving face 116 in the up-down direction Z, the connecting portion 125 is in a state of being slightly stretched, when the covering body 120 is placed on the back face 74*a* of the openable/closable cover 74. Then, restoring force generated with elastic deformation (stretch) of the connecting portion 125 is exerted on the covering body 120 frontward of the openable/closable cover 74. In this regard, in the present embodiment, the covering body 120 abuts against the hook area 110 of the openable/closable cover 74. Accordingly, a fall of the covering body 120 from the openable/closable cover 74, or the like, is suppressed. Furthermore, the back face 74*a* of the openable/closable cover 74 located at the uncovering position is lowest on the side where the hook area 110 is formed. Accordingly, for example, even if the covering body 120 to which the ink is attached is placed on the back face 74*a* of the openable/closable cover 74, spread of this ink over the entire area of the openable/closable cover 74 (in particular, to the rear area thereof) is suppressed.

Figure 25:
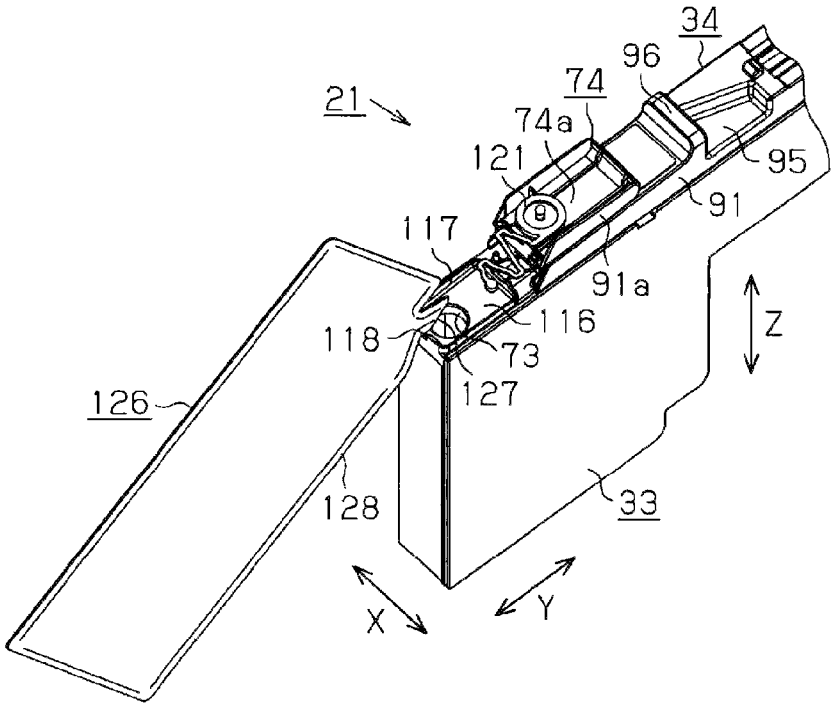
FIG. 25 is a perspective view showing a positional relationship between the liquid container and a liquid injection source when ink is injected.
Figure 26:
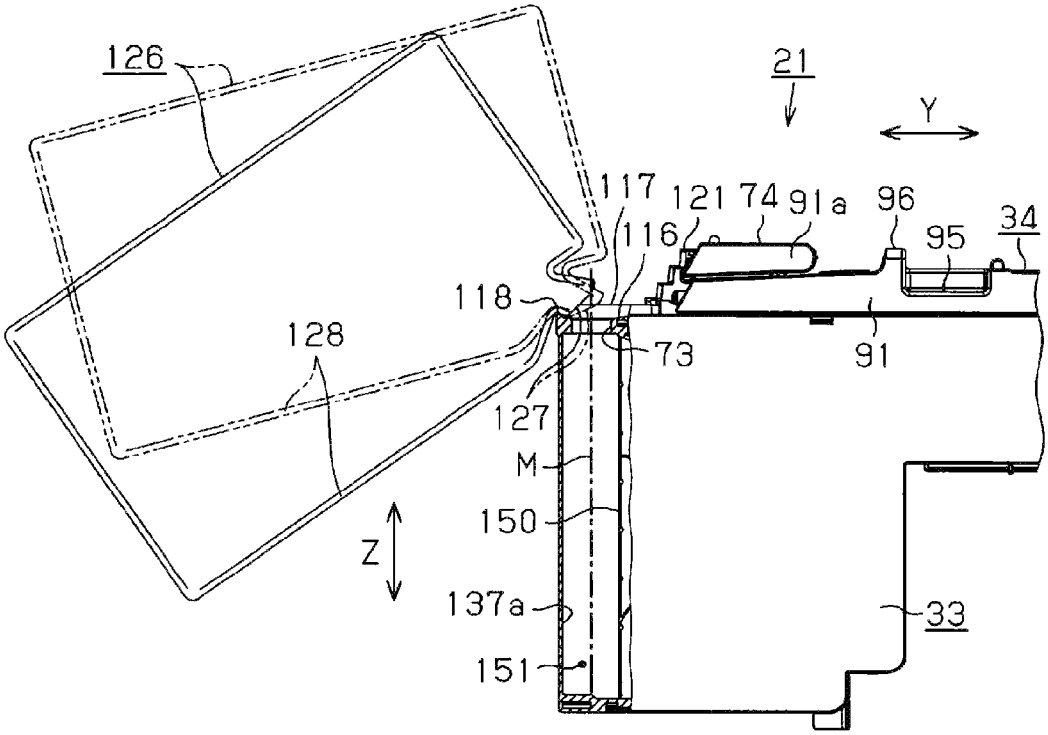
FIG. 26 is a partial cross-sectional side view showing a positional relationship between the liquid container and the liquid injection source when ink is injected.

Then, as shown in FIGS. 25 and 26, the ink is injected into the liquid containing body 33 from the liquid injection source 126 that is formed by adhering edge portions 128 of overlaid films or the like and has an outlet 127. When the ink is injected, the liquid injection source 126 is positioned with respect to the liquid containing body 33 by inserting the edge portion 128 near the outlet 127 of the liquid injection source 126 into the cutoff groove 118 formed in the peripheral wall portion 117 of the liquid containing body 33 so as to abut against the cutoff groove 118. Then, as shown in FIG. 26, the liquid injection source 126 is inclined with respect to the center of inclining movement, which is the point at which the liquid injection source 126 and the liquid containing body 33 abut against each other, such that the outlet 127 of the liquid injection source 126 faces downward. Thus, the ink in the liquid injection source 126 is injected into the first ink chamber 151 via the injection port 73 of the liquid containing body 33.

At this time, if the user forcefully inclines the liquid injection source 126, the ink flowing out from the outlet 127 of the liquid injection source 126 strays from the injection port 73 and is poured around the injection port 73 in the liquid receiving face 116 in some cases. Even in such cases, an outflow of the ink toward the outside of the liquid receiving face 116 is suppressed by the peripheral wall portion 117 surrounding the periphery of the liquid receiving face 116 damming up the ink poured into the liquid receiving face 116. Since the liquid receiving face 116 inclines downward in the left-right direction X and the front-rear direction Y toward the injection port 73, the ink attached to the liquid receiving face 116 is guided up to the injection port 73 along this inclination.

After finishing the ink injection, the injection port 73 of the liquid containing body 33 is covered with the covering body 120 placed on the back face 74*a* of the openable/closable cover 74 as shown in FIG. 9A, and the openable/closable cover 74 is displaced to the covering position as shown in FIG. 2, and the injecting operation ends.

Figure 27:
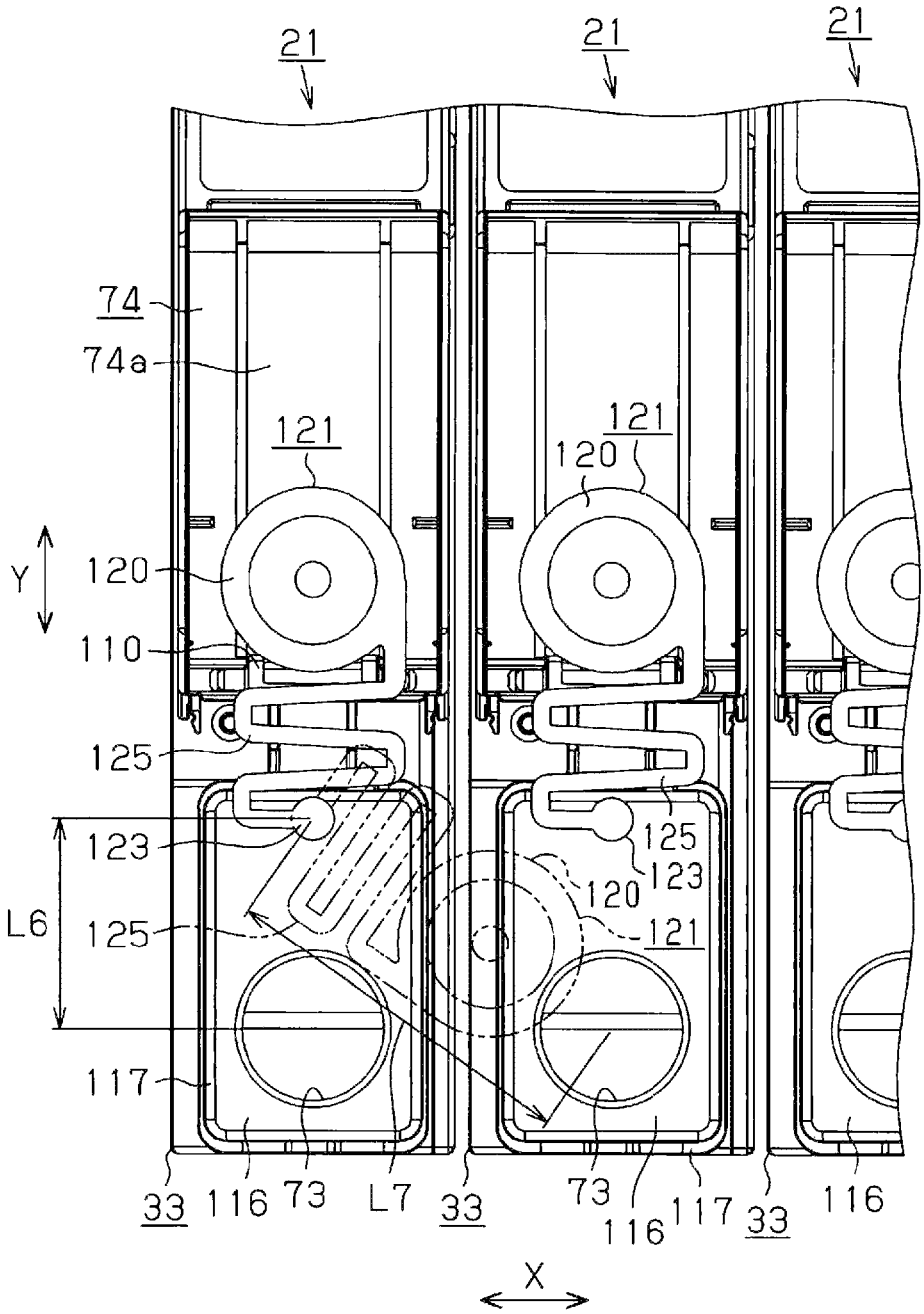
FIG. 27 is a plan view showing a range within which a covering member provided in the liquid container pivots around a fixation portion.

In a state where the plurality of liquid containers 21 are arranged in a line when in use as shown in FIG. 27, the distance L6 from the fixation portion 123 (fixation hole 124) of the covering member 121 to the injection port 73 in one liquid container 21 (e.g., the left end one) is shorter than the distance L7 from the fixation portion 123 of one liquid container 21 to the injection port 73 of the adjacent liquid container 21. With this configuration, as shown in FIG. 27, even if the covering body 120 of the covering member 121 corresponding to the liquid containing body 33 located at the left end is brought toward the injection port 73 of the adjacent liquid containing body 33, with the fixation portion 123 serving as the center of rotation (as indicated by chain double-dashed lines in FIG. 27), this covering body 120 cannot cover this injection port 73. Note that the distances L6 and L7 indicate the distances between one fixation portion 123 (the fixation hole 124) and the center positions of the respective injection ports 73 as seen in a plan view shown in FIG. 27.

Next, an operation within the liquid containing body 33 when the ink is injected from the injection port 73 will be described.

As shown in FIG. 14, upon the ink being injected from the injection port 73, the liquid surface in the first ink chamber 151 rises, and the ink flows into the second ink chamber 152 via the wall communication opening 155. Note that the recess portion 154 is formed in the first ink chamber 151 such that its position is shifted from the injection port 73 in the front-rear direction Y. For this reason, even if a foreign object has been deposited on the recess portion 154, flowing-up of the foreign object is suppressed.

Note that the first ink chamber 151 and the second ink chamber 152 are in communication with each other via the wall ventilation opening 156. For this reason, the pressure in the first ink chamber 151 is substantially the same as that in the second ink chamber 152, and accordingly, the liquid surfaces of the ink in the first ink chamber 151 and the second ink chamber 152 rise so as to reach substantially the same height in the up-down direction Z.

Since the rib communication openings 161 are formed at both ends of the third inclined rib portion 158*c* and the fourth inclined rib portion 158*d*, the ink passes through the rib communication openings 161, and the liquid surfaces of the ink on both sides of each of the third inclined rib portion 158*c* and the fourth inclined rib portion 158*d* are at substantially the same position. Furthermore, the ink passes through the gap formed between the first and second inclined rib portions 158*a* and 158*b* and the film 133, and the liquid surface of the ink moves up to a position above the first inclined rib portion 158*a* and the second inclined rib portion 158*b*. If the liquid surface of the ink further rises, the ink spreads so as to climb the inclined bottom face 152*a* and passes through the rib communication openings 161 of the fourth to ninth intersecting rib portions 157*d* to 157*i*, and the liquid surface rises.

Furthermore, the rib ventilation opening 160 is formed in each of the intersecting rib portions 157*a* to 157*i*. For this reason, the pressures in the spaces on both sides of each of the intersecting rib portions 157*a* to 157*i* in the second ink chamber 152 are substantially the same. Accordingly, the liquid surfaces of the ink in the second ink chamber 152 also rise so as to reach substantially the same height in the up-down direction Z.

In the liquid containing body 33 having the injection port 73, there are cases where a foreign object such as dust mixes in from the injection port 73, and this foreign object itself deposits, or the ink itself is dried up at a gas-liquid interface and becomes a foreign object. Note that, in the first ink chamber 151, a foreign object is deposited on the bottom face 153 and the recess portion 154. Since the wall communication opening 155 is formed separately from the recess portion 154, the mixing of the foreign object into the second ink chamber 152 is suppressed as compared with the inflow of the ink thereinto. That is to say, among foreign objects entering from the injection port 73, a foreign object with a particularly large size or weight is likely to remain in the first ink chamber 151.

In the second ink chamber 152, with a lapse of time, a foreign object is deposited on the inclined rib portions 158*a* to 158*d* in the front area, and is deposited on the bottom face 152*a* in the rear area. Since the inclined rib portions 158*a* to 158*d* and the bottom face 152*a* on which the foreign object is deposited incline so as to intersect the front-rear direction Y, when the ink is guided out from the guiding port 69 and the liquid surface of the ink lowers, the deposited foreign object moves in a direction (downward direction) with the movement of the liquid surface.

Furthermore, when the ink is injected from the injection port 73, an air bubble mixes in with the ink injection in some cases. If the air bubble enters the second ink chamber 152, or melt gas becomes an air bubble in the second ink chamber 152, the air bubble moves upward and reaches the inclined rib portions 158*a* to 158*d*. In this regard, since the inclined rib portions 158*a* to 158*d* intersect the front-rear direction Y in the present embodiment, the air bubble moves along the inclined rib portions 158*a* to 158*d* and are guided toward the liquid surface.

Furthermore, the ink in the second ink chamber 152 flows from the flow passage opening 162 through the guiding flow passage 138, and is guided out from the guiding port 69. That is to say, initially, a foreign object and an air bubble in the ink guided out from the flow passage opening 162 are caught by the filter 166. Thereafter, the ink flows toward the bent flow passage portion 163 via the second connecting flow passage portion 164*b* and the third connecting flow passage portion 164*c*.

Note that, since the flowing direction of the ink changes in the bent flow passage portion 163, the gas that has melted in the ink is likely to become an air bubble. In this regard, with this configuration, the cross-sectional area of the bent flow passage portion 163 is larger than the cross-sectional area of the third connecting flow passage portion 164*c*. Accordingly, the generated air bubble moves toward the inclined flow passage portion 165 with the flow of the ink. Furthermore, the cross-sectional area of the inclined flow passage portion 165 is larger than the cross-sectional area of the third connecting flow passage portion 164*c*, and the inclined flow passage portion 165 forms a face inclining upward toward the guiding port 69. For this reason, the air bubble generated in the bent flow passage portion 163 moves along the inclined flow passage portion 165 toward the guiding port 69, and is guided out from the guiding port 69 together with the ink.

Next, an operation of the float valve 131 will be described.

FIG. 19 shows a state where a liquid surface line IL of the ink in the ink chamber 137 is considerably above a threshold remaining amount line EL, that is, a state where the ink remaining amount in the ink chamber 137 is a necessary and sufficient amount for ejecting the ink toward the sheet S from the liquid ejection head 24 to continue printing. For this reason, in the state shown in FIG. 19, the sum of the second biasing force of the coil spring 195 and the buoyancy of the float member 181 is larger than or equal to the first biasing force of the coil spring 184, and accordingly, the float member 181 is not pressed downward by the first biasing force of the coil spring 184 so as to cause the valve body 182 to abut against the valve port 192.

That is to say, in this case, the sum of the buoyancies generated by the gas chambers 187 of the float member 181 surpasses the first biasing force of the coil spring 184 as shown in FIG. 19, and the float member 181 is in a state of floating at a position separated upward from the valve body 182. Meanwhile, since the valve body 182 is not pressed downward by the coil spring 184 via the float member 181, the valve body 182 receives only the second biasing force exerted upward by the coil spring 195, is separated upward from the valve port 192, and is located at the valve opening position of opening the guiding flow passage 138.

As a result of printing being continued from the state shown in FIG. 19, the ink remaining amount in the ink chamber 137 gradually decreases. When the liquid surface line IL of the ink approaches the threshold remaining amount line EL, a state is achieved where the sum of the buoyancy of the float member 181 and the second biasing force of the coil spring 195 is balanced with the first biasing force of the coil spring 184, as shown in FIG. 28. For this reason, the float member 181 is pressed downward by the first biasing force of the coil spring 184, and the pressing portion 189 in the lower face of the float member 181 is brought into a state of abutting, from above, against the valve body 182 located at the valve opening position. Note that, although the float member 181 abuts against the valve body 182 from above at this time, the float member 181 does not yet displace the valve body 182 toward a valve closing position on the lower side.

As a result of printing being further continued from the state shown in FIG. 28, the ink remaining amount in the ink chamber 137 further decreases. When the liquid surface line IL of the ink falls below the threshold remaining amount line EL, the sum of the buoyancy of the float member 181 and the second biasing force of the coil spring 195 becomes smaller than the first biasing force of the coil spring 184, as shown in FIG. 29. For this reason, the float member 181 is pressed further downward by the first biasing force of the coil spring 184, and the pressing portion 189 in the lower face of the float member 181 presses downward the valve body 182 located at the valve opening position. Consequently, the valve body 182 is displaced to the valve closing position of closing the valve port 192.

Since the valve port 192 is then closed, the guiding flow passage 138 is closed, and the ink no longer flows toward the downstream side of the valve port 192. For this reason, as a result of the ink no longer flowing into the liquid chamber 53 provided on the downstream side of the guiding flow passage 138, the remaining amount detection bar 45 moves and a state is maintained where the light between the light-emitting portion and the light-receiving portion in the sensor 68 is blocked. Accordingly, the state where the ink remaining amount has become smaller than the threshold remaining amount is detected by the sensor 68. When the ink is then newly injected from the injection port 73 into the ink chamber 137 in accordance with this detection result, the liquid surface line IL of the ink in the ink chamber 137 again goes above the threshold remaining amount line EL. Accordingly, the buoyancy of the float member 181 surpasses the first biasing force of the coil spring 184, and the float member 181 is caused to float so as to separate upward from the valve body 182.

At this time, if the valve body 182, which has been pressed downward by the pressing portion 189 of the float member 181 biased downward by the first biasing force of the coil spring 184 and located at the valve closing position of closing the valve port 192, has remained at the valve closing position for a long time, there are cases where the valve body 182 enters a state of sticking to the valve port 192 even after the pressing by the float member 181 from above is cancelled. In this regard, in the case of the present embodiment, the second biasing force of the coil spring 195 biases the valve body 182 located at the valve closing position toward the valve opening position on the upper side. Accordingly, even if the valve body 182 temporarily sticks to the valve port 192, the valve body 182 is then detached from the valve port 192, and this sticking state is cancelled.

If the ink is forcefully injected into ink chamber 137 from the injection port 73, the inflow pressure of the ink flowing into the ink chamber 137 at the time of the injection possibly increases as well. For this reason, there is a possibility that the thin film members 186, which close the opening portions 185*a* of the frame body 185 and form the gas chambers 187 in the float valve 131, is damaged as a result of directly receiving such strong inflow pressure. In this regard, in the case of the present embodiment, the float valve 131 is arranged within the second ink chamber 152 that is separated by the partition wall 150 from the first ink chamber 151 in which the injection port 73 is formed. For this reason, it is possible to avoid the ink injected from the injection port 73 directly falling onto the float valve 131 from above.

Moreover, if the ink forcefully flows into the second ink chamber 152 from the first ink chamber 151 via the wall communication opening 155 formed in the partition wall 150, there is also a possibility that the inflow pressure at this time damages the thin film members 186 of the float member 181 of the float valve 131. In this regard, in the present embodiment, the float member 181 is arranged within the second ink chamber 152 so as to be in a state of not opposing the front-rear direction Y that is the direction in which the ink flows into the second ink chamber 152 via the wall communication opening 155, that is, so as to be in a state where the thin film members 186 are aligned with the front-rear direction Y. For this reason, the inflow pressure of the ink flowing from the wall communication opening 155 into the second ink chamber 152 is exerted on the thin film members 186 of the float member 181 such that the ink flows in the front-rear direction Y along film faces of the thin film members 186.

Note that there can also be a case where some of the plurality of (in the present embodiment, four) gas chambers 187 lose the sealing structure thereof since the thin film members 186 of the float member 181 are partially damaged due to deterioration over time or for other reasons. In such a case, the buoyancy of the entire float member 181 decreases, and accordingly, there is a possibility that the valve function of the float valve 131 fails. However, in the present embodiment, even when only one gas chamber 187 is left, the sum of the buoyancy generated by this single gas chamber 187 and the second biasing force of the coil spring 195 is set to be larger than or equal to the first biasing force of the coil spring 184 when the ink remaining amount becomes larger than or equal to the threshold remaining amount. For this reason, even when only one gas chamber 187 is left, the float valve 131 exerts its valve function without any problems.

When the float member 181 floats in the up-down direction Z with a change of the ink remaining amount in the ink chamber 137, the float member 181 is positioned in the front-rear direction Y and the left-right direction X as a result of the bar-shaped portion 190 of the float member 181 being inserted into the insertion hole 198*a* in the cylindrical portion 198. Since the projecting portions 188 protruding from both front and rear side faces of the frame body 185 are inserted into the elongated guide holes 201 of the restriction case 183, the rotation of the float member 181 around the bar-shaped portion 190 is restricted. Furthermore, in a state where the coil spring 184 is placed on the float member 181, the floating of the float member 181 to a position above the valve opening position of the valve body 182 is restricted by the upper wall of the cylindrical portion 198 of the restriction case 183.

Furthermore, when the float member 181 floats in the front-rear direction Y and the left-right direction X within the ink chamber 137, for example, the thin film members 186 coming into surface contact with the side walls 196*a* of the restriction case 183 that face the thin film members 186 is restricted as a result of the plate-shaped portions 191 with a cross shape abutting, in the horizontal direction, against the inner side faces of the cylindrical portion 198. That is to say, in a state where the bar-shaped portion 190 of the float member 181 is inserted into the insertion hole 198*a* of the cylindrical portion 198, the interval distance between the leading edge of each plate-shaped portion 191 in the radial direction and the inner side face of the cylindrical portion 198 is set to be smaller than the interval distance between each thin film member 186 and the inner face of each of the left and right side walls 196*a* of the restriction case 183. Accordingly, surface contact between the thin film members 186 of the float member 181 and the side walls 196*a* of the restriction case 183 that face the thin film members 186 is restricted. In this regard, the plate-shaped portions 191 each function as an example of a restricting abutting portion that restricts the surface contact between the facing faces of the restriction case 183 and the float member 181 that face each other in the horizontal direction.

Furthermore, regarding the side walls 196*a* of the restriction case 183 and the thin film members 186 of the float member 181 that face each other in the left-right direction X, the rectangular cutout portions 199 are formed in the side walls 196*a* of the restriction case 183. Accordingly, in this case, the thin film members 186 being damaged as a result of sliding on the inner faces of the side walls 196*a* of the restriction case 183 are also suppressed.

Moreover, in particular, if the float member 181 floats upward within the restriction case 183, there is a possibility that the ink in the restriction case 183 is pressed from below by the float member 181, resulting in an increase in the ink pressure. Regarding such an increase in the ink pressure, in the present embodiment, an unnecessary increase in the ink pressure is suppressed since the ink is allowed to flow out from the passing holes 202 and the cutout portions 199 formed at a plurality of positions in the restriction case 183.

According to the above embodiment, the following effects can be achieved.

(1) In the liquid container 21, since the injection port 73 is formed in the first area (the first containing body portion 37) of the liquid containing body 33 that is located outside the printer 11, the ink can be injected in a state where the liquid containing body 33 is fixed to the printer 11. Accordingly, it is possible to suppress damage to the liquid container 21 and the dropping of the liquid remaining inside during an ink injecting operation. Furthermore, when the fixed state is cancelled, the probability that the liquid containing body 33 does not fall off and is held by the printer 11 increases, due to the second area (the second containing body portion 38) of the liquid containing body 33 that is located within the printer 11.

(2) In the liquid container 21, the recording chip 75, which records the information related to the ink injected into the liquid containing body 33 fixed in an immovable manner, can be moved from the outside to the inside of the printer 11, using the slider 34 that slides with respect to the liquid containing body 33. For this reason, if the recording chip is designed to come into contact with the electric terminals 78 or the like provided within the liquid consuming apparatus, for example, when the recording chip is moved toward the inside of the liquid consuming apparatus, the information related to the ink injected into the liquid containing body 33 can be correctly transmitted to the printer 11. It is also possible to place the recording chip 75 onto the chip holder 76 provided in the moving area of the slider 34, outside the printer 11, and thereafter easily insert the placed recording chip 75 into the printer 11 by sliding the slider 34.

(3) Since the injection port 73 is covered with the slider 34, a foreign object entering the injection port 73 can be suppressed without separately providing a lid for the injection port 73.

(4) In a state where the slider 34 covers the injection port 73, the injection port 73 can be covered and exposed by displacing the provided openable/closable cover 74, without sliding the slider 34.

(5) In a state where the openable/closable cover 74 is displaced from the covering position to the uncovering position, the openable/closable cover 74 is located on the side of the printer 11 with respect to the injection port 73. Accordingly, the openable/closable cover 74 can be prevented from hindering an operation for injecting the ink from the injection port 73.

(6) Since the openable/closable cover 74 can be stably maintained at the covering position, it is possible to suppress the injection port 73 being exposed due to unintentional opening of the openable/closable cover 74.

(7) Since the chip holder 76 is positioned within the printer 11 with respect to a direction intersecting the moving direction of the moving area, the recording chip 75 placed on the chip holder 76 is also positioned within the printer 11 with accuracy. Accordingly, for example, since the electric terminals 78 provided in the printer 11 come into contact with the recording chip 75 in a state where a position shift is suppressed, the related information recorded in the recording chip 75 is transmitted to the printer 11 at a high probability.

(8) Since the movement of the chip holder 76 in the sliding direction of the slider 34 is suppressed, the chip holder 76 is positioned with accuracy with respect to the sliding direction of the slider 34 within the printer 11. Furthermore, since the recording chip 75 placed on the chip holder 76 is brought into an inclining state with respect to the sliding direction of the slider 34, for example, the electric terminals 78 provided in the printer 11 move while sliding on the recording chip 75 (the electrodes 75*a*), and are electrically connected thereto. Accordingly, highly reliable electric conductivity is achieved.

(9) When the user injects the ink into the first ink chamber 151 (the ink chamber 137) of the liquid containing body 33 via the injection port 73, even if the ink is spilled around the injection port 73, the spilled ink can be received in the liquid receiving face 116. Since the liquid receiving face 116 inclines downward (in the gravity direction) toward the injection port 73, the ink received in the liquid receiving face 116 is guided along the inclined liquid receiving face 116 up to the injection port 73. Accordingly, even if the ink is spilled around the injection port 73 when the ink is injected into the injection port 73 of the liquid container 21, it is possible to suppress the ink spreading along the outer face of the liquid container 21 from the periphery of the injection port 73 and making the surrounding dirty.

(10) When the ink is injected into the first ink chamber 151 of the liquid containing body 33, an overflow of the ink to the outside of the liquid receiving face 116 can be suppressed by the peripheral wall portion 117 surrounding the periphery of the liquid receiving face 116.

(11) When injecting the ink into the first ink chamber 151 from the liquid injection source 126 via the injection port 73, the user can position the liquid injection source 126 by causing the liquid injection source 126 to abut against the cutoff groove 118 in the peripheral wall portion 117. With this configuration, the user can stably inject the ink when injecting the ink from the liquid injection source 126 into the first ink chamber 151.

(12) The covering body 120 that covers the injection port 73 is fixed to the liquid containing body 33 via the connecting portion 125 and the fixation portion 123. For this reason, it is possible to reduce the possibility that the covering body 120 is lost when the covering body 120 is removed from the injection port 73. Furthermore, as a result of the covering body 120 covering the injection port 73, it is possible to suppress evaporation of the ink from the first ink chamber 151 and a foreign object mixing into the first ink chamber 151.

(13) When the ink is injected, the covering body 120 can be placed on the back face 74*a* of the openable/closable cover 74 located at the uncovering position. With this configuration, when the user injects the ink into the first ink chamber 151, for example, it is possible to suppress the user performing the ink injecting operation in a state where one of his/her hands being unavailable because of holding the covering body 120.

(14) Even if the ink is attached to the covering body 120 when the covering body 120 is placed on the openable/closable cover 74 located at the uncovering position, the leakage of the ink to the outside of the openable/closable cover 74 can be suppressed by the insulating portion.

(15) The covering body 120 can be placed on the back face 74*a* of the openable/closable cover 74 located at the uncovering position, so as to be housed within the face area of the back face 74*a*. Furthermore, even if the ink is attached to the placed covering body 120, it is possible to suppress the ink spreading throughout the back face 74*a* since the back face 74*a* of the openable/closable cover 74 inclines downward (in the gravity direction) toward the injection port 73.

(16) Since the connecting portion 125 of the covering member bends, the connecting portion 125 has an excellent storageability when placed on the liquid receiving face 116. Furthermore, when the ink is attached to the covering body 120 when the covering body 120 is removed from the injection port 73, it is possible to make it hard for the ink to move along the connecting portion 125, as compared with a case where the connecting portion 125 is formed linearly.

(17) Since the fixation portion 123 is fixed onto the liquid receiving face 116 at a position higher than the injection port 73, when the ink is injected into the liquid containing body 33, it is possible to make it hard for the ink flowing on the liquid receiving face 116 to be attached to the fixation portion 123 of the covering member 121. With this configuration, for example, it is possible to suppress the ink being attached to and hardening on the fixation portion 123, and thereby affecting the fixed state of the fixation portion 123.

(18) When the user is about to inject a plurality of types of ink into a plurality of liquid containers 21 (the ink chambers 137), it is possible to suppress the covering body 120 corresponding to one of the liquid containers 21 covering the injection port 73 of the adjacent liquid container 21. With this configuration, it is possible to suppress the ink being mixed, via the covering body 120, into the ink chamber 137 of another liquid container 21 as a result of the covering body 120 corresponding to one liquid container 21 covering the injection port 73 of the other liquid container 21.

(19) The wall communication opening 155 is located at a position that is a twisted position with respect to the injection port 73 and is separate from the bottom face 153. For this reason, the ink injected from the injection port 73 flows into the second ink chamber 152 via the wall communication opening 155, while a foreign object mixing in from the injection port 73 and a foreign object generated within the first ink chamber 151 are harder to pass through the wall communication opening 155 than the ink. That is to say, since it is possible to more easily cause a foreign object to remain in the first ink chamber 151, the ink flows into the second ink chamber 152 while the mixing of the foreign object is suppressed. Accordingly, even if a foreign object mixes in from the injection port 73 or a foreign object is generated inside, the ink can be favorably guided out while the possibility that the mixed foreign object is guided out from the guiding port 69 is reduced.

(20) Since the recess portion 154 is formed by the bottom face 153 being recessed in the gravity direction, even if a foreign object remaining in the first ink chamber 151 subsides with time, this foreign object can be deposited within the recess portion 154. That is to say, when the ink is injected from the injection port 73 in a state where a foreign object is deposited on the recess portion 154, upward floating of the deposited foreign object from the inside of the recess portion 154 toward the outside thereof can be suppressed.

(21) A mixed or generated foreign object can be deposited on the recess portion 154. Since the recess portion 154 is provided such that its position is shifted from the injection port 73 in a direction intersecting the gravity direction, upward floating of the foreign objects deposited on the recess portion 154 can be further suppressed when the ink is injected from the injection port 73.

(22) The flow passage opening 162 can be formed at a position near the partition wall 150 by making the distance L1 between the flow passage opening 162 and the partition wall 150 smaller than the distance L2 between the upper end of the recess portion 154 and the lower end of the wall communication opening 155. For this reason, it is possible to reduce the possibility that a foreign object having passed through the wall communication opening 155 together with the ink from the first ink chamber 151 to the second ink chamber 152 subsides within the flow passage opening 162 and enters the guiding flow passage 138.

(23) Even if a foreign object enters in the second ink chamber 152 or a foreign object is generated within the second ink chamber 152, the foreign object subsiding within the second ink chamber 152 can be deposited on the inclined rib portions 158*a* to 158*d*. Accordingly, it is possible to further suppress the mixing of a foreign object into the ink guided out to the guiding flow passage 138 from the flow passage opening 162 located further on the side in the gravity direction than the inclined rib portions 158*a* to 158*d*.

(24) Since the inclined rib portions 158*a* to 158*d* extend in directions intersecting the up-down direction Z and the front-rear direction Y, a foreign object that has been deposited on the inclined rib portions 158*a* to 158*d* can be collected in a direction, with a decrease of the ink contained in the second ink chamber 152.

(25) Regarding the float valve 131 that displaces the valve body 182 using the float member 181 floating with a change of the ink remaining amount, for example, if a foreign object is deposited on the float member 181, there is a possibility that the float valve 131 performs an erroneous operation due to the weight of the deposited foreign object. In this regard, since the foreign objects can be deposited on the inclined rib portions 158*a* to 158*d* provided on the side in the direction opposite to the gravity direction with respect to the float valve 131, it is possible to suppress the depositing of a foreign object that subsides in the second ink chamber 152, on the float member 181.

(26) Even if a foreign object deposited on the third inclined rib portion 158*c* and the fourth inclined rib portion 158*d* moves with a change of the remaining amount of the ink contained in the second ink chamber 152 and falls off from the third inclined rib portion 158*c* and the fourth inclined rib portion 158*d*, the foreign object can be caused to drop so as to avoid the float valve 131.

(27) The ink guided out from the flow passage opening 162 can be caused to flow toward the float valve 131 after the ink is passed through the filter 166. That is to say, for example, among foreign objects mixing into the ink in the first ink chamber 151 from the injection port 73, foreign objects with a relatively large size remain in the first ink chamber 151 and are deposited on the inclined rib portions 158*a* to 158*d* in the second ink chamber 152. For this reason, since the size of foreign objects mixing into the ink guided out from the flow passage opening 162 to the guiding flow passage 138 is relatively small, even if these foreign objects enter from the flow passage opening 162, clogging of the guiding flow passage 138 is suppressed, as compared with a case where large foreign objects enter. Furthermore, foreign objects mixing into the ink guided out from the guiding port 69 can be further reduced by passing the ink through the filter 166 provided in the guiding flow passage 138.

(28) The area of the wall communication opening 155 is smaller than the area of the injection port 73. Accordingly, in a case where a foreign object with a large size mixes in from the injection port 73, it is possible to reduce the possibility that the foreign object gets over the wall communication opening 155 and enters the second ink chamber 152.

(29) An air bubble in the ink is likely to remain at the bent portions of the guiding flow passage 138. In this regard, an air bubble located at the bent flow passage portion 163 is guided toward the guiding port 69 via the inclined flow passage portion 165. Accordingly, it is possible, for example, to reduce the possibility that an air bubble remaining in the bent flow passage portion 163 becomes large and blocks the guiding flow passage 138, and the ink can therefore be guided out while reducing the influence of the air bubble.

(30) By passing the ink through the filter 166 before causing the ink to flow up to the bent flow passage portion 163 where an air bubble is likely to remain, an already-generated air bubble can be caught in advance.

(31) Since the air bubble generated in the ink chamber 137 moves upward with respect to the gravity direction, it is possible to reduce the possibility that the air bubble enters the guiding flow passage 138 from the flow passage opening 162, by forming the flow passage opening 162 in the bottom face 152*a*.

(32) The ink chamber 137 can be reinforced by forming the inclined rib portions 158*a* to 158*d*. Furthermore, since the inclined rib portions 158*a* to 158*d* extend in directions intersecting the horizontal direction, when an air bubble is generated in the ink contained in the ink chamber 137, the air bubble can be moved along the inclined rib portions 158*a* to 158*d*. That is to say, it is possible to reduce the possibility that the air bubble is caught at the inclined rib portions 158*a* to 158*d*.

(33) The bottom face 152*a* of the ink chamber 137 can be inclined along the inclined flow passage portion 165. That is to say, since the inclined flow passage portion 165 is formed so as to be lower on the side of the flow passage opening 162, the ink in the ink chamber 137 can be collected on the side of the flow passage opening 162.

(34) Since the cross-sectional area of the inclined flow passage portion 165 is large, it is possible to reduce the possibility that the inclined flow passage portion 165 is blocked by an air bubble generated in the bent flow passage portion 163.

(35) Even if an air bubble is generated in the wall communication opening 155, since the upper face 155*c* on the side in the direction opposite to the gravity direction inclines, it is possible to reduce the possibility that the air bubble remains at the wall communication opening 155.

(36) The difference in pressure between the first ink chamber 151 and the second ink chamber 152 can be reduced by the wall ventilation opening 156 formed in the partition wall 150. Furthermore, since the wall ventilation opening 156 in the partition wall 150 is formed closer to the ceiling face 137*b* than the rib ventilation openings 160 formed in the intersecting rib portions 157*a* to 157*i*, it is possible to reduce the possibility that the ink in the second ink chamber 152 enters the first ink chamber 151 from the wall ventilation opening 156.

(37) As a result of the positioning protrusion 141 being formed, the air passage forming film 147 can be easily adhered to the snake grooves 142 and 143, while suppressing a shift of the air passage forming film 147.

(38) The filter 166 can be easily replaced by attaching the filter 166 to the first flow passage forming recess portion 168*a* formed in the lower face 40 of the containing body case 130.

(39) In the float valve 131 arranged within the second ink chamber 152 of the liquid containing body 33, the thin film members 186 closing the opening portions 185*a* of the gas chamber 187 do not directly receive the inflow pressure of the ink flowing into the second ink chamber 152 when the ink is injected from the injection port 73. That is to say, the inflow pressure of the ink is exerted on the thin film members 186 along the film faces thereof. For this reason, even if the ink is forcefully injected into the first ink chamber 151 of the ink chamber 137 from the outside via the injection port 73, it is possible to suppress the inflow pressure of the ink being strongly exerted on the thin film members 186 of the float member 181 in the second ink chamber 152 via the first ink chamber 151, in a direction of pressing the thin film members 186. Accordingly, the float valve 131 arranged inside is not damaged due to the inflow pressure of the ink injected from the outside, and can maintain an appropriate valve operation.

(40) Since the float valve 131 is arranged in the second ink chamber 152 that is separated, by the partition wall 150, from the first ink chamber 151 in which the injection port 73 is formed, it is possible to avoid the ink injected from the outside via the injection port 73 directly falling onto the float valve 131. In this regard as well, the possibility that the float valve 131 is damaged can be further reduced.

(41) Even if, for example, a sealed state of one of the plurality of (in an example, four) gas chambers 187 is lost due to damage or the like, the function of the float valve 131 can be favorably maintained by designing the volumes of the gas chambers 187 such that the total sum of the volumes of the remaining gas chambers 187 generates desired buoyancy in the float member 181.

(42) In particular, when the ink remaining amount becomes larger than or equal to the threshold remaining amount by injection of the ink via the injection port 73, from a state where the ink remaining amount has been smaller than the threshold remaining amount and the valve body 182 has been located at the valve closing position for a long time, a state of the valve body 182 sticking to the valve closing position can be suppressed, and the valve body 182 can be quickly displaced from the valve closing position to the valve opening position.

(43) It is possible to reduce the possibility that the float member 181, when floating in the up-down direction Z, generates movement resistance as a result of sliding in a state of coming into surface contact with the loop wall portion 196 of the restriction case 183, while suppressing, using the loop wall portion 196 of the restriction case 183, the inflow pressure of the ink flowing into the second ink chamber 152 being directly exerted on the float member 181.

(44) It is possible to reduce the possibility that the thin film members 186 slide on the loop wall portion 196 of the restriction case 183 and are damaged, when the float member 181 floats in the up-down direction.

(45) When the float member 181 floats in the up-down direction Z, the ink is allowed to flow between the inside and the outside of the loop wall portion 196 of the restriction case 183 via the passing holes 202. Accordingly, a smooth floating state of the float member 181 can be maintained in accordance with a change of the ink remaining amount.

(46) It is possible to reduce the possibility that the facing faces of the restriction case 183 and the float member 181 that face each other in the horizontal direction, namely the thin film members 186 and the side walls 196*a* cohere with each other due to surface tension of the ink. Accordingly, an appropriate valve operation of the float valve 131 can be favorably maintained.

(47) An operation of displacing the valve body 182 between the valve opening position and the valve closing position can be performed only by pressing the float member 181 against the valve body 182 with a small stroke, which can contribute to making the float valve 131 compact.

Note that the above embodiment can be modified into other embodiments described below.

Figure 30:
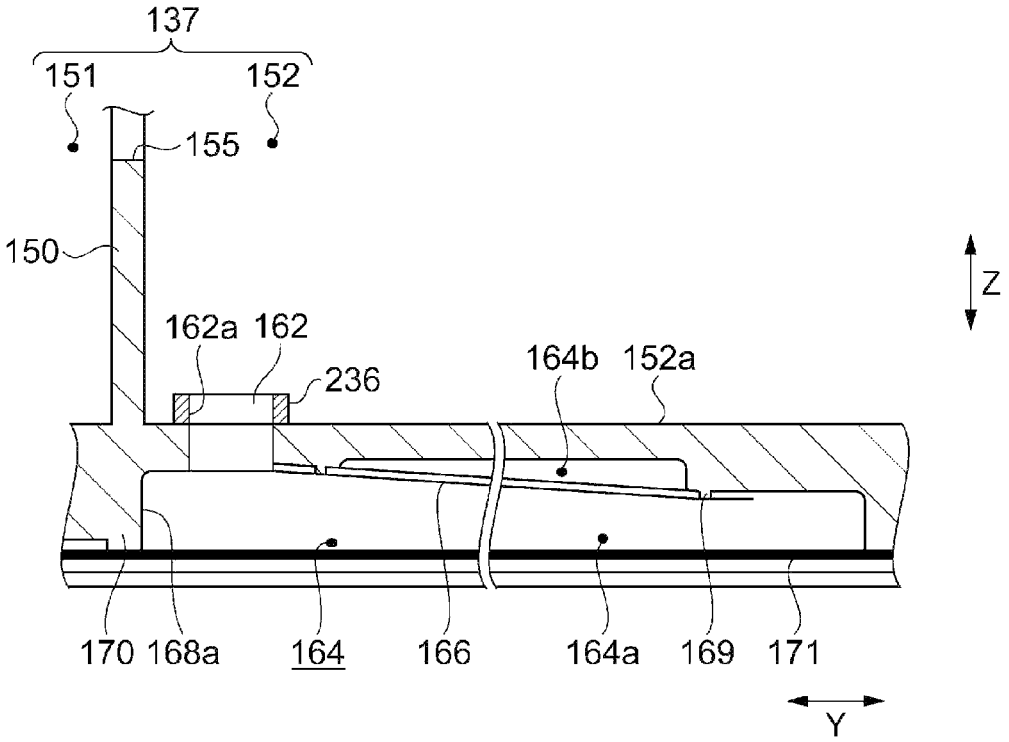
FIG. 30 is a cross-sectional view of a containing body case in another embodiment.

In the above embodiment, regarding the guiding flow passage 138 of the containing body case 130, the filter 166 that partitions the connecting flow passage portion 164 into the first connecting flow passage portion 164*a* and the second connecting flow passage portion 164*b* may incline in a direction with respect to the front-rear direction (horizontal direction) Y, as shown in FIG. 30. In FIG. 30, the filter 166 is formed so as to incline in the front-rear direction Y such that the flow passage opening 162 is located thereabove (in the direction opposite to the gravity direction). That is to say, the filter 166 inclines in an upward orientation so as to rise from the side of a through hole 238 toward the through hole 162*a*. That is to say, the filter 166 inclines such that its end portion located on the upstream side of the ink passing through the connecting flow passage portion 164 is located vertically above its end portion located on the downstream side. It can also be said that the filter 166 inclines such that its end portion located on the side of the float valve 131 is located vertically below its opposite end portion. In still another aspect, the filter 166 inclines in an orientation of approaching the bottom face 152*a* as the filter 166 approaches, in the front-rear direction Y, the side of the through hole 162*a* from the side of the through hole 238. Note that the inclined face of the filter 166 is not limited to a single plane, and may be a curved face protruding toward the first connecting flow passage portion 164*a*, or may be constituted by a plurality of inclined faces, for example.

The ink in the second ink chamber 152 flows from the flow passage opening 162 into the first connecting flow passage portion 164*a*, thereafter passes through the filter 166 from below to above, and flows into the second connecting flow passage portion 164*b*. Since the ink passes through the filter 166 from below to above, a foreign object in the ink caught by the filter 166 subsides below due to its own weight, without being deposited on the filter 166. With this configuration, adverse influence of a foreign object deposited on the filter 166 and blocking the filter 166 can be suppressed.

Furthermore, since the filter 166 inclines such that the flow passage opening 162 is located thereabove, an air bubble in the ink caught by the filter 166 moves upward along the inclined face of the filter 166 without remaining at the filter 166, and is guided out to the second ink chamber 152 from the flow passage opening 162 serving as a guiding port, via the through hole 162*a*. With this configuration, adverse influence of the air bubble remaining at the filter 166 and blocking the filter 166 can be suppressed.

In the second ink chamber 152, as shown in FIGS. 13 and 14, the inclined rib portions 158*a* to 158*d* incline so as to intersect the front-rear direction Y, that is, incline in directions with respect to the horizontal direction. Accordingly, an air bubble guided out into the second ink chamber 152 moves upward along the inclined rib portions 158*a* to 158*d*, which incline, and the air bubble is guided up to the liquid surface of the ink, without remaining at the inclined rib portions 158*a* to 158*d*.

Note that, in an example of the adverse influence of a foreign object and an air bubble in the ink blocking the filter 166, the filter 166 is clogged and pressure loss increases, resulting in the operation of the float valve 131 not being performed correctly and a problem occurring in the operation of supplying the ink to the printer.

Figure 31:
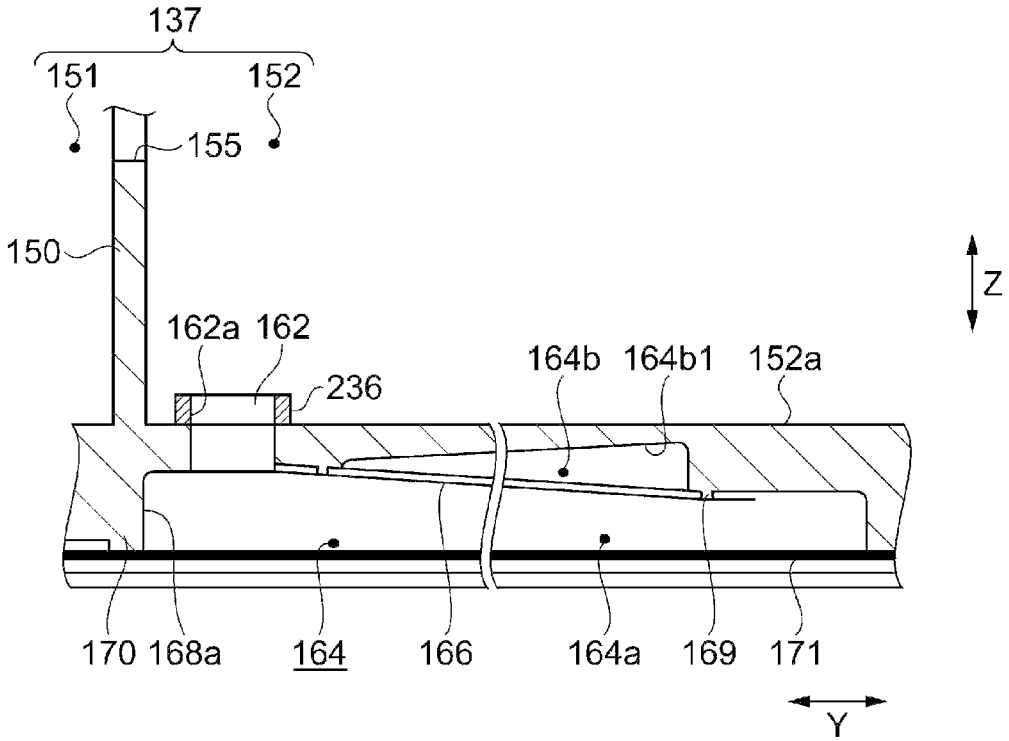
FIG. 31 is a cross-sectional view of a containing body case in another embodiment.

Furthermore, as shown in FIG. 31, the second connecting flow passage portion 164*b* located on the downstream side of the filter 166 may incline upward in the downstream direction with respect to the front-rear direction (horizontal direction) Y. In FIG. 31, the filter 166 inclines upward toward the flow passage opening 162, and an upper wall face 164*b*1 of the second connecting flow passage portion 164*b* also inclines in the direction opposite to the inclination of the filter 166. That is to say, the flow passage on the downstream side of the filter 166 inclines so as to be located above further on the downstream side.

When an air bubble in the ink passes through the filter 166 or when a new air bubble is generated on the downstream side of the filter 166, since the flow passage on the downstream side of the filter 166 inclines upward, these air bubbles can be moved along the flow passage, and the air bubbles remaining in the flow passage can be reduced.

Figure 32:
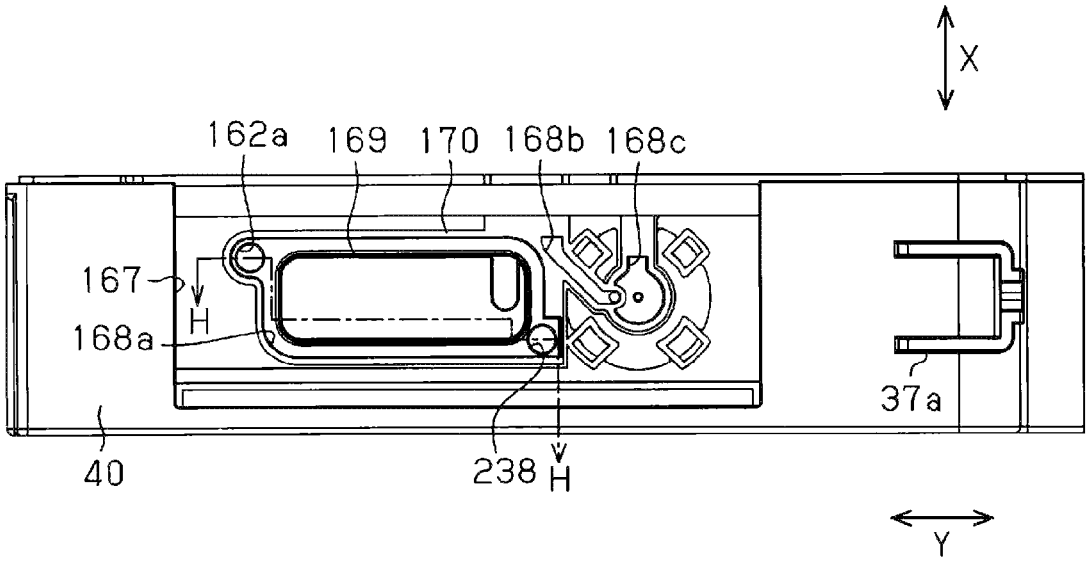
FIG. 32 is a bottom view of a containing body case in another embodiment.
Figure 33:
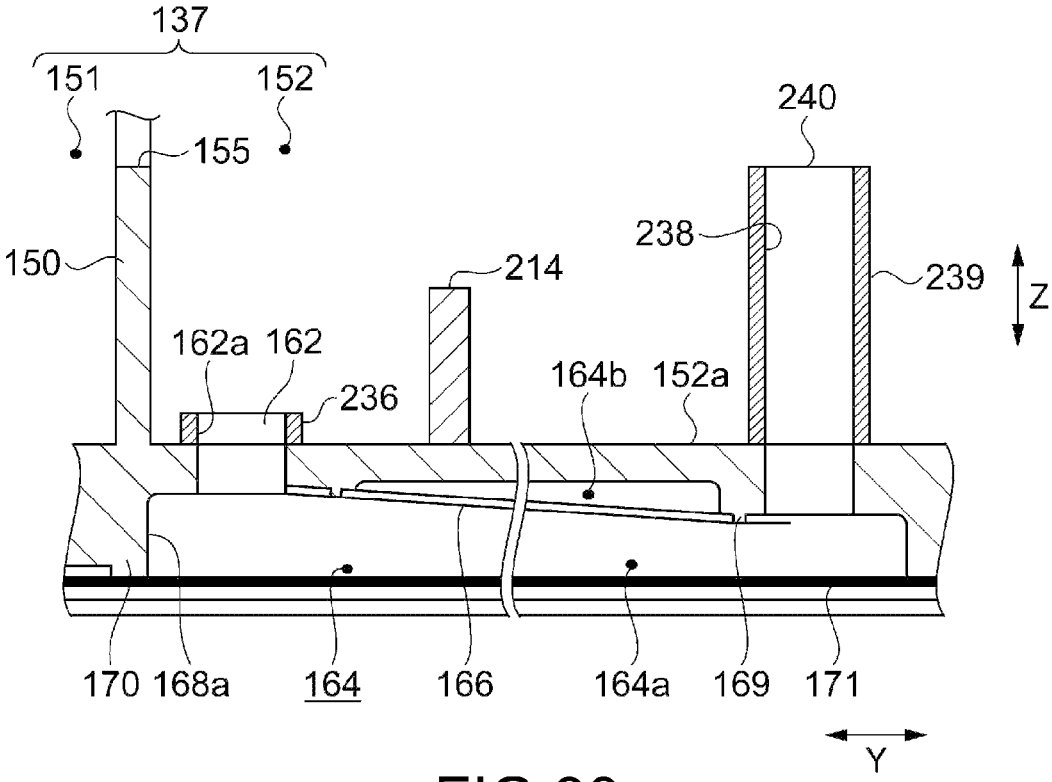
FIG. 33 is a cross-sectional view of the containing body in FIG. 32.

Furthermore, as shown in FIGS. 32 and 33, one or more through holes 238 may be formed in the first flow passage forming recess portion 168*a*, in addition to the through hole 162*a* that is in communication with the second ink chamber 152. In FIG. 33, as in FIGS. 30 and 31, the filter 166 inclines upward toward the flow passage opening 162. The through holes 162*a* and 238 are formed in the bottom face 152*a*, one end of each through hole is open toward the second ink chamber 152, and the other end thereof is open toward the first connecting flow passage portion 164*a*. Accordingly, the through hole 162*a* and the through hole 238 are in communication with the first connecting flow passage portion 164*a*, and cause the second ink chamber 152 and the first connecting flow passage portion 164*a* to be in communication with each other. Note that, as shown in FIG. 31, the second connecting flow passage portion 164*b* on the downstream side of the filter 166 may incline upward toward the downstream direction.

As shown in FIG. 32, the through holes 162*a* and 238 are formed so as to sandwich the filter 166 in the front-rear direction Y. Note that the through holes 162*a* and 238 are formed separately from each other at positions that are diagonal in the first flow passage forming recess portion 168*a*, which is substantially rectangular as seen in a bottom view. Note that the through holes 162*a* and 238 may be formed so as to sandwich the filter 166 in the left-right direction X.

As shown in FIG. 33, the bottom face 152*a* of the second ink chamber 152 is provided with a cylinder portion 239, which serves as an example of a cylindrical portion forming the through hole 238, so as to be aligned with the up-down direction Z. The height of the cylinder portion 239 forming the through hole 238 in the up-down direction Z is larger than the height of a first cylinder portion 236 forming the through hole 162*a* or the height of the through hole 162*a*, and an opening portion 240 provided on the upper side of the cylinder portion 239 is located above the flow passage opening 162 or the through hole 162*a*. Furthermore, a protrusion portion 214 that protrudes upward from the bottom face 152*a* is provided at a position between the through hole 162*a* and the through hole 238. Note that the protrusion portion 214 is formed so as to extend in the left-right direction X, and the height thereof in the up-down direction Z is larger than the height of the first cylinder portion 236 and is smaller than the height of the cylinder portion 239.

The opening of the through hole 162*a* on the side of the first connecting flow passage portion 164*a* and the opening of the through hole 238 on the side of the first connecting flow passage portion 164*a* are located at the same height as the respective end portions of the filter 166 on the close side, or are located above these end portions.

Note that, in an initial state where the ink is not contained in the ink chamber 137, the ink chamber 137 and the connecting flow passage portion 164 are filled with air. For this reason, for example, if only one through hole 162*a* is formed in the first flow passage forming recess portion 168*a*, the air cannot pass through the filter 166 and remains within the first connecting flow passage portion 164*a*, blocking a flow of the ink in some cases.

However, the following effect can be achieved in the case of the embodiment shown in FIGS. 32 and 33. Since two through holes 162*a* and 238 are formed in the first flow passage forming recess portion 168*a*, when the ink flows in from one of these through holes, the air can be discharged from the other one. Furthermore, since the through holes 162*a* and 238 are formed, the injected ink initially passes through the through hole 162*a* from the flow passage opening 162 formed at a low position, and then flows into the first connecting flow passage portion 164*a*. At this time, the ink does not flows in from the through hole 238 whose opening portion 240 is located above the flow passage opening 162, and the air in the first connecting flow passage portion 164*a* is discharged into the second ink chamber 152 via the through hole 238. Accordingly, the air remaining within the first connecting flow passage portion 164*a* can be reduced, and it is possible to reduce the possibility that the air is trapped by the filter 166 provided at the first connecting flow passage portion 164*a*.

Since the cylinder portion 239 is provided, all buoyancy of the air in the volume part of the cylinder portion 239 is exerted in the air discharging direction (toward the second ink chamber 152), and the air can be efficiently discharged.

Since the two through holes 162*a* and 238 are formed separately from each other while sandwiching the filter 166, the air can be efficiently discharged from the through hole 238, using the flow of the ink flowing into the first connecting flow passage portion 164*a* from the through hole 162*a*.

The ink flowing into one of the two through holes 162*a* and 238 can be blocked by the protrusion portion 214. That is to say, it is possible to achieve a state where the ink is not flowing into the first connecting flow passage portion 164*a* from the through hole 238 although the ink is flowing into the first connecting flow passage portion 164*a* from the through hole 162*a*. The air can be efficiently discharged using the pressure difference between the through hole 162*a* and the through hole 238 that is generated due to the above-described state.

Since the height of the opening of the through hole 162*a* on the side of the first connecting flow passage portion 164*a* is the same as, or larger than or equal to, the height of the end portion of the inclined filter 166 on the upstream side, the air is likely to move to the through hole 162*a* located at a position higher than the end portion of the filter 166 on the upstream side. Meanwhile, since the height of the opening of the through hole 238 on the side of the first connecting flow passage portion 164*a* is the same as, or larger than or equal to, the height of the end portion of the inclined filter 166 on the downstream side, the air (air bubble) that has moved to the downstream side of the filter 166 is likely to move toward the through hole 238 located at a position higher than the end portion of the filter 166 on the downstream side. Thus, the air (air bubble) remaining immediately below the filter 166 can be suppressed.

The heights of the cylinder portions 236 and 239 in the up-down direction Z may be the same. That is to say, the flow passage opening 162 and the opening portion 240 may be formed at the same position in the up-down direction Z. Furthermore, the cylinder portions 236 and 239 do not have to be formed. Even in this case, the injected ink initially passes through the through hole 162*a* formed at a position near the injection port 73 and then flows into the first connecting flow passage portion 164*a*. At this time, the ink does not flows in from the through hole 238 located at a position that is more separate from the injection port 73 than the through hole 162*a*, and the air within the first connecting flow passage portion 164*a* is discharged into the second ink chamber 152 via the through hole 238. Accordingly, the air remaining within the first connecting flow passage portion 164*a* can be reduced.

After the ink is initially packed, the ink flows into the first connecting flow passage portion 164*a* from the through hole 162*a* and the through hole 238. Accordingly, the speed of the ink flowing into the first connecting flow passage portion 164*a* can be increased. Furthermore, even if one of the through hole 162*a* and the through hole 238 is blocked by a foreign object or the like, the ink can be caused to flow in from the other through hole.

Figure 34:
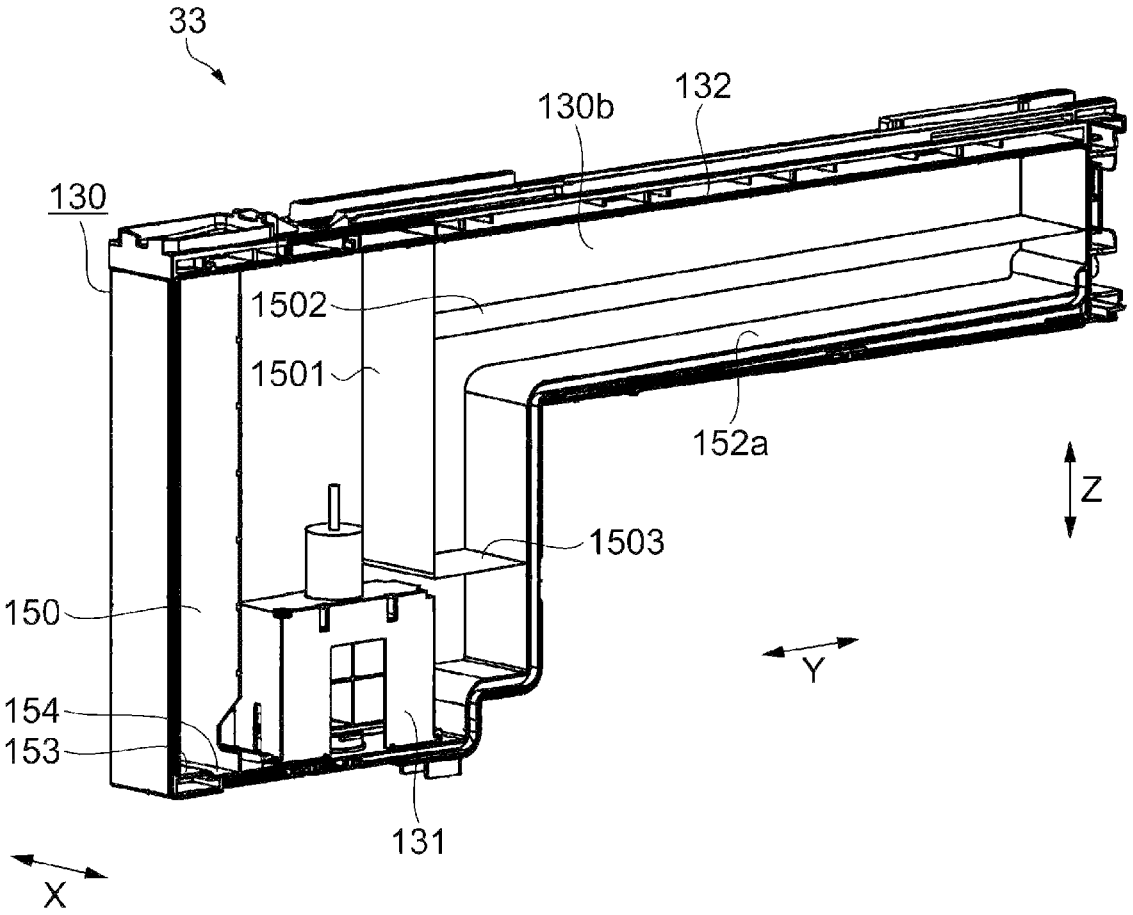
FIG. 34 is an exploded perspective view of a containing body case in another embodiment.
Figure 35:
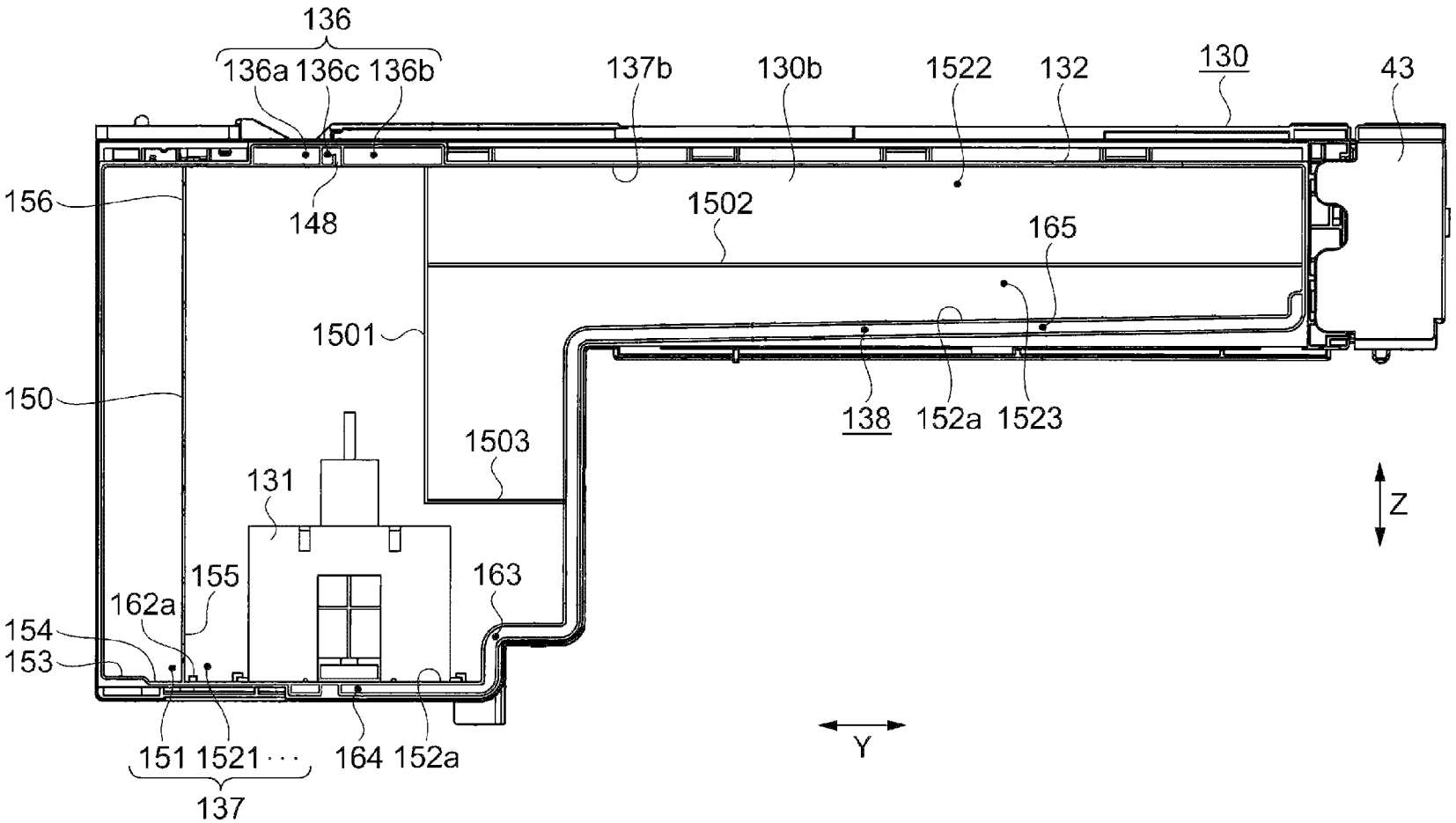
FIG. 35 is a side view of a containing body case in another embodiment.

In the above embodiment, regarding the ink chamber 137 of the containing body case 130, the ink chamber 137 may be partitioned into four ink chambers, namely the first ink chamber 151, a second ink chamber 1521, a third ink chamber 1522, and a fourth ink chamber 1523, by partition walls 150, 1501, 1502, and 1503, as shown in FIGS. 34 and 35. Note that FIG. 34 omits the film 133 adhered to the case opening portion 132 of the containing body case 130 and the cover 134 covering the case opening portion 132 that are shown in FIG. 13.

In FIGS. 34 and 35, the width of each of the partition walls 150, 1501, 1502, and 1503 in the left-right direction X is substantially equal to the width from the left side wall 130*b* of the containing body case 130 to the case opening portion 132. The first ink chamber 151 and the second ink chamber 1521 are in communication with each other via the wall communication opening 155 and the wall ventilation opening 156. The second ink chamber 1521 and the fourth ink chamber 1523 are in communication with each other via a flow passage (not shown). The fourth ink chamber 1523 and the third ink chamber 1522 are in communication with each other via a flow passage (not shown). Thus, the ink flows from the first ink chamber 151 to the second ink chamber 1521, the ink flows from the third ink chamber 1522 to the fourth ink chamber 1523, and the ink flows from the fourth ink chamber 1523 to the second ink chamber 1521.

The height of the second ink chamber 1521 on the side of the first ink chamber 151 in the up-down direction Z is substantially equal to the height of the first ink chamber 151 in the up-down direction Z, and is larger than the heights of the third ink chamber 1522 and the fourth ink chamber 1523 in the up-down direction Z. The position in the up-down direction Z of the liquid surface of the ink that can be contained in the first ink chamber 151 is substantially equal to the position in the up-down direction Z of the liquid surface of the ink that can be contained in the second ink chamber 1521 and to the position in the up-down direction Z of the liquid surface of the ink that can be contained in the third ink chamber 1522, and is higher than the position in the up-down direction Z of the liquid surface of the ink that can be contained in the fourth ink chamber 1523. That is to say, it can be said that the first ink chamber 151, the second ink chamber 1521, and the third ink chamber 1522 are the ink chambers located at the uppermost position in the ink chamber 137. Furthermore, the air intake 148 is formed in the ceiling face 137*b* of the second ink chamber 1521. The second ink chamber 1521 is in communication with the outside air from the air intake 148 via the third air chamber 136*c*, the second air chamber 136*b*, the first air chamber 136*a*, and the like.

The guiding flow passage 138 formed below the second ink chamber 1521 and the fourth ink chamber 1523 has the connecting flow passage portion 164, the bent flow passage portion 163, and the inclined flow passage portion 165. The second ink chamber 1521 and the connecting flow passage portion 164 are in communication with each other due to the through hole 162*a* formed in the bottom face 152*a* of the second ink chamber 1521, as shown in FIG. 30 (here, the second ink chamber 152 shown in FIG. 30 is replaced with the second ink chamber 1521). Furthermore, the filter 166 that partitions the connecting flow passage portion 164 into the first connecting flow passage portion 164*a* and the second connecting flow passage portion 164*b* inclines upward toward the flow passage opening 162.

Note that the configuration of the ink chambers is not limited to the configuration shown in FIGS. 34 and 35, and the number of ink chambers can be reduced or increased, for example. A configuration may also be employed in which the intersecting rib portions and the inclined rib portions such as those shown in FIGS. 13 and 14 are provided in each ink chamber. The configuration in the peripheral part of the filter 166 is not limited to the configuration shown in FIG. 30, and may be, for example, a configuration in which the second connecting flow passage portion 164*b* located on the downstream side of the filter 166 inclines upward toward the downstream direction, as shown in FIG. 31, or may be a configuration in which the through hole 238 is formed in addition to the through hole 162*a*, as shown in FIGS. 32 and 33.

In the above-described configuration of the containing body case 130, an air bubble in the ink caught by the filter 166 moves upward along the inclined face of the filter 166 and is guided out to the second ink chamber 1521 from the flow passage opening 162. The air bubble guided out to the second ink chamber 1521 moves upward as-is and floats upward toward the liquid surface of the ink. At this time, since an ink chamber does not exist at a higher position in the up-down direction Z than the second ink chamber 1521, the air bubble in the second ink chamber 1521 moving into the other ink chambers can be avoided. Furthermore, as a result of the second ink chamber 1521 being in communication with the outside air via the air intake 148, it is possible to prevent a problem, such as deformation of the containing body case 130 caused by the pressure of an air bubble floating up to the liquid surface of the ink in the second ink chamber 1521.

Figure 36:
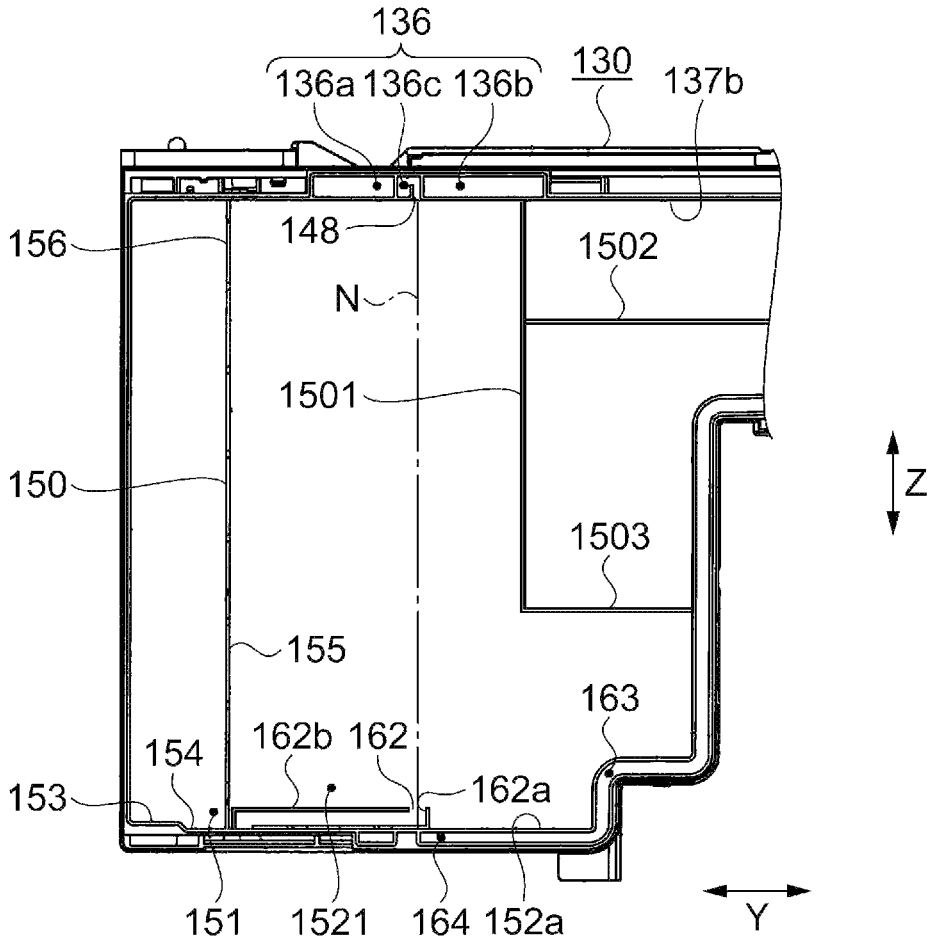
FIG. 36 is a partial side view of a containing body case in another embodiment.

Furthermore, as shown in FIG. 36, a cylinder portion 162*b* of the through hole 162*a* may be provided so as to extend in the front-rear direction Y along the bottom face 152*a*, such that the position of the flow passage opening 162 faces the position of the air intake 148 that is located above. That is to say, the flow passage opening 162 and the air intake 148 may be arranged at positions that overlap each other as seen in a plan view from the up-down direction Z. The line N connecting two facing points shown in FIG. 36 indicates that the flow passage opening 162 and the air intake 148 are in a facing state in the front-rear direction Y. The air intake 148 is open in the left-right direction X from the left side wall 130*b* of the containing body case 130 up to the case opening portion 132. Accordingly, the position of the flow passage opening 162 faces the position of the air intake 148.

As a result of the position of the flow passage opening 162 facing the position of the air intake 148, an air bubble coming from the filter 166 and guided out from the flow passage opening 162 via the cylinder portion 162*b* floats upward and reaches the liquid surface of the ink at a position corresponding to the air intake 148. Consequently, air bubbles gather on the lower face of the air intake 148, and the air bubbles can be efficiently discharged to the outside via the air intake 148.

Figure 37A:
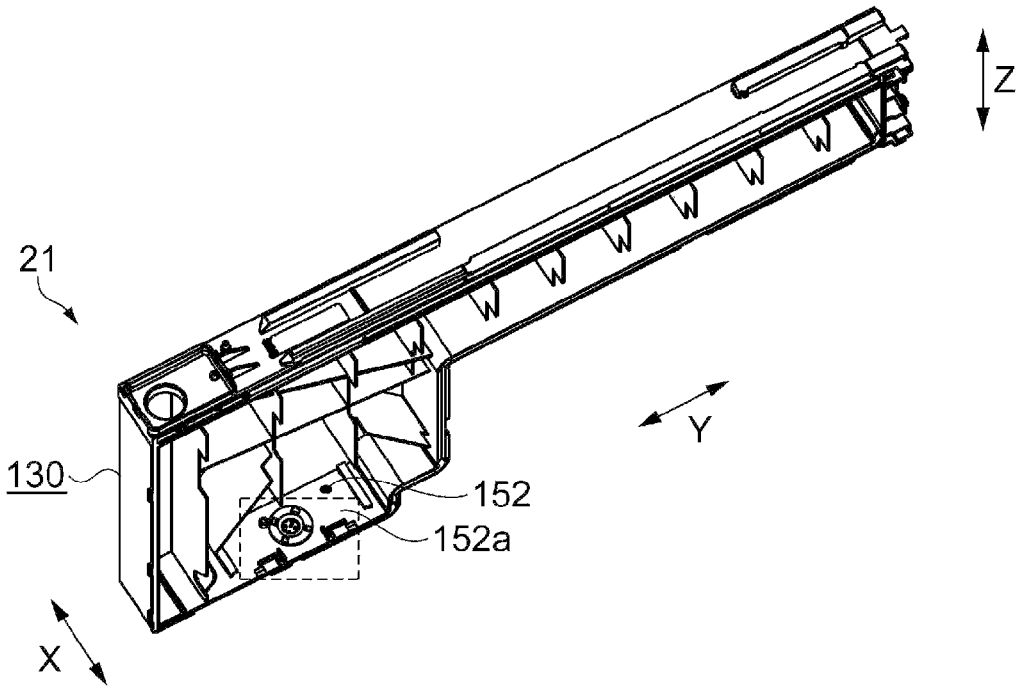
FIG. 37A is a perspective view of an attaching portion of a float valve in another embodiment.
Figure 37B:
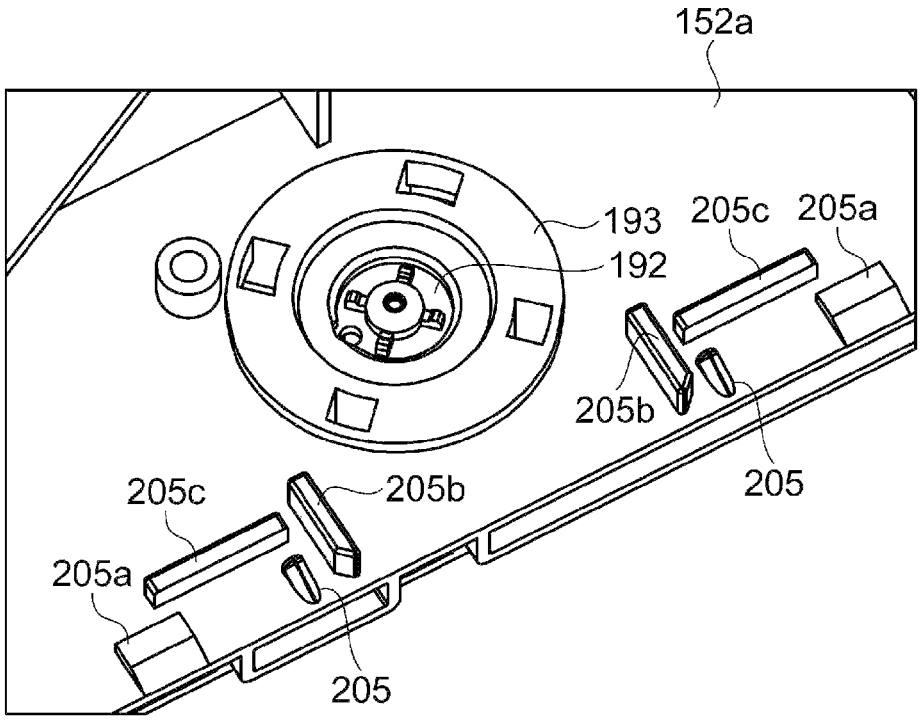
FIG. 37B is an enlarged view of the attaching portion of the float valve in FIG. 37A.

In the above embodiment, regarding the configuration in which the float valve 131 is attached into the containing body case 130, a configuration may be employed in which a protruding portion 205 group is formed in the bottom face 152*a* of the containing body case 130, as shown in FIGS. 37A and 37B. The protruding portion 205 group includes protruding portions 205*a*, 205*b*, and 205*c* that are formed at two positions in the front-rear direction Y on the near side of the containing body case 130, in addition to the protruding portions 205 shown in FIG. 22. Each of the protruding portions 205*a* is a structure that extends obliquely upward toward the far side of the containing body case 130 and is capable of undergoing elastic deformation, similarly to the protruding portions 205. The protruding portions 205*a* are provided in an inclined posture such that, when the hook portions 200 of the restriction case 183 shown in FIG. 22 are inserted into the interlocking rail portions 203 and moved by sliding toward the far side, the lower end edge of each side wall 196*a* can get over the protruding portions 205*a* while sliding from the near side toward the far side. The protruding portions 205*a* are provided at positions that are more separate in the front-rear direction Y from each other than the protruding portions 205, and can more reliably prevent the restriction case 183 from withdrawing from the far side of the containing body case 130 toward the near side thereof.

Each of the protruding portions 205*b* is a structure extending in the left-right direction X, abuts against the side wall 196*a* of the restriction case 183 on the near side, and fixes the position of the restriction case 183 in the front-rear direction Y. Each of the protruding portions 205*c* is a structure extending in the front-rear direction Y, abuts against the lower end edge of the side walls 196*a* that have got over the protruding portions 205 and the protruding portions 205*a* from the near side toward the far side, and fixes the position of the restriction case 183 in the left-right direction X.

With this protruding portion 205 group, even when a strong impact is applied to the liquid container 21, such as when the liquid container 21 falls in a state where the liquid container 21 is not installed in the apparatus body 14, it is possible to suppress trouble such as the float valve 131 withdrawing from the containing body case 130 or shifting from its appropriate position in the containing body case 130.

In the above embodiment, a configuration may be employed in which the cover 134 is not provided.

In the above embodiment, a configuration may be employed in which the injection port 73 is not provided.—In the above embodiment, the chip holder 76 may be included in the slider 34 by being inserted into the slider 34 from a direction aligned with the sliding direction of the slider 34 with respect to the liquid containing body 33, that is, from a direction aligned with the long direction of the slider 34. Furthermore, the recording chip 75 attached to the chip holder 76 does not necessarily have to be placed on the chip holder 76 in an inclined state with respect to the sliding direction of the slider 34. For example, the recording chip 75 may be placed on the chip holder 76 in a state parallel with the sliding direction, or in a state perpendicular thereto.

In the above embodiment, the groove-shaped portions 107, which serves as an example of the positioned shape portion that is positioned within the printer 11 when the moving area of the slider 34 moves into the printer 11, does not necessarily have to be provided in the chip holder 76. For example, in a case where the slider 34 is inserted into the installation portion 31 in a state where the slider 34 is positioned with respect to the communication portion 77, the positioned shape portion is not necessary.

In the above embodiment, the engaging portions (the groove portions 112) that engage with the openable/closable cover 74 does not necessarily have to be provided in the slider 34. For example, if a configuration is employed in which the bearing portions 90 of the openable/closable cover 74 engage with the rotation shaft 89 of the slider 34 in a tight-fitting state, the engaging portions are not necessary since a load on the rotation is obtained by this tight-fitting.

In the above embodiment, the openable/closable cover 74 does not necessarily have to be configured to rotate around the rotational center that is the axis extending in the short direction of the liquid containing body 33. For example, a configuration may be employed in which the openable/closable cover 74 moves parallel with the long direction of the slider 34 and is displaced from the covering position to the uncovering position.

In the above embodiment, the openable/closable cover 74 does not necessarily have to be provided in the slider 34 that is provided in a state of covering the injection port 73. In this case, the injection port 73 for the ink need only be exposed by withdrawing the slider 34 from the printer 11 (the installation portion 31).

In the above embodiment, the injection port 73 does not necessarily have to be provided in the upper face 39 located on the side in the direction opposite to the gravity direction in the liquid containing body 33. For example, the injection port 73 may be provided in a side face located on the horizontal direction side. Furthermore, the slider 34 does not necessarily have to be provided in a state of covering the injection port 73. In this case, a configuration may be employed in which the injection port 73 is covered with a member separate from the slider 34.

In the above embodiment, the configuration of the chip holder 76 is not necessarily limited to the configuration in which the chip holder 76 is attached to the holder attaching portion 86 of the slider 34. For example, a configuration may be employed in which the chip holder 76 is formed integrally with a part of the slider 34.

In the above embodiment, the medium is not limited to the paper S, and may be a plate-shaped member made of a material such as a metal plate, a resin plate, or cloth. That is to say, any kind of member with which recording (printing) can be performed using a liquid ejected by the liquid ejection head 24 may be employed as the medium.

In the above embodiment, the liquid consuming apparatus is not limited to the serial printer 11 in which the liquid ejection head 24 moves back and forth with the carriage 25, and may be a line-head printer that is capable of performing printing over a maximum paper width area while fixing the liquid ejection head 24.

In the above embodiment, the covering member 121 need only include at least the covering body 120.

In the above embodiment, an absorber capable of absorbing the ink may be arranged on the back face 74*a* of the openable/closable cover 74.

In the above embodiment, the connecting portion 125 does not have to have a shape that is bent several times on the liquid receiving face 116. For example, the connecting portion 125 may be formed into an L-shape as seen in a plan view, by bending a part of the connecting portion 125 only once. The connecting portion 125 may also be made of a metal chain or the like and be placed on the liquid receiving face 116.

In the above embodiment, the back face 74*a* of the openable/closable cover 74 does not have to be a face inclining downward toward the injection port 73 when the openable/closable cover 74 is located at the uncovering position. In this case, it is desirable that the aforementioned ink absorber is arranged at a portion on which the covering body 120 is placed in the back face 74*a* of the openable/closable cover 74.

In the above embodiment, the covering body 120 of the covering member 121 does not have to be placed on the back face 74*a* of the openable/closable cover 74.—In the above embodiment, the cutoff groove 118 may be provided at a position at the periphery of the injection port 73 excluding the peripheral wall portion 117. For example, the cutoff groove 118 may be formed at the opening edge 73*a* of the injection port 73. A projecting portion that protrudes upward from the peripheral wall portion 117 may also be provided in place of the cutoff groove 118 serving as the recess portion. Note that, in this case, it is desirable that two projecting portions are provided such that the liquid injection source 126 can be positioned from both sides.

In the above embodiment, the area of the wall communication opening 155 may be the same as the area of the injection port 73. The area of the wall communication opening 155 may also be larger than the area of the injection port 73.

In the above embodiment, a configuration may be employed in which the filter 166 is not provided. The filter 166 may also be provided so as to cover the flow passage opening 162 within the second ink chamber 152.

In the above embodiment, a configuration may be employed in which the float valve 131 is not provided.—In the above embodiment, a configuration may be employed in which the inclined rib portions 158*a* to 158*d* are not provided. A configuration may also be employed in which the inclined rib portions 158*a* to 158*d* are individually provided, and the inclined rib portion(s) to be provided may be arbitrarily selected from among the inclined rib portions 158*a* to 158*d*. For example, a configuration may be employed in which only one of the inclined rib portions 158*a* to 158*d* is provided. Furthermore, for example, a configuration may be employed in which any two of the inclined rib portions, such as the third inclined rib portion 158*c* and the fourth inclined rib portion 158*d*, are provided, or any three of the inclined rib portions, such as the first to third inclined rib portions 158*a* to 158*c*, are provided.

In the above embodiment, the inclined rib portions 158*a* to 158*d* may not only extend in a direction, but also partially bend or curve. That is to say, for example, the inclined rib portions 158*a* to 158*d* may have both a portion extending in the gravity direction and a portion intersecting the gravity direction.

In the above embodiment, the third inclined rib portion 158*c* and the fourth inclined rib portion 158*d* do not have to be axially symmetric. That is to say, for example, one of the third inclined rib portion 158*c* and the fourth inclined rib portion 158*d* may be formed so as to be shifted in the up-down direction Z. The axis serving as the reference of the axial symmetry of the third inclined rib portion 158*c* and the fourth inclined rib portion 158*d* may pass through the float valve 131 at any position, as long as the axis is aligned with the gravity direction. Furthermore, the third inclined rib portion 158*c* and the fourth inclined rib portion 158*d* may be partially axially symmetric with respect to an axis.

In the above embodiment, the inclined rib portions 158*a* to 158*d* may be formed so as to extend in the front-rear direction Y. The inclined rib portions 158*a* to 158*d* may be formed so as to extend in a direction intersecting the left-right direction X.

In the above embodiment, the inclined rib portions 158*a* to 158*d* may be provided such that the positions thereof are shifted from the flow passage opening 162 in the up-down direction Z.—In the above embodiment, the flow passage opening 162 may be formed at a position other than the bottom face 152*a*. For example, a flow passage opening may be formed in the side wall 130*b*. Furthermore, the flow passage opening 162 may be formed at a position separate from the partition wall 150. That is to say, the distance L1 may be longer than the distance L2.

In the above embodiment, a configuration may be employed in which the recess portion 154 is not provided in the bottom face 153. The recess portion 154 may also be formed so as to be recessed in a direction intersecting the gravity direction. Furthermore, the recess portion 154 may be formed so as to coincide with the virtual injection line M. That is to say, the recess portion 154 may be formed at a position on the side in the gravity direction with respect to the injection port 73. Note that the recess portion 154 and the injection port 73 are different in shape as seen in a top view, and the recess portion 154 is larger in the left-right direction X than the injection port 73. For this reason, even if the recess portion 154 is formed at a position on the side in the gravity direction with respect to the injection port 73, a part of the recess portion 154 is located at a position shifted from the injection port 73 in a direction intersecting the gravity direction. For this reason, the recess portion 154 may be formed so as to be smaller than the injection port 73 as seen in a top view, or the injection port 73 and the recess portion 154 may be formed into the same shape.

In the above embodiment, a configuration may be employed in which the liquid container 21 does not include the slider 34. That is to say, the liquid container 21 may be constituted only by the liquid containing body 33.—In the above embodiment, the partition wall 150 may be provided so as to intersect the up-down direction Z.

In the above embodiment, a configuration may be employed in which the containing body case 130 does not include the intersecting rib portions 157*a* to 157*i*.—In the above embodiment, a configuration may be employed in which the containing body case 130 does not include the partition wall 150.

In the above embodiment, the upper face 155*c* of the wall communication opening 155 may be formed so as to be aligned with the horizontal direction.—In the above embodiment, the cross-sectional area of the inclined flow passage portion 165 may be the same as the cross-sectional area of the connecting flow passage portion 164. The cross-sectional area of the inclined flow passage portion 165 may be larger than the cross-sectional area of the bent flow passage portion 163. The cross-sectional area of the inclined flow passage portion 165 may be smaller than the cross-sectional area of the connecting flow passage portion 164 and the cross-sectional area of the bent flow passage portion 163.

In the above embodiment, the inclined flow passage portion 165 may be provided at a position shifted from the lower side position of the ink chamber 137 in the gravity direction. That is to say, for example, the inclined flow passage portion 165 may be provided so as to be adjacent to the ink chamber 137 via the side wall 130*b*.

In the above embodiment, the valve body 182 fixed to the bottom face 152*a* of the second ink chamber 152 may be omitted, and the pressing portion 189 protruding vertically downward from the lower face of the float member 181 may function as a valve body capable of closing the valve port 192 when the pressing portion 189 moves downward.

In the above embodiment, the cross-sectional shape of the plate-shaped portions 191, each functioning as an example of the restricting abutting portion for the restriction case 183 in the float member 181, may be other than the cross shape. In short, the shape of the plate-shaped portions 191 can be arbitrarily changed as long as the plate-shaped portions 191 are in a relationship in which the distance of the interval between the area constituting each restricting abutting portion and the inner face of the cylindrical portion 198 is smaller than the distance of the interval between each thin film member 186 and the inner face of the loop wall portion 196.

In the above embodiment, the shape of the passing holes 202 of the restriction case 183 is not limited to a rectangular shape, and may be a round shape, a triangle shape or a cutoff shape. In short, the shape of the passing holes 202 may be arbitrarily changed as long as it is a shape that allows the ink to flow therethrough when the float member 181 floats.

In the above embodiment, the cutout portions 199 formed in the side walls 196*a* aligned with the front-rear direction Y in the restriction case 183 may be omitted. Alternatively, these cutout portions 199 may be formed in the side walls 196*b* aligned with the left-right direction X. In this case as well, these cutout portions 199 can bring the inside and the outside of the restriction case 183 into communication with each other and allow the ink to flow therethrough, and can also perform a function of reducing the possibility that the float member 181 slides when floating.

In the above embodiment, the coil spring 195 having the second biasing force that biases the valve body 182 toward the above valve opening position may be omitted.—In the above embodiment, the float member 181 need only include at least one gas chamber 187. That is to say, the number of gas chambers 187 is not necessarily limited to four, and need only be one or more, such as two, three, or five.

In the above embodiment, the partition wall 150 that partitions the ink chamber 137 into the first ink chamber 151 and the second ink chamber 152 may be omitted. That is to say, a configuration may be employed in which the liquid containing body 33 includes only one ink chamber 137, and the float valve 131 is arranged within this single ink chamber 137.

In the above embodiment, the shape of the restriction case 183 is not limited to a box shape, and may be arbitrarily changed as long as the restriction case 183 has the loop wall portion 196 that surrounds the float member 181 so as to protect the float member 181 against the inflow pressure of the ink flowing into the second ink chamber 152.

In the above embodiment, the restriction member may have a frame-body shape, rather than a box shape such as the shape of the restriction case 183. In short, the shape of the restriction member can be arbitrarily changed as long as the restriction member has a configuration in which, when the float member 181 floats upward with a rise of the liquid surface of the ink, the restriction member abuts against the float member 181 and restricts the float member 181 so as to stop the upward floating at a position lower than the ceiling of the ink chamber 137.

In the above embodiment, the thin film members 186 that close the opening portions 185*a* of the float member 181 and form the gas chambers 187 may be, for example, thin resin sheets, plates, or the like, rather than films.

In the above embodiment, the state of posture of the liquid container 21 when in use may be other than the state where the liquid container 21 is installed in the installation portion 31 of the printer 11 and is fixed to the printer 11 so as to be unable to move, and a use mode may be employed in which the liquid container 21 is connected in a state of being placed on a side of the printer 11 so as to be able to supply a liquid using a tube.

Although the liquid container and the liquid injection source have been described in the above embodiment, both can be expressed as a liquid vessel.—In the above embodiment, the liquid consuming apparatus may be a liquid ejection apparatus that ejects or discharges a liquid other than the ink. Note that the state of the liquid discharged as a miniscule droplets from the liquid ejection apparatus includes a granular shape, a tear-drop shape, and a shape having a thread-like trailing end. Furthermore, the liquid mentioned here may be any kind of material that can be ejected from the liquid ejection apparatus. For example, the liquid need only be a material whose substance is in the liquid phase, and includes fluids such as inorganic solvent, organic solvent, solution, liquid resin, and liquid metal (metal melt) in the form of a liquid body having a high or low viscosity, sol, gel water, or the like. Furthermore, the liquid is not limited to being a one-state substance, and also includes particles of a functional material made from solid matter, such as pigment or metal particles, that are dissolved, dispersed, or mixed in a solvent. Representative examples of the liquid include ink, such as the ink described in the above embodiment, and liquid crystal. Here, the "ink" encompasses various liquid compositions, such as general water-based ink and oil-based ink, a gel ink, and a hot melt ink. As specific examples of the liquid ejection apparatus, there are liquid ejection apparatuses that eject a liquid containing, in the form of dispersion or dissolution, a material such as an electrode material or a color material used in manufacturing or the like of a liquid crystal display, an EL (electro-luminescence) display, a surface-emitting display, or a color filter, for example. The liquid ejection apparatus may also be a liquid ejection apparatus that ejects biological organic matter used in manufacturing of a biochip, a liquid ejection apparatus that is used as a precision pipette and ejects a liquid serving as a sample, a textile printing apparatus, a microdispenser, or the like. Furthermore, the liquid ejection apparatus may also be a liquid ejection apparatus that ejects lubricating oil in a pinpoint manner to a precision machine such as a watch or a camera, or a liquid ejection apparatus that ejects a transparent resin liquid such as ultraviolet-cured resin onto a substrate, in order to form a micro-hemispherical lens (optical lens) or the like that is used in an optical communication device or the like. Furthermore, the liquid ejection apparatus may be a liquid ejection apparatus that ejects an etchant that is acid, alkaline, or the like, for etching a substrate or the like.

What is claimed is:

1. A liquid container containing a liquid comprising:

a flow passage that is formed in the liquid container and through which the liquid flows;

a flow passage opening that is in communication with the flow passage; and a filter provided in the middle of the flow passage, wherein the filter inclines in a direction with respect to a horizontal direction, wherein the filter is disposed at a position lower than a position of the flow passage opening, so that an air bubble caught by the filter moves upward into the flow passage opening.

2. The liquid container according to claim 1, wherein the filter inclines such that an end portion of the filter that is located on an upstream side of the liquid passing through the filter is located vertically above an end portion of the filter that is located on a downstream side of the liquid.

3. The liquid container according to claim 1, further comprising a plurality of liquid containing chambers each containing a liquid, wherein the filter is provided in a filter chamber, and the filter chamber is in communication with a liquid containing chamber located at the highest position in a vertical direction, among the plurality of liquid containing chambers.

4. The liquid container according to claim 3, wherein the liquid containing chamber that is in communication with the filter chamber is provided with a rib that inclines with respect to the horizontal direction.

5. The liquid container according to claim 3, wherein a vertically upper face of the liquid containing chamber that is in communication with the filter chamber is provided with an air intake that is capable of taking, into the liquid containing chamber, the air coming from the outside of the liquid container.

6. The liquid container according to claim 5, wherein the liquid containing chamber that is in communication with the filter chamber is provided with the flow passage opening that guides out, to the liquid containing chamber, an air bubble coming from the filter chamber, and the flow passage opening and the air intake are arranged at positions that overlap each other as seen in a plan view from the vertical direction.

7. The liquid container according to claim 3, wherein the flow passage inclines so as to be located vertically above further on a downstream side of the filter chamber.

8. The liquid container according to claim 1, further comprising a float portion that floats with a change of a remaining amount of the liquid contained in the liquid container, wherein the filter inclines such that an end portion of the filter that is located on the side of the float portion is located vertically below an end portion of the filter that is located on a side opposite to the float portion.

9. The liquid container according to claim 1, wherein the filter is arranged such that the liquid passes therethrough from below to above in the vertical direction.

* * * * *